US010438440B2

(12) United States Patent
Arnone et al.

(10) Patent No.: US 10,438,440 B2
(45) Date of Patent: Oct. 8, 2019

(54) INTEGRATED WAGERING PROCESS INTERLEAVED SKILL WAGERING GAMING SYSTEM

(71) Applicant: Gamblit Gaming, LLC, Glendale, CA (US)

(72) Inventors: Miles Arnone, Sherborn, MA (US); David Chang, San Gabriel, CA (US); Frank Cire, Pasadena, CA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 195 days.

(21) Appl. No.: 15/345,451

(22) Filed: Nov. 7, 2016

(65) Prior Publication Data

US 2017/0124801 A1 May 4, 2017

Related U.S. Application Data

(63) Continuation of application No. PCT/US2015/029798, filed on May 7, 2015.
(Continued)

(51) Int. Cl.
*G07F 17/32* (2006.01)

(52) U.S. Cl.
CPC ..... *G07F 17/3223* (2013.01); *G07F 17/3211* (2013.01); *G07F 17/3244* (2013.01); *G07F 17/3286* (2013.01)

(58) Field of Classification Search
CPC ..... G07F 17/3223; G07F 17/3211; G07F 17/3244; G07F 17/3286
See application file for complete search history.

(56) References Cited

U.S. PATENT DOCUMENTS 5,413,357 A 5/1995 Schulze et al.
5,718,429 A 2/1998 Keller
(Continued)

OTHER PUBLICATIONS

U.S. Appl. No. 15/063,365 Arnone, et al. filed Mar. 7, 2016.
(Continued)

*Primary Examiner* — Corbett B Coburn
(74) *Attorney, Agent, or Firm* — Frank Cire

(57) ABSTRACT

A integrated wagering process interleaved wagering system is disclosed, including an interactive controller configured to: communicate application telemetry comprising a random event occurrence and wager occurrence; receive a resolution to the random event occurrence; display the random event resolution; receive a wager resolution; and display the wager resolution; a wager controller constructed to: receive random outcome request; determine a sequence of at least one random outcome; and communicate random outcome data comprising the sequence; and the application controller operatively connecting the interactive controller and the wager controller, constructed to: determine the random event occurrence and the wager occurrence; communicate the random outcome request; receive the random outcome data; determine the resolution to the occurrence of the at least one random event and the resolution to the occurrence of the at least one wagering event based on the sequence of at least one random outcome; communicate the resolution and wager outcome.

8 Claims, 31 Drawing Sheets

Related U.S. Application Data

(60) Provisional application No. 61/989,876, filed on May 7, 2014.

(56) References Cited

U.S. PATENT DOCUMENTS

| | | | |
|---|---|---|---|
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat |
| 6,267,669 | B1 | 7/2001 | Luciano |
| 6,685,563 | B1 | 2/2004 | Meekins et al. |
| 6,712,693 | B1 | 3/2004 | Hettinger |
| 6,761,632 | B2 | 7/2004 | Bansemer et al. |
| 6,761,633 | B2 | 7/2004 | Riendeau |
| 6,764,397 | B1 | 7/2004 | Robb |
| 6,811,482 | B2 | 11/2004 | Letovsky |
| 7,118,105 | B2 | 10/2006 | Benevento |
| 7,294,058 | B1 | 11/2007 | Slomiany |
| 7,326,115 | B2 | 2/2008 | Baerlocher |
| 7,361,091 | B2 | 4/2008 | Letovsky |
| 7,517,282 | B1 | 4/2009 | Pryor |
| 7,575,517 | B2 | 8/2009 | Parham et al. |
| 7,682,239 | B2 | 3/2010 | Friedman et al. |
| 7,720,733 | B2 | 5/2010 | Jung |
| 7,753,770 | B2 | 7/2010 | Walker et al. |
| 7,753,790 | B2 | 7/2010 | Nguyen |
| 7,766,742 | B2 | 8/2010 | Bennett et al. |
| 7,775,885 | B2 | 8/2010 | Van Luchene |
| 7,798,896 | B2 | 9/2010 | Katz |
| 7,828,657 | B2 | 11/2010 | Booth |
| 7,917,371 | B2 | 3/2011 | Jung et al. |
| 7,931,531 | B2 | 4/2011 | Oberberger |
| 7,938,727 | B1 | 5/2011 | Konkle |
| 7,950,993 | B2 | 5/2011 | Oberberger |
| 7,967,674 | B2 | 6/2011 | Baerlocher |
| 7,980,948 | B2 | 7/2011 | Rowe |
| 7,996,264 | B2 | 8/2011 | Kusumoto et al. |
| 8,012,023 | B2 | 9/2011 | Gates |
| 8,047,908 | B2 | 11/2011 | Walker |
| 8,047,915 | B2 | 11/2011 | Lyle |
| 8,060,829 | B2 | 11/2011 | Jung et al. |
| 3,075,383 | A1 | 12/2011 | Friedman et al. |
| 8,087,999 | B2 | 1/2012 | Oberberger |
| 8,113,938 | B2 | 2/2012 | Friedman et al. |
| 8,118,654 | B1 | 2/2012 | Nicolas |
| 8,128,487 | B2 | 3/2012 | Hamilton et al. |
| 8,135,648 | B2 | 3/2012 | Oram |
| 8,137,193 | B1 | 3/2012 | Kelly et al. |
| 8,142,272 | B2 | 3/2012 | Walker |
| 8,157,653 | B2 | 4/2012 | Buhr |
| 8,167,699 | B2 | 5/2012 | Inamura |
| 8,177,628 | B2 | 5/2012 | Manning |
| 8,182,338 | B2 | 5/2012 | Thomas |
| 8,182,339 | B2 | 5/2012 | Anderson |
| 8,187,068 | B2 | 5/2012 | Slomiany |
| 8,206,210 | B2 | 6/2012 | Walker |
| 8,308,544 | B2 | 11/2012 | Friedman |
| 8,430,735 | B2 | 4/2013 | Oberberger |
| 3,480,470 | A1 | 7/2013 | Napolitano et al. |
| 8,475,266 | B2 | 7/2013 | Arnone |
| 8,622,809 | B1 | 1/2014 | Arora et al. |
| 8,864,564 | B2 | 10/2014 | Oberberger |
| 2001/0004609 | A1 | 6/2001 | Walker et al. |
| 2001/0019965 | A1 | 9/2001 | Ochi |
| 2002/0022509 | A1 | 2/2002 | Nicastro et al. |
| 2002/0090990 | A1 | 7/2002 | Joshi et al. |
| 2002/0175471 | A1 | 11/2002 | Faith |
| 2003/0060286 | A1 | 3/2003 | Walker et al. |
| 2003/0119576 | A1 | 6/2003 | McClintic et al. |
| 2003/0139214 | A1 | 7/2003 | Wolf et al. |
| 2003/0171149 | A1 | 9/2003 | Rothschild |
| 2003/0204565 | A1 | 10/2003 | Guo et al. |
| 2003/0211879 | A1 | 11/2003 | Englman |
| 2004/0092313 | A1 | 5/2004 | Saito et al. |
| 2004/0097610 | A1 | 5/2004 | Saito |
| 2004/0102238 | A1 | 5/2004 | Taylor |
| 2004/0121839 | A1 | 6/2004 | Webb |
| 2004/0225387 | A1 | 11/2004 | Smith |
| 2005/0003878 | A1 | 1/2005 | Updike |
| 2005/0096124 | A1 | 5/2005 | Stronach |
| 2005/0116411 | A1 | 6/2005 | Herrmann et al. |
| 2005/0192087 | A1 | 9/2005 | Friedman et al. |
| 2005/0233791 | A1 | 10/2005 | Kane |
| 2005/0233806 | A1 | 10/2005 | Kane et al. |
| 2005/0239538 | A1 | 10/2005 | Dixon |
| 2005/0269778 | A1 | 12/2005 | Samberg |
| 2005/0288101 | A1 | 12/2005 | Lockton et al. |
| 2006/0003823 | A1 | 1/2006 | Zhang |
| 2006/0003830 | A1 | 1/2006 | Walker et al. |
| 2006/0035696 | A1 | 2/2006 | Walker |
| 2006/0040735 | A1 | 2/2006 | Baerlocher |
| 2006/0068913 | A1 | 3/2006 | Walker et al. |
| 2006/0084499 | A1 | 4/2006 | Moshal |
| 2006/0084505 | A1 | 4/2006 | Yoseloff |
| 2006/0135250 | A1 | 6/2006 | Rossides |
| 2006/0154710 | A1 | 7/2006 | Serafat |
| 2006/0166729 | A1 | 7/2006 | Saffari et al. |
| 2006/0189371 | A1 | 8/2006 | Walker et al. |
| 2006/0223611 | A1 | 10/2006 | Baerlocher |
| 2006/0234791 | A1 | 10/2006 | Nguyen et al. |
| 2006/0240890 | A1 | 10/2006 | Walker |
| 2006/0246403 | A1 | 11/2006 | Monpouet et al. |
| 2006/0258433 | A1 | 11/2006 | Finocchio et al. |
| 2007/0026924 | A1 | 2/2007 | Taylor |
| 2007/0035548 | A1 | 2/2007 | Jung et al. |
| 2007/0038559 | A1 | 2/2007 | Jung et al. |
| 2007/0064074 | A1 | 3/2007 | Silverbrook et al. |
| 2007/0087799 | A1 | 4/2007 | Van Luchene |
| 2007/0093299 | A1 | 4/2007 | Bergeron |
| 2007/0099696 | A1 | 5/2007 | Nguyen et al. |
| 2007/0117641 | A1 | 5/2007 | Walker et al. |
| 2007/0129149 | A1 | 6/2007 | Walker |
| 2007/0142108 | A1 | 6/2007 | Linard |
| 2007/0156509 | A1 | 7/2007 | Jung et al. |
| 2007/0167212 | A1 | 7/2007 | Nguyen |
| 2007/0167239 | A1 | 7/2007 | O'Rourke |
| 2007/0173311 | A1 | 7/2007 | Morrow et al. |
| 2007/0191104 | A1 | 8/2007 | Van Luchene |
| 2007/0202941 | A1 | 8/2007 | Miltenberger |
| 2007/0203828 | A1 | 8/2007 | Jung et al. |
| 2007/0207847 | A1 | 9/2007 | Thomas |
| 2007/0259717 | A1 | 11/2007 | Mattice |
| 2007/0293306 | A1 | 12/2007 | Nee et al. |
| 2008/0004107 | A1 | 1/2008 | Nguyen et al. |
| 2008/0014835 | A1 | 1/2008 | Weston et al. |
| 2008/0015004 | A1 | 1/2008 | Gatto et al. |
| 2008/0064488 | A1 | 3/2008 | Oh |
| 2008/0070659 | A1 | 3/2008 | Naicker |
| 2008/0070690 | A1 | 3/2008 | Van Luchene |
| 2008/0070702 | A1 | 3/2008 | Kaminkow |
| 2008/0096665 | A1 | 4/2008 | Cohen |
| 2008/0108406 | A1 | 5/2008 | Oberberger |
| 2008/0108425 | A1 | 5/2008 | Oberberger |
| 2008/0113704 | A1 | 5/2008 | Jackson |
| 2008/0119283 | A1 | 5/2008 | Baerlocher |
| 2008/0146308 | A1 | 6/2008 | Okada |
| 2008/0161081 | A1 | 7/2008 | Berman |
| 2008/0176619 | A1 | 7/2008 | Kelly |
| 2008/0191418 | A1 | 8/2008 | Lutnick et al. |
| 2008/0195481 | A1 | 8/2008 | Lutnick |
| 2008/0248850 | A1 | 10/2008 | Schugar |
| 2008/0254893 | A1 | 10/2008 | Patel |
| 2008/0274796 | A1 | 11/2008 | Lube |
| 2008/0274798 | A1 | 11/2008 | Walker et al. |
| 2008/0311980 | A1 | 12/2008 | Cannon |
| 2008/0318668 | A1 | 12/2008 | Ching |
| 2009/0011827 | A1 | 1/2009 | Englman |
| 2009/0023489 | A1 | 1/2009 | Toneguzzo |
| 2009/0023492 | A1 | 1/2009 | Erfanian |
| 2009/0061974 | A1 | 3/2009 | Lutnick et al. |
| 2009/0061975 | A1 | 3/2009 | Ditchev |
| 2009/0061991 | A1 | 3/2009 | Popovich |

(56) References Cited

U.S. PATENT DOCUMENTS

2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0209317 A1* 8/2009 Gomez ..... G07F 17/3244 463/20
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0151968 A1 6/2011 Chan et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0077577 A1* 3/2012 Michaelson ..... G07C 15/006 463/26
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0357350 A1 12/2014 Weingardt et al.

OTHER PUBLICATIONS

U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.

(56) References Cited

OTHER PUBLICATIONS

U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 14/205,303 Arnone, et al., filed Mar. 11, 2014.
U.S. Appl. No. 14/205,306 Arnone, et al., filed Mar. 11, 2014.

(56) References Cited

OTHER PUBLICATIONS

U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
WIPO/ISA International Search Report and Written Opinion, PCT/US15/029798, dated Aug. 28, 2015.

* cited by examiner

INTEGRATED WAGERING PROCESS INTERLEAVED SKILL WAGERING GAMING SYSTEM

CROSS REFERENCE TO RELATED APPLICATIONS

The current application is a continuation of Patent Cooperation Treaty Application No. PCT/US15/29798, filed May 7, 2015, which claims priority to U.S. Provisional Patent Application No. 61/989,876, filed May 7, 2014, the disclosures of each of which are incorporated by reference herein in their entirety.

FIELD OF THE INVENTION

Embodiments of the present invention are generally related to communications within data processing systems. More particularly, the present invention relates to the communication and processing of wagering data.

BACKGROUND

The gaming industry has traditionally developed electronic gaming machines that present simple gambling games to a user. The communication and processing needs for these simple gambling games are easily met using conventional processing systems.

For example, U.S. Pat. No. 6,905,405 to McClintic describes a conventional gaming device provided with a central processor (CPU) operably coupled to input logic circuitry and output logic circuitry. The input logic circuitry is employed to operably couple CPU to input devices such as, for example, a touch screen segment or physical button, a coin acceptor, a bill acceptor, a player tracking card reader or a credit/debit card reader. The output logic circuitry is employed to operably couple the CPU with output devices such as, for example, a hopper, a video monitor, meter displays, and a printer. The CPU is also operably coupled to controlling software memory, which includes assigned memory locations storing game software and system software. Such controlling software memory dictates when selected graphics or messages are displayed to a player, as well as when play sequences begin and end and management of wager input and award output. The CPU is also operably coupled to a second memory, which is employed to store data indicative of game statistics, number of plays, number of wins, etc. Controlling software memory, a second memory, or other, ancillary memory store data indicative of winning results, such as data representative of one or more symbol combinations, including winning combinations. Second memory may also be used, for example, to store a bit map of the symbol pattern depicted as a matrix display on video monitor. In operation of the gaming device the CPU carries out instructions of the system software to implement an initial display pattern on the video monitor and to enable the input devices. After a wager is received a player activates an initiator element such as a handle, the physical button or the touch screen to initiate a play sequence. At this point, the game software, in conjunction with a random number generator, generates a random symbol configuration at for a random final outcome comprised of a pattern of symbols for depiction on video monitor. System software then animates the video monitor by simulating the movement of visible representations of symbol carriers including symbols thereon so that the player perceives symbol carrier rotational "movement" of each symbol carrier as well as, optionally, rotational movement of the entire group of symbol carriers about a common axis. Once the visible representations of the symbol carriers have stopped, all of the generated, displayed symbols comprising a winning combination or combinations in the matrix display are identified or flagged. The displayed results (pattern of symbols depicted on the video monitor, which may include symbols received from a remote location, is compared with data stored in game software representing winning combinations to determine if any displayed combination on an active pay line is a winning combination. Any identified winning combination or combinations of symbols are then associated with winnings to be distributed to the player according to a paytable of the game software associated with the various possible winning combinations. The various pay line configurations and required combinations of the various indicia for a winning combination within each pay line reside within the game software and are retrieved for comparison to the randomly generated pattern of indicia depicted on the video monitor.

Operation of another conventional computer gaming system is described in U.S. Pat. No. 6,409,602 issued to Wiltshire et al. A game program is executed on server/host computer. It is then determined whether an image is to be displayed on a screen of a client/terminal computer. If so, an image is sent from the server/host computer to client/terminal computer. The image may include any type of graphical information including a bitmap, a JPEG file, a TIFF file or even an encoded audio/video stream such as a compressed video MPEG stream. The image is generated by game computer program and passed to server/host interface program. In turn, the image is transferred over communication pathways to client/terminal computer via the network services provided by server operating system. The image is received by a client/terminal program executing on the client/terminal computer via the network services provided by client operating system. The client/terminal program then causes the image to be displayed on a screen of the client/terminal computer. It is then determined whether an input command has been entered by the patron using the client/terminal computer. The input command may be a keystroke, movement or clicking of the mouse, a voice activated command or even the clicking of a "virtual button" on a touch screen. The client/terminal program causes the input command to be transmitted back to server/host computer via communication pathways, again using network services provided by the client operating system on one end and server operating system on the other. The command is thus received by the server/host interface program, that, in turn, passes the command back to the game program. The game program processes the input command and updates the state of the game accordingly.

However, more complicated wagering processes need communication and processing systems that are better suited for implementing these more complicated wagering processes. Various aspects of embodiments of the present invention meet such a need.

SUMMARY OF THE INVENTION

Systems and methods in accordance with embodiments of the invention provide a communication and data processing system constructed for an integrated wagering process interleaved wagering system.

In some

An embodiment includes an interactive controller configured to: communicate, to an application controller, application telemetry comprising an occurrence of at least one random event and an occurrence of at least one wagering event; receive, from the application controller, resolution instructions comprising a resolution to the occurrence of the at least one random event; integrate the resolution to the occurrence of the at least one random event within the interactive application based on the resolution instructions; display the resolution to the occurrence of the at least one random event; receive, from the application controller, wager outcome instructions comprising a resolution to the occurrence of the at least one wagering event; and display the resolution to the occurrence of the at least one wagering event based on the wager outcome instructions; a wager controller constructed to: receive, from the application controller, random outcome request instructions; determine a sequence of at least one random outcome based on the random outcome request instructions; and communicate, to the application controller, random outcome data comprising the sequence of at least one random outcome; and the application controller operatively connecting the interactive controller and the wager controller, the application controller constructed to: receive, from the interactive controller, the application telemetry; scan the application telemetry to determine the occurrence of at least one random event and the occurrence of at least one wagering event; generate the random outcome request instructions based on determination of the occurrence of at least one random event and the occurrence of at least one wagering event; instruct the wager controller by communicating the random outcome request instructions to the wager controller; receive, from the wager controller, the random outcome data; scan the random outcome data to determine the sequence of at least one random outcome; determine the resolution to the occurrence of the at least one random event and the resolution to the occurrence of the at least one wagering event based on the sequence of at least one random outcome; generate the resolution instructions using the resolution to the occurrence of the at least one random event; instruct the interactive controller by communicating the resolution instructions to the interactive controller; generate the wager outcome instructions using the resolution to the occurrence of the at least one wagering event; and instruct the interactive controller by communicating the wager outcome instructions to the interactive controller.

In a further embodiment, the interactive controller and the application controller are constructed from the same device, and the application controller is operatively connected to the wager controller using a communication link. In a further embodiment, the wager controller and the application controller are constructed from the same device, and the application controller is operatively connected to the interactive controller using a communication link.

In a further embodiment, the determining of the sequence of one or more random outcomes comprises caching one or more intermediate random outcomes, and the resolution to the occurrence of the at least one wagering event is based on the cache of one or more intermediate random outcomes.

In a further embodiment, the application controller is further constructed to cache one or more intermediate random outcomes of the sequence of one or more random outcomes.

In a further embodiment, the resolution to the occurrence of the at least one random event is based on the cached one or more intermediate random outcomes.

In a further embodiment, the application controller is further constructed to: receive, from a user management system, user information; and determine the resolution to the occurrence of the at least one wagering event based on the sequence of one or more random outcomes and the user information.

In a further embodiment, the application controller is further constructed to: receive, from a game provider system, game provider information; and determine the resolution to the occurrence of the at least one wagering event based on the sequence of one or more random outcomes and the game provider information.

An embodiment includes a wager controller constructed to: receive, from an application controller, random outcome request instructions; determine a sequence of at least one random outcome based on the random outcome request instructions; and communicate, to the application controller, random outcome data comprising the sequence of at least one random outcome; and the application controller operatively connecting an interactive controller and the wager controller, the application controller constructed to: receive, from the interactive controller, application telemetry comprising an occurrence of at least one random event and an occurrence of at least one wagering event; scan the application telemetry to determine an occurrence of at least one random event and an occurrence of at least one wagering event; generate the random outcome request instructions based on determination of the occurrence of at least one random event and the occurrence of at least one wagering event; instruct the wager controller by communicating the random outcome request instructions to the wager controller; receive, from the wager controller, the random outcome data; scan the random outcome data to determine the sequence of at least one random outcome; determine a resolution to the occurrence of the at least one random event and a resolution to the occurrence of the at least one wagering event based on the sequence of at least one random outcome; generate resolution instructions using the resolution to the occurrence of the at least one random event; instruct the interactive controller by communicating the resolution instructions to the interactive controller; generate wager outcome instructions using the resolution to the occurrence of the at least one wagering event; and instruct the interactive controller by communicating the wager outcome instructions to the interactive controller.

An embodiment includes an interactive controller configured to: communicate, to an application controller, application telemetry comprising an occurrence of at least one random event and an occurrence of at least one wagering event; receive, from the application controller, resolution instructions comprising a resolution to the occurrence of the at least one random event; integrate the resolution to the occurrence of the at least one random event within the interactive application based on the resolution instructions; display the resolution to the occurrence of the at least one random event; receive, from the application controller, wager outcome instructions comprising a resolution to the occurrence of the at least one wagering event; and display the resolution to the occurrence of the at least one wagering event based on the wager outcome instructions; and the application controller operatively connecting the interactive controller and a wager controller, the application controller constructed to: receive, from the interactive controller, the application telemetry; scan the application telemetry to determine the occurrence of at least one random event and the occurrence of at least one wagering event; generate random outcome request instructions based on determination of the occurrence of at least one random event and the occurrence of at least one wagering event; instruct the wager controller by communicating the random outcome request instructions to the wager controller; receive, from the wager controller, random outcome data; scan the random outcome data to determine a sequence of at least one random outcome; determine the resolution to the occurrence of the at least one random event and the resolution to the occurrence of the at least one wagering event based on the sequence of at least one random outcome; generate the resolution instructions using the resolution to the occurrence of the at least one random event; instruct the interactive controller by communicating the resolution instructions to the interactive controller; generate the wager outcome instructions using the resolution to the occurrence of the at least one wagering event; and instruct the interactive controller by communicating the wager outcome instructions to the interactive controller.

DETAILED DESCRIPTION

Figure 1A:
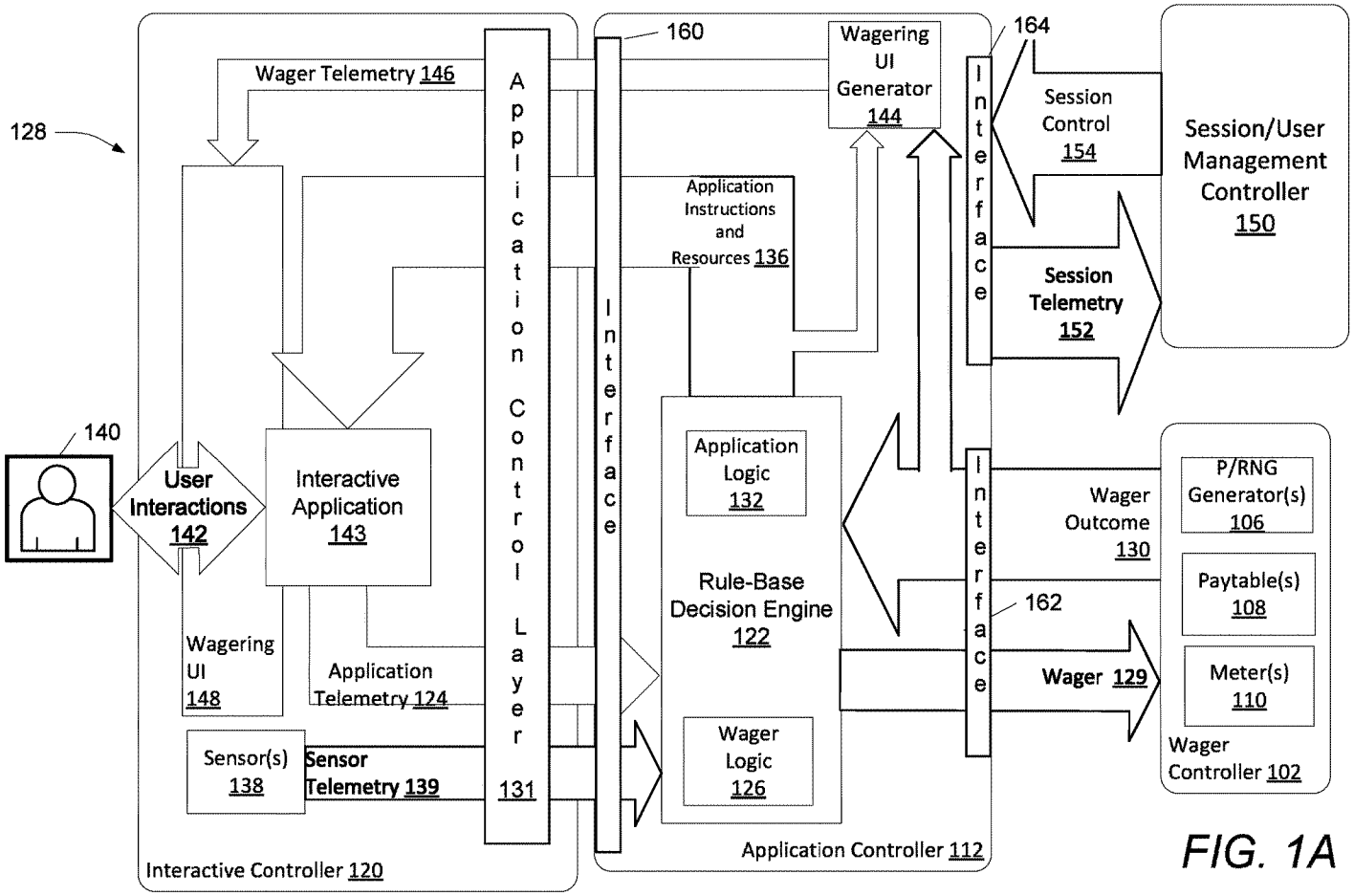
FIG. 1A is a diagram of a structure of an integrated wagering process interleaved wagering system in accordance with various embodiments of the invention.

An integrated wagering process interleaved wagering system interleaves wagering with non-wagering activities. In some embodiments of an integrated wagering process interleaved wagering system an interactive application executed by an interactive controller provides non-wagering components of the integrated wagering process interleaved wagering system. The interactive controller is operatively connected to an application controller that manages and configures the interactive application of the interactive controller and determines when wagers should be interleaved with the operations of the interactive application. The application controller is further operatively connected to a wager controller that provides one or more wagering propositions for one or more wagers.

In some embodiments, the interactive controller also includes a wagering user interface that is used to display data about a wagering process, including but not limited a wager outcome of a wager made in accordance with a wagering proposition. The content of the wagering user interface is controlled by the application controller and includes content provided by the wager controller.

In several embodiments, a user or user interactions are represented in an integrated wagering process interleaved wagering system by the electronic representation of interactions between the user and the interactive application, typically received via a user interface of the interactive application, and a user profile of the integrated wagering process interleaved wagering system associated with the user.

Many different types of interactive applications may be utilized with the integrated wagering process interleaved wagering system. In some embodiments, the interactive application reacts to the physical activity of the user. In these embodiments, the user interacts with the interactive application through one or more sensors that monitor the user's physical activities. Such sensors may include, but are not limited to, physiological sensors that monitor the physiology of the user, environmental sensors that monitor the physical environment of the user, accelerometers that monitor changes in motion of the user, and location sensors that monitor the location of the user such as global positioning sensors.

In some embodiments, the interactive application is a skill-based interactive game that is played by the user.

In some embodiments, the interactive application is a tool used by the user to achieve some useful goal.

In operation, a user interacts with the interactive application using various types of elements of the interactive application in an interactive application environment. Elements are interactive application resources utilized by the user within the interactive application environment to provide an interactive experience for the user. Wagers of credits are made in accordance with a wagering proposition as triggered by the user's use of one or more of the elements of the interactive application. Wager outcomes of wagers of credits made in accordance with the wagering proposition can cause consumption, loss or accrual of credits.

In accordance with some embodiments, wager outcomes of wagering events can influence elements in the interactive application such as, but not limited to, providing one or more new elements, restoring one or more consumed elements, causing the loss of one or more elements, and restoration or placement of one or more fixed elements.

In various embodiments, the wagers may be made using one or more credits (Cr).

In some embodiments, Cr can be one or more credits that are purchased using, and redeemed in, a real world currency having a real world value.

In many embodiments, Cr can be one or more credits in a virtual currency. Virtual currency is an alternate currency that can be acquired, purchased or transferred by or to a user, but does not necessarily directly correlate to a real world currency. In many such embodiments, Cr in a virtual currency are allowed to be purchased using a real world currency but are prevented from being redeemed in a real world currency having a real world value.

In several embodiments, during interaction with the interactive application using the elements, a user can optionally consume and/or accrue application environment credit (AC) within the interactive application as a result of the user's use of the interactive application. AC can be in the form of, but is not limited to, application environment credits, experience points, and points generally.

In various embodiments, when the interactive application is a skill-based interactive game, AC is awarded to a player of the skill-based interactive game on the basis of the player's skillful play of the skill-based interactive game. In such embodiments, AC may be analogous to the score in a typical video game. The skill-based interactive game can have one or more scoring criteria, embedded within an application controller and/or an interactive controller that provides the skill-based interactive game, that reflect user performance against one or more goals of the skill-based interactive game.

In many embodiments, AC can be used to purchase in-application items, including but not limited to, application elements that have particular properties, power ups for existing items, and other item enhancements.

In some embodiments, AC may be used to earn entrance into a sweepstakes drawing, to earn entrance in a tournament with prizes, to score in the tournament, and/or to participate and/or score in any other game event.

In several embodiments, AC can be stored on a user-tracking card or in a network-based user tracking system where the AC is attributed to a specific user.

In many embodiments, a wagering proposition includes a wager of AC for a wager outcome of a randomly generated payout of interactive application AC, elements, and/or objects in accordance with a wagering proposition.

In a number of embodiments, a wager of an amount of Cr results in a wager outcome of a payout of AC, elements, and/or objects that have an Cr value if cashed out.

In some embodiments, in a case that an interactive application is a skill-based interactive game, interactive application objects include in-application objects that may be used by a player of the skill-based interactive game to enhance the player's gameplay of the skill-based interactive game. Such objects include, but are not limited to, power-ups, enhanced in-application items, and the like. In some embodiments, the interactive application objects include objects that are detrimental to the player's play of the skill-based interactive game such as, but not limited to, obstructions in the game space, a temporary player handicap, an enhanced opponent, and the like.

In some embodiments, elements in an interactive application include, but are not limited to, enabling elements (EE) that are interactive application environment resources utilized during the user's use of the interactive application and whose utilization by the user while using the interactive application triggers execution of a wager in accordance with a wagering proposition. In another embodiment, elements in an interactive application include, but are not limited to, a reserve enabling element (REE), that is an element that converts into one or more enabling elements upon occurrence of a release event during an interactive user session. In yet another embodiment, elements in an interactive application include, but are not limited to, an actionable element (AE) that is an element that is acted upon during use of the interactive application to trigger a wager in accordance with a wagering proposition and may or may not be restorable during normal play of the interactive application. In yet another embodiment, elements in an interactive application include, but are not limited to, a common enabling element (CEE) that is an element that may be shared by two or more users and causes a wagering event and associated wager to be triggered in accordance with the wagering proposition when used by one of the users during use of the interactive application. In some embodiments, in progressing through interactive application use, a user can utilize elements during interactions with a controlled entity (CE). A CE is a character, entity, inanimate object, device or other object under control of a user.

In accordance with some embodiments of an integrated wagering process interleaved wagering system, the triggering of the wagering event and/or wager can be dependent upon an interactive application environment variable such as, but not limited to, a required object (RO), a required environmental condition (REC), or a controlled entity characteristic (CEC). A RO is a specific interactive application object in an interactive application acted upon for an AE to be completed. A non-limiting example of an RO is a specific key needed to open a door. An REC is an interactive application state present within an interactive application for an AE to be completed. A non-limiting example of an REC is daylight whose presence enables a character to walk through woods. A CEC is a status of the CE within an interactive application for an AE to be completed. A non-limiting example of a CEC is requirement that a CE have full health points before entering battle. Although various interactive application resources such as, but not limited to, the types of interactive application elements as discussed herein may be used to trigger a wager in accordance with a wagering proposition, one skilled in the art will recognize that any interactive application resource can be utilized in an integrated wagering process interleaved wagering system to trigger of a wager as appropriate to the specification of a specific application in accordance with various embodiments of the invention.

In several embodiments, an integrated wagering process interleaved wagering system can utilize an application controller to monitor use of the interactive application executed by an interactive controller for detecting a trigger of a wagering event. The trigger for the wagering event can be detected by the application controller from the utilization of the interactive application in accordance with at least one wagering event occurrence rule. The trigger of the wagering event can be communicated to a wager controller. In response to notification of the trigger, the wager controller executes a wager in accordance with a wagering proposition. In addition, use of an interactive application in an integrated wagering process interleaved wagering system can be modified by the application controller based upon the wager outcome.

In several embodiments, a wagering event occurrence can be determined from one or more application environment variables within an interactive application that are used to trigger a wager and/or associated wager in accordance with a wagering proposition. Application environment variables can include, but are not limited to, passage of a period of time during integrated wagering process interleaved wagering system interactive application use, a result from an integrated wagering process interleaved wagering system interactive application user session (such as, but not limited to, achieving a goal or a particular score), a user action that is a consumption of an element, or a user action that achieves a combination of elements to be associated with a user profile.

In numerous embodiments, an interactive application instruction is an instruction to an interactive controller and/or an interactive application to modify an interactive application application state or modify one or more interactive application resources. In some embodiments, the interactive application instructions may be based upon one or more of a wager outcome and application environment variables. An interactive application instruction can modify any aspect of an interactive application, such as, but not limited to, an addition of a period of time available for a current interactive application user session for the interactive application of integrated wagering process interleaved wagering system, an addition of a period of time available for a future integrated wagering process interleaved wagering system interactive application user session or any other modification to the interactive application elements that can be utilized during interactive application use. In some embodiments, an interactive application instruction can modify a type of element whose consumption triggers a wagering event occurrence. In many embodiments, an interactive application instruction can modify a type of element whose consumption is not required in a wagering event occurrence.

In a number of embodiments, a user interface can be utilized that depicts a status of the interactive application in the integrated wagering process interleaved wagering system. A user interface can depict any aspect of an interactive application including, but not limited to, an illustration of integrated wagering process interleaved wagering system interactive application use advancement as a user uses the integrated wagering process interleaved wagering system.

In some embodiments, an integrated wagering process interleaved wagering system including an application controller operatively connected to a wager controller and operatively connected to an interactive controller may provide for interleaving entertainment content from an interactive application. The integrated wagering process interleaved wagering system provides for random wager outcomes in accordance with the wagering proposition that are independent of user skill while providing an interactive experience to the user that may be shaped by the user's skill.

In several embodiments, an application controller of an integrated wagering process interleaved wagering system may provide for a communications interface for asynchronous communications between a wager controller and an interactive application provided by an interactive controller, by operatively connecting the interactive controller, and thus the interactive controller's interactive application, with the wager controller. In some embodiments, asynchronous communications provided for by an integrated wagering process interleaved wagering system may reduce an amount of idle waiting time by an interactive controller of the integrated wagering process interleaved wagering system, thus increasing an amount of processing resources that the interactive controller may provide to an interactive application or other processes of the interactive controller. In many embodiments, asynchronous communications provided for by an integrated wagering process interleaved wagering system reduces an amount of idle waiting time by a wager controller, thus increasing an amount of processing resources that the wager controller may provide to execution of wagers to determine wager outcomes, and other processes provided by the wager controller. In some embodiments, a wager controller of an integrated wagering process interleaved wagering system may be operatively connected to a plurality of interactive controllers through one or more application controllers and the asynchronous communications provided for by the one or more application controllers allows the wager controller to operate more efficiently and provide wager outcomes to a larger number of interactive controllers than would be achievable without the one or more application controllers of the integrated wagering process interleaved wagering system.

In some embodiments, an integrated wagering process interleaved wagering system including an application controller operatively connected to a wager controller and operatively connected to an interactive controller may provide for simplified communication protocols for communications of the interactive controller as the interactive controller may communicate user interactions with an interactive application provided by the interactive controller to the application controller without regard to a nature of a wagering proposition to be interleaved with processes of the interactive application.

In various embodiments, an integrated wagering process interleaved wagering system including an application controller operatively connected to a wager controller and operatively connected to an interactive controller may provide for simplified communication protocols for communications of the wager controller as the wager controller may receive wager requests and communicate wager outcomes without regard to a nature of an interactive application provided by the interactive controller.

An embodiment includes an integrated wagering process interleaved skill wagering gaming system, including a player's gaming device operatively connected to an application controller, the player's gaming device, configured to communicate, to the application controller, application telemetry comprising an occurrence of at least one random event and an occurrence of at least one wagering event; receive, from the application controller, resolution instructions comprising a resolution to the occurrence of the at least one random event; integrate the resolution to the occurrence of the at least one random event within the interactive application based on the resolution instructions; display the resolution to the occurrence of the at least one random event; receive, from the application controller, wager outcome instructions comprising a resolution to the occurrence of the at least one wagering event; and display the resolution to the occurrence of the at least one wagering event based on the wager outcome instructions; a real credit controller constructed to receive, from the application controller, random outcome request instructions; determine a sequence of at least one random outcome based on the random outcome request instructions; and communicate, to the application controller, random outcome data comprising the sequence of at least one random outcome; and the application controller operatively connecting the player's gaming device, and the real credit controller, the application controller constructed to receive, from the player's gaming device, the application telemetry; scan the application telemetry to determine the occurrence of at least one random event and the occurrence of at least one wagering event; generate the random outcome request instructions based on determination of the occurrence of at least one random event and the occurrence of at least one wagering event; instruct the real credit controller by communicating the random outcome request instructions to the real credit controller; receive, from the real credit controller, the random outcome data; scan the random outcome data to determine the sequence of at least one random outcome; determine the resolution to the occurrence of the at least one random event and the resolution to the occurrence of the at least one wagering event based on the sequence of at least one random outcome; generate the resolution instructions using the resolution to the occurrence of the at least one random event; instruct the player's gaming device by communicating the resolution instructions to the player's gaming device; generate the wager outcome instructions using the resolution to the occurrence of the at least one wagering event; and instruct the player's gaming device by communicating the wager outcome instructions to the player's gaming device.

In a further embodiment, the player's gaming device and the application controller are constructed from the same device, and where the application controller is operatively connected to the real credit controller using a communication link.

In many embodiments, the real credit controller and the application controller are constructed from the same device, and where the application controller is operatively connected to the player's gaming device using a communication link.

In further embodiments, the determining of the sequence of one or more random outcomes comprises caching one or more intermediate random outcomes, and where the resolution to the occurrence of the at least one wagering event is based on the cache of one or more intermediate random outcomes.

In various embodiments, the application controller is further constructed to cache one or more intermediate random outcomes of the sequence of one or more random outcomes.

In numerous embodiments, the resolution to the occurrence of the at least one random event is based on the cached one or more intermediate random outcomes.

In many embodiments, the application controller is further constructed to receive, from a user management system, user information; and determine the resolution to the occurrence of the at least one wagering event based on the sequence of one or more random outcomes and the user information.

In various embodiments, the application controller is further constructed to receive, from a game provider system, game provider information; and determine the resolution to the occurrence of the at least one wagering event based on the sequence of one or more random outcomes and the game provider information.

An embodiment includes an integrated wagering process interleaved skill wagering gaming system, including a real credit controller constructed to receive, from an application controller, random outcome request instructions; determine a sequence of at least one random outcome based on the random outcome request instructions; and communicate, to the application controller, random outcome data comprising the sequence of at least one random outcome; and the application controller operatively connecting a player's gaming device and the real credit controller, the application controller constructed to receive, from the player's gaming device, application telemetry comprising an occurrence of at least one random event and an occurrence of at least one wagering event; scan the application telemetry to determine an occurrence of at least one random event and an occurrence of at least one wagering event; generate the random outcome request instructions based on determination of the occurrence of at least one random event and the occurrence of at least one wagering event; instruct the real credit controller by communicating the random outcome request instructions to the real credit controller; receive, from the real credit controller, the random outcome data; scan the random outcome data to determine the sequence of at least one random outcome; determine a resolution to the occurrence of the at least one random event and a resolution to the occurrence of the at least one wagering event based on the sequence of at least one random outcome; generate resolution instructions using the resolution to the occurrence of the at least one random event; instruct the player's gaming device by communicating the resolution instructions to the player's gaming device; generate wager outcome instructions using the resolution to the occurrence of the at least one wagering event; and instruct the player's gaming device by communicating the wager outcome instructions to the player's gaming device.

In many embodiments, the determining of the sequence of one or more random outcomes comprises caching one or more intermediate random outcomes, and where the resolution to the occurrence of the at least one wagering event is based on the cache of one or more intermediate random outcomes.

In various embodiments, the application controller is further constructed to cache one or more intermediate random outcomes of the sequence of one or more random outcomes.

In numerous embodiments, the resolution to the occurrence of the at least one random event is based on the cached one or more intermediate random outcomes.

In many embodiments, the application controller is further constructed to receive, from a user management system, user information; and determine the resolution to the occurrence of the at least one wagering event based on the sequence of one or more random outcomes and the user information.

In various embodiments, the application controller is further constructed to receive, from a game provider system, game provider information; and determine the resolution to the occurrence of the at least one wagering event based on the sequence of one or more random outcomes and the game provider information.

An embodiment includes an integrated wagering process interleaved skill wagering gaming system, including a player's gaming device, configured to communicate, to an application controller, application telemetry comprising an occurrence of at least one random event and an occurrence of at least one wagering event; receive, from the application controller, resolution instructions comprising a resolution to the occurrence of the at least one random event; integrate the resolution to the occurrence of the at least one random event within the interactive application based on the resolution instructions; display the resolution to the occurrence of the at least one random event; receive, from the application controller, wager outcome instructions comprising a resolution to the occurrence of the at least one wagering event; and display the resolution to the occurrence of the at least one wagering event based on the wager outcome instructions; and the application controller operatively connecting the player's gaming device and a real credit controller, the application controller constructed to receive, from the player's gaming device, the application telemetry; scan the application telemetry to determine the occurrence of at least one random event and the occurrence of at least one wagering event; generate random outcome request instructions based on determination of the occurrence of at least one random event and the occurrence of at least one wagering event; instruct the real credit controller by communicating the random outcome request instructions to the real credit controller; receive, from the real credit controller, random outcome data; scan the random outcome data to determine a sequence of at least one random outcome; determine the resolution to the occurrence of the at least one random event and the resolution to the occurrence of the at least one wagering event based on the sequence of at least one random outcome; generate the resolution instructions using the resolution to the occurrence of the at least one random event; instruct the player's gaming device by communicating the resolution instructions to the player's gaming device; generate the wager outcome instructions using the resolution to the occurrence of the at least one wagering event; and instruct the player's gaming device by communicating the wager outcome instructions to the player's gaming device.

In many embodiments, the determining of the sequence of one or more random outcomes comprises caching one or more intermediate random outcomes.

In various embodiments, the resolution to the occurrence of the at least one wagering event is based on the cache of one or more intermediate random outcomes.

In numerous embodiments, the application controller is further constructed to cache one or more intermediate random outcomes of the sequence of one or more random outcomes.

In many embodiments, the resolution to the occurrence of the at least one random event is based on the cached one or more intermediate random outcomes.

In various embodiments, the application controller is further constructed to receive, from a user management system, user information; and determine the resolution to the occurrence of the at least one wagering event based on the sequence of one or more random outcomes and the user information.

Integrated Wagering Process Wagering Interleaved Systems

FIG. 1A is a diagram of a structure of an integrated wagering process interleaved wagering system in accordance with various embodiments of the invention. The integrated wagering process interleaved wagering system 128 includes an interactive controller 120, an application controller 112, and a wager controller 102. The interactive controller 120 is operatively connected to, and communicates with, the application controller 112. The application controller 112 is also operatively connected to, and communicates with, the wager controller 102.

In several embodiments, the wager controller 102 is a controller for providing one or more wagering propositions provided by the integrated wagering process interleaved wagering system 128 and executes wagers in accordance with the wagering propositions. Types of value of a wager can be one or more of several different types. Types of value of a wager can include, but are not limited to, a wager of an amount of Cr corresponding to a real currency or a virtual currency, a wager of an amount of AC earned by the player through use of an interactive application, a wager of an amount of elements of an interactive application, and a wager of an amount of objects used in an interactive application. A wager outcome determined for a wager in accordance with a wagering proposition can increase or decrease an amount of the type of value used in the wager, such as, but not limited to, increasing an amount of Cr for a wager of Cr. In various embodiments, a wager outcome determined for a wager in accordance with a wagering proposition can increase or decrease an amount of a type of value that is different than a type of value of the wager, such as, but not limited to, increasing an amount of an object of an interactive application for a wager of Cr.

In many embodiments, the wager controller 120 includes one or more pseudo random or random number generators (P/RNG) 106 for generating random results, one or more paytables 108 for determining a wager outcome from the random results, and one or more credit or value meters 110 for storing amounts of wagered and won credits.

The one or more P/RNG generators 106 execute processes that can generate random or pseudo random results. The one or more paytables 108 are tables that can be used in conjunction with the random or pseudo random results to determine a wager outcome including an amount of Cr, AC, elements or objects won as a function of integrated wagering process interleaved wagering system use. There can be one or more paytables 108 in the wager controller 102. The paytables 108 are used to implement one or more wagering propositions in conjunction with a random output of the random or pseudo random results.

In some embodiments, selection of a paytable to use to execute a wager can be based on factors including, but not limited to, interactive application progress a user has achieved through use of the interactive application, user identification, and eligibility of the user for bonus rounds.

In various embodiments, the interactive controller 120 provides an interactive application 143 and provides human input devices (HIDs) and output devices for interacting with the user 140. The interactive controller 120 provides for user interactions 142 with the interactive application 143 by receiving input from a user through the HIDs and providing outputs such as video, audio and/or other sensory output to the user using the output devices.

The interactive controller 120 is operatively connected to, and communicates with, the application controller 112. The interactive controller communicates application telemetry data 124 to the application controller 112 and receives data of the application instructions and resources 136 from the application controller 112. Via the communication of the data of the application instructions and resources 136, the application controller 112 can communicate certain interactive application resources including control parameters to the interactive application 143 to affect the interactive application's execution by the interactive controller 120. In various embodiments, these interactive application control parameters can be based on a wager outcome of a wager that was triggered by an element in the interactive application being utilized or acted upon by the user.

In some embodiments, execution of the interactive application by the interactive controller 120 communicates user interactions with the interactive application to the application controller 112. The application telemetry data 124 includes, but is not limited to, the user's utilization of the elements in the interactive application.

In some embodiments, the interactive application 143 is a skill-based interactive game. In such embodiments, execution of the skill-based interactive game by the interactive controller 120 is based on the user's skillful play of the skill-based interactive game. The interactive controller 120 can also communicate user choices made in the skill-based interactive game to the application controller 112 included in the application telemetry data 124 such as, but not limited to, the user's utilization of the elements of the skill-based interactive game during the user's skillful play of the skill-based interactive game. In such an embodiment, the application controller is interfaced to the interactive controller 120 in order to allow the coupling of the skill-based interactive game to wagers made in accordance with a wagering proposition.

In some embodiments, the interactive controller 120 includes one or more sensors 138 that sense various aspects of the physical environment of the interactive controller 120. Examples of sensors include, but are not limited to: global positioning sensors (GPSs) for sensing communications from a GPS system to determine a position or location of the interactive controller; temperature sensors; accelerometers; pressure sensors; and the like. Sensor telemetry data 128 is communicated by the interactive controller to the application controller 112. The application controller 112 receives the sensor telemetry data 128 and uses the sensor telemetry data to make wager decisions.

In many embodiments, the interactive controller includes a wagering user interface 148 used to display wagering data to the user.

In various embodiments, an application control layer 131 resident in the interactive controller 120 provides an interface between the interactive controller 120 and the application controller 112. The application control layer 131 implements an interactive controller to application controller communication protocol employing a device-to-device communication protocol In some embodiments, the application controller 112 includes an interactive controller interface 160 to an interactive controller. The interactive controller interface 160 provides for the communication of data between the interactive controller and the application controller, including but not limited to wager telemetry data 146, application instructions and resources 136, application telemetry data 124, and sensor telemetry data 128.

In many embodiments, application controller 112 provides an interface between the interactive application 143 provided by the interactive controller 120 and a wagering proposition provided by the wager controller 102.

In various embodiments, the application controller 112 includes a wager controller interface 162 to a wager controller. The wager controller interface 162 provides for communication of data between the application controller 112 and the wager controller, including but not limited to wager outcome data 130 and wager execution instructions 129.

In some embodiments, the application controller 112 includes a user management and session controller interface 164 to a user management and session controller. The user management and session controller interface 164 provides for communication of data between the application controller 112 and the user management and session controller, including but not limited to user session control data 154 and user session telemetry data 152.

The application controller 112 includes a rule-based decision engine 122 that receives telemetry data, such as application telemetry data 124 and sensor telemetry data 128, from the interactive controller 120. The rule-based decision engine 122 uses the telemetry data, along with trigger logic 126 to generate wager execution instructions 129 that are used by the application controller 112 to instruct the wager controller 120 to execute a wager. The wager execution data is communicated by the application controller 112 to the wager controller 102. The wager controller 102 receives the wager execution instructions 129 and executes a wager in accordance with the wager execution instructions.

In some embodiments, the application telemetry data 124 includes, but is not limited to, application environment variables that indicate the state of the interactive application 143 being used by a user 140, interactive controller data indicating the state of the interactive controller, and user actions and interactions 142 between the user and the interactive application 143 provided by the interactive controller 120. The wager execution instructions 129 may include, but are not limited to, an amount and type of the wager, a trigger of the wager, and a selection of a paytable 108 to be used when executing the wager.

In some embodiments, the rule-based decision engine 122 also receives wager outcome data 130 from the wager controller 102. The decision engine 122 uses the wager outcome data 130, in conjunction with the telemetry data and application logic 132 to generate application decisions 134 communicated to an application resource generator 138. The application resource generator 138 receives the application decisions and uses the application decisions to generate application instructions and application resources 136 to be communicated to the interactive application 143.

In some embodiments, the wager outcome data 130 includes game state data about execution of a gambling game that underlies a wagering proposition, including but not limited to a final state, intermediate state and/or beginning state of the gambling game. For example, in a gambling game that is a slot math-based game, the final state of the gambling game may be reel positions, in a gambling game that is a roulette wheel-based game, the final state may be a pocket where a ball may have come to rest, in a gambling game that is a card-based game, the beginning, intermediate and final states may represent a play of cards, etc.

In many embodiments, the application controller 112 includes a pseudo random or random result generator used to generate random results that are communicated to the application resource generator 138. The application resource generator 138 uses the random results to generate application instructions and application resources 136 used by the application controller 112 to instruct the interactive controller 120.

In various embodiments, the rule-based decision engine 122 also determines an amount of AC to award to the user 140 based at least in part on the user's use of the interactive application of the integrated wagering process interleaved wagering system as determined from the application telemetry data 124. In some embodiments, wager outcome data 130 may also be used to determine the amount of AC that should be awarded to the user.

In numerous embodiments, the interactive application is a skill-based interactive game and the AC is awarded to the user for the user's skillful play of the skill-based interactive game.

In some embodiments, the application decisions 134 and wager outcome data 130 are communicated to a wagering user interface generator 144. The wagering user interface generator 144 receives the application decisions 134 and wager outcome data 130 and generates wager telemetry instructions 146 used by the application controller 112 to instruct the interactive controller to generate a wagering user interface 148 describing the state of wagering and credit accumulation and loss for the integrated wagering process interleaved wagering system. In some embodiments, the data of the wager telemetry instructions 146 may include, but is not limited to, amounts of AC and elements earned, lost or accumulated by the user through use of the interactive application as determined from the application decisions, and Cr amounts won, lost or accumulated as determined from the wager outcome data 130 and the one or more meters 110.

In some embodiments, the wager outcome data 130 also includes data about one or more game states of a gambling game executed in accordance with a wagering proposition by the wager controller 102. In various such embodiments, the wagering user interface generator 144 generates a gambling game process display and/or gambling game state display using the one or more game states of the gambling game. The gambling game process display and/or gambling game state display is included in the wager telemetry data 146 that is communicated to the interactive controller 120. The gambling game process display and/or a gambling game state display is displayed by the wagering user interface 148 to the user 140. In other such embodiments, the one or more game states of the gambling game are communicated to the interactive controller 120 and the interactive controller 120 is instructed to generate the gambling game process display and/or gambling game state display of the wagering user interface 148 using the one or more game states of the gambling game for display to the user 140.

The application controller 112 can further operatively connect to the wager controller 102 to determine an amount of credit or elements available and other wagering metrics of a wagering proposition. Thus, the application controller 112 may potentially affect an amount of Cr in play for participation in the wagering events of a gambling game provided by the wager controller 102 in some embodiments. The application controller 112 may additionally include various audit logs and activity meters. In some embodiments, the application controller 112 can also couple to a centralized server for exchanging various data related to the user and the activities of the user during game play of an integrated wagering process interleaved wagering system.

In many embodiments, one or more users can be engaged in using the interactive application executed by the interactive controller 120. In various embodiments, an integrated wagering process interleaved wagering system can include an interactive application that provides a skill-based interactive game that includes head-to-head play between a single user and a computing device, between two or more users against one another, or multiple users playing against a computer device and/or each other. In some embodiments, the interactive application can be a skill-based interactive game where the user is not skillfully playing against the computer or any other user such as skill-based interactive games where the user is effectively skillfully playing against himself or herself.

In some embodiments, the operation of the application controller 112 does not affect the provision of a wagering proposition by the wager controller 102 except for user choice parameters that are allowable in accordance with the wagering proposition. Examples of user choice parameters include, but are not limited to: wager terms such as but not limited to a wager amount; speed of game play (for example, by pressing a button or pulling a handle of a slot machine); and/or agreement to wager into a bonus round.

In various embodiments, wager outcome data 130 communicated from the wager controller 102 can also be used to convey a status operation of the wager controller 102.

In a number of embodiments, communication of the wager execution instructions 129 between the wager controller 102 and the application controller 112 can further be used to communicate various wagering control factors that the wager controller 102 uses as input. Examples of wagering control factors include, but are not limited to, an amount of Cr, AC, elements, or objects consumed per wagering event, and/or the user's election to enter a jackpot round.

In some embodiments, the application controller 112 utilizes the wagering user interface 148 to communicate certain interactive application data to the user, including but not limited to, club points, user status, control of the selection of choices, and messages which a user can find useful in order to adjust the interactive application experience or understand the wagering status of the user in accordance with the wagering proposition in the wager controller 102.

In some embodiments, the application controller 112 utilizes the wagering user interface 148 to communicate aspects of a wagering proposition to the user including, but not limited to, odds of certain wager outcomes, amount of Cr, AC, elements, or objects in play, and amounts of Cr, AC, elements, or objects available.

In a number of embodiments, the wager controller 102 can accept wager proposition factors including, but not limited to, modifications in the amount of Cr, AC, elements, or objects wagered on each individual wagering event, a number of wagering events per minute the wager controller 102 can resolve, entrance into a bonus round, and other factors. An example of a varying wager amount that the user can choose can include, but is not limited to, using a more difficult interactive application level associated with an amount of a wager. These factors can increase or decrease an amount wagered per individual wagering proposition in the same manner that a standard slot machine player can decide to wager more or less credits for each pull of the handle. In several embodiments, the wager controller 102 can communicate a number of factors back and forth to the application controller 112, via an interface, such that an increase/ decrease in a wagered amount can be related to the change in user profile of the user in the interactive application. In this manner, a user can control a wager amount per wagering event in accordance with the wagering proposition with the change mapping to a parameter or component that is applicable to the interactive application experience.

In some embodiments, a user management and session controller 150 is used to authorize an integrated wagering process interleaved wagering system user session. The user management and session controller receives game user session data 152, that may include, but is not limited to, user, interactive controller, application controller and wager controller data from the application controller 112. The user management and session controller 150 uses the user, interactive controller, application controller and wager controller data to regulate an integrated wagering process interleaved wagering system user session. In some embodiments, the user management and session controller 150 may also assert control of an integrated wagering process interleaved wagering system game user session 154. Such control may include, but is not limited to, ending an integrated wagering process interleaved wagering system game user session, initiating wagering in an integrated wagering process interleaved wagering system game user session, ending wagering in an integrated wagering process interleaved wagering system game user session but not ending a user's play of the interactive application portion of the integrated wagering process interleaved wagering system, and changing from real credit wagering in an integrated wagering process interleaved wagering system to virtual credit wagering, or vice versa.

In many embodiments, the user management and session controller 150 manages user profiles for a plurality of users. The user management and session controller 150 stores and manages data about users in order to provide authentication and authorization of users of the integrated wagering process interleaved wagering system 128. In some embodiments, the user management and session controller 150 also manages geolocation information to ensure that the integrated wagering process interleaved wagering system 128 is only used by users in jurisdictions were gaming is approved. In various embodiments, the user management and session controller 150 stores application credits that are associated with the user's use of the interactive application of the integrated wagering process interleaved wagering system 128.

In some embodiments, an interactive application 143 may utilize data of one or more random outcomes as part of its data processing. The data of the one or more random outcomes may also be utilized to determine data of a wagering outcome by either the wager controller 102 or the application controller 112, that is, data of the same one or more random outcomes may be utilized by both the interactive controller 120 and the wager controller 102. As the interactive controller 120 may be an unregulated device and the wager controller 102 is responsible for generating wager outcomes in a regulated environment, data of the one or more random outcomes generated by the unregulated interactive controller 120 cannot be used in the regulated environment of the wager controller 102. Therefore, data of the one or more random outcomes is generated by the wager controller 102 within the regulated environment and communicated via the application controller 112 to the interactive controller 120 for utilization by the interactive application 143 on the unregulated interactive controller 120.

In various embodiments, the application controller operates as an interface between the interactive controller and the wager controller. By virtue of this construction, the wager controller is isolated from the interactive controller allowing the interactive controller to operate in an unregulated environment will allowing the wager controller to operate in a regulated environment.

In some embodiments, a single wager controller may provide services to two or more interactive controllers and/or two or more application controllers, thus allowing an integrated wagering process interleaved wagering system to operate over a large range of scaling.

In various embodiments, multiple types of interactive controllers using different operating systems may be interfaced to a single type of application controller and/or wager controller without requiring customization of the application controller and/or the wager controller.

In many embodiments, an interactive controller may be provided as a user device under control of a user while maintaining the wager controller in an environment under the control of a regulated operator of wagering equipment.

In several embodiments, data communicated between the controllers may be encrypted to increase security of the integrated wagering process interleaved wagering system.

In some embodiments, the application controller isolates trigger logic and application logic as unregulated logic from a regulated wager controller, thus allowing errors in the application logic and/or trigger logic to be corrected, new application logic and/or trigger logic to be used, or modifications to be made to the application logic and/or trigger logic without a need for regulatory approval.

In various embodiments, an interactive application may require extensive processing resources from an interactive controller leaving few processing resources for the functions performed by an application controller and/or a wager controller. By virtue of the architecture described herein, processing loads may be distributed across multiple devices such that operations of the interactive controller may be dedicated to the interactive application and the processes of the application controller and/or wager controller are not burdened by the requirements of the interactive application.

In many embodiments, an integrated wagering process interleaved wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like.

In some embodiments, one or more components of an integrated wagering process interleaved wagering system are distributed in close proximity to each other and communicate using a local area network and/or a communication bus. In several embodiments, an interactive controller and an application controller of an integrated wagering process interleaved wagering system are in a common location and communicate with an external wager controller. In some embodiments, an application controller and a wager controller of an integrated wagering process interleaved wagering system are in a common location and communicate with an external interactive controller. In many embodiments, an interactive controller, an application controller, and a wager controller of an integrated wagering process interleaved wagering system are located in a common location. In some embodiments, a user management and session controller is located in a common location with an application controller and/or a wager controller.

In various embodiments, These multiple devices can be constructed from or configured using a single server or a plurality of servers such that an integrated wagering process interleaved wagering system is executed as a system in a virtualized space such as, but not limited to, where a wager controller and an application controller are large scale centralized servers in the cloud operatively connected to widely distributed interactive controllers via a wide area network such as the Internet or a local area network. In such embodiments, the components of an integrated wagering process interleaved wagering system may communicate using a networking protocol or other type of device-to-device communications protocol.

In many embodiments, a centralized wager controller is operatively connected to, and communicates with, one or more application controllers using a communication link. The centralized wager controller can generate wager outcomes for wagers in accordance with one or more wagering propositions. The centralized wager controller can execute a number of simultaneous or pseudo-simultaneous wagers in order to generate wager outcomes for a variety of wagering propositions that one or more distributed integrated wagering process interleaved wagering systems can use.

In several embodiments, a centralized application controller is operatively connected to one or more interactive controllers and one or more wager controllers using a communication link. The centralized application controller can perform the functionality of an application controller across various integrated wagering process interleaved wagering systems.

In a variety of embodiments, management of user profile data can be performed by a user management and session controller operatively connected to, and communicating with, one or more application controllers, wager controllers and interactive controllers using a communication link. A user management and session controller can manage data related to a user profile. The managed data in the user profile may include, but is not limited to, data concerning controlled entities (characters) in interactive application use, user performance metrics for a type or class of interactive application, interactive application elements acquired by a user; Cr and AC associated with a particular user, and tournament reservations.

Although a user management and session controller is discussed as being separate from an application controller server, a centralized application controller server may also perform the functions of a user management and session controller in some embodiments.

In numerous embodiments, an interactive application server provides a host for managing head-to-head play operating over a network of interactive controllers connected to the interactive application server using a communication link. The interactive application server provides an environment where users can compete directly with one another and interact with other users.

Processing devices connected using a communication link to construct integrated wagering process interleaved wagering systems in accordance with many embodiments of the invention can communicate with each other to provide services utilized by an integrated wagering process interleaved wagering system. In several embodiments, a wager controller can communicate with an application controller using a communication link. In some embodiments, the wager controller can communicate with an application controller to communicate any type of data as appropriate for a specific application. Examples of the data that may be communicated include, but are not limited to, data used to configure the various simultaneous or pseudo simultaneous wager controllers executing in parallel within the wager controller to accomplish integrated wagering process interleaved wagering system functionalities; data used to determine metrics of wager controller performance such as wagers run and/or wager outcomes for tracking system performance; data used to perform audits and/or provide operator reports; and data used to request the results of a wager outcome for use in one or more function(s) operating within the application controller such as, but not limited to, automatic drawings for prizes that are a function of interactive controller performance.

In several embodiments, an application controller can communicate with an interactive application server using a communication link when the interactive application server is also communicating with one or more interactive controllers using a communication link. An application controller can communicate with an interactive application server to communicate any type of data as appropriate for a specific application. The data that may be communicated between an application controller and an interactive application server includes, but is not limited to, the data for management of an interactive application server by an application controller server during an integrated wagering process interleaved wagering system tournament. In an example embodiment, an application controller may not be aware of the relationship of the application controller to the rest of a tournament since the actual tournament play may be managed by the interactive application server. Therefore, management of an integrated wagering process interleaved wagering system can include, but is not limited to tasks including, but not limited to, conducting tournaments according to system programming that can be coordinated by an operator of the integrated wagering process interleaved wagering system; allowing entry of a particular user into a tournament; communicating the number of users in a tournament; and the status of the tournament (such as, but not limited to the amount of surviving users, the status of each surviving user within the game, and time remaining on the tournament); communicating the performance of users within the tournament; communicating the scores of the various users in the tournament; and providing a synchronizing link to connect the application controllers in a tournament with their respective interactive controllers.

In several embodiments, an application controller can communicate with a user management and session controller using a communication link. An application controller can communicate with a user management and session controller to communicate any type of data as appropriate for a specific application. Examples of data communicated between an application controller and a user management and session controller include, but are not limited to, data for configuring tournaments according to system programming conducted by an operator of an integrated wagering process interleaved wagering system; data for exchange of data used to link a user's user profile to an ability to participate in various forms of integrated wagering process interleaved wagering system use(such as but not limited to the difficulty of play set by the application controller server for an interactive application that is a skill-based interactive game); data for determining a user's ability to participate in a tournament as a function of a user's characteristics (such as but not limited to a user's prowess or other metrics used for tournament screening); data for configuring application controller and interactive controller performance to suit preferences of a user on a particular integrated wagering process interleaved wagering system; and data for determining a user's use and wagering performance for the purposes of marketing intelligence; and data for logging secondary drawing awards, tournament prizes, Cr and/or AC into the user profile.

In many embodiments, an integrated wagering process interleaved wagering system can be distributed across one or more processing devices, with the actual location of where various process are executed being located either on an end device (user management and session controller, wager controller, application controller, interactive controller), on servers (user management and session controller, wager controller, application controller, or interactive application server), or a combination of both end devices and servers. In a number of embodiments, certain functions of a wager controller, application controller, and/or interactive application server can operate on a local wager controller, local application controller and/or local interactive controller used to construct an integrated wagering process interleaved wagering system being provided locally on a device. In some embodiments, a controller or server can be part of a server system including multiple servers, where applications can be run on one or more physical devices. Similarly, in particular embodiments, multiple servers can be combined on a single physical device.

In many embodiments, an integrated wagering process interleaved wagering system can be distributed across one or more processing devices that are in close proximity to each other, such as a common enclosure. In such an embodiment, the one or more processing devices can be operatively connected using communication links that incorporate an interdevice communication protocol over a serial or parallel physical link.

Figure 1B:
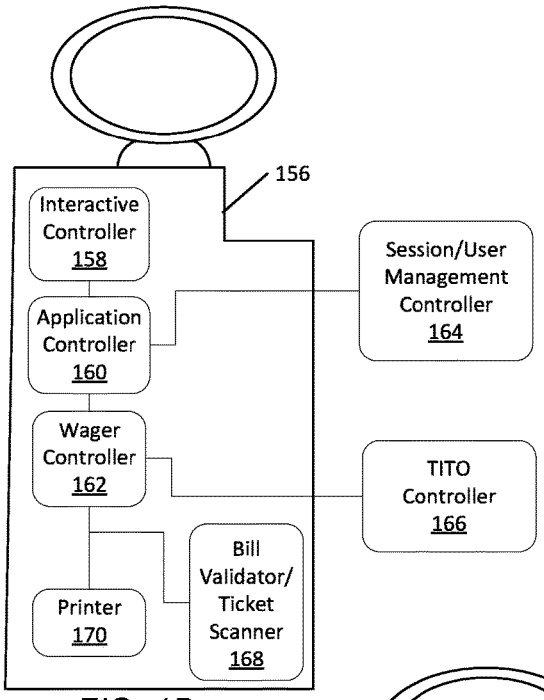
FIG. 1B is a diagram of a land-based configuration of an integrated wagering process interleaved wagering system in accordance with various embodiments of the invention.
Figure 1C:
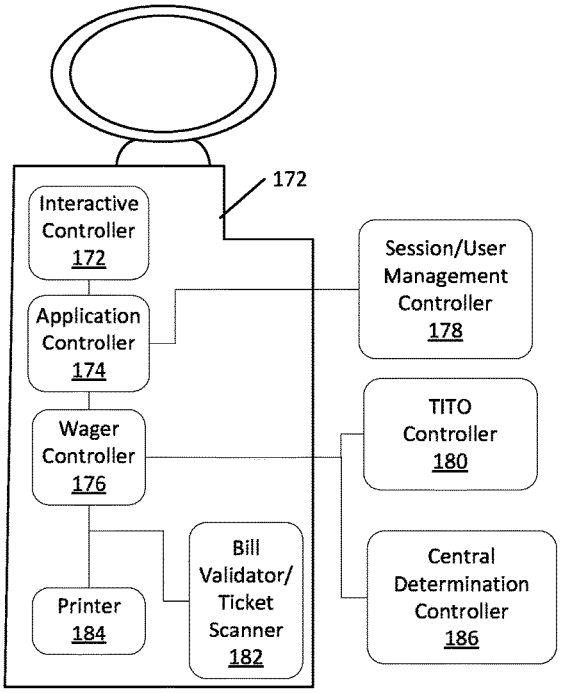
FIG. 1C is another diagram of a land-based configuration of an integrated wagering process interleaved wagering system in accordance with various embodiments of the invention.

FIG. 1B is a diagram of a land-based configuration of an integrated wagering process interleaved wagering system in accordance with various embodiments of the invention. Land-based configurations are suitable for deployment in a gaming establishment. A land-based configuration of an integrated wagering process interleaved wagering system 156 includes an interactive controller 158, an application controller 160 and a wager controller 162 housed in a common enclosure. The application controller 160 is operatively connected to an external session/user management controller 164. The wager controller 162 is operatively connected to a ticket-in-ticket-out (TITO) controller 166 or other type of credit controller. The wager controller 162 communicates with the TITO controller 166 to obtain amounts of credits used for wagering. In operation, the wager controller 162 uses a bill validator/ticket scanner 168 to scan a TITO ticket having indicia of credit account data of a credit account of the TITO controller 166. The wager controller 162 communicates the credit account data to the TITO controller 166. The TITO controller 166 uses the credit account data to determine an amount of credits to transfer to the wager controller 162. The TITO controller 166 communicates the amount of credits to the wager controller 162. The wager controller 162 credits the one or more credit meters with the amount of credits so that the credits can be used when a user makes wagers using the integrated wagering process interleaved wagering system 156. In addition, the wager controller 162 can use the TITO controller 166 along with a ticket printer 170 to generate a TITO ticket for a user. In operation, the wager controller 162 communicates an amount of credits for a credit account on the TITO controller 166. The TITO controller 166 receives the amount of credits and creates the credit account and credits the credit account with the amount of credits. The TITO controller 166 generates credit account data for the credit account and communicates the credit account data to the wager controller 162. The wager controller 162 uses the ticket printer 170 to print indicia of the credit account data onto a TITO ticket.

FIG. 1B is a diagram of another land-based configuration of an integrated wagering process interleaved wagering system in accordance with various embodiments of the invention. A land-based configuration of an integrated wagering process interleaved wagering system 172 includes an interactive controller 172, an application controller 174 and a wager controller 176 housed in a common enclosure. The application controller 174 is operatively connected to an external session/user management controller 178. The wager controller 176 is operatively connected to a ticket-in-ticket-out (TITO) controller 180 or other type of credit controller. The wager controller 176 communicates with the TITO controller 180 to obtain amounts of credits used for wagering. In operation, the wager controller 176 uses a bill validator/ticket scanner 182 to scan a TITO ticket having indicia of credit account data of a credit account of the TITO controller 180. The wager controller 176 communicates the credit account data to the TITO controller 180. The TITO controller 180 uses the credit account data to determine an amount of credits to transfer to the wager controller 176. The TITO controller 180 communicates the amount of credits to the wager controller 176. The wager controller 176 receives the amount of credits and credits the one or more credit meters with the amount of credits so that the credits can be used when a user makes wagers using the integrated wagering process interleaved wagering system 172. In addition, the wager controller 176 can use the TITO controller 180 along with a ticket printer 184 to generate a TITO ticket for a user. In operation, the wager controller 176 communicates an amount of credits for a credit account on the TITO controller 180. The TITO controller 180 receives the amount of credits and creates the credit account and credits the credit account with the amount of credits. The TITO controller 180 generates credit account data for the credit account and communicates the credit account data to the wager controller 176. The wager controller 176 uses the ticket printer 184 to print indicia of the credit account data onto a TITO ticket.

The wager controller 176 is operatively connected to a central determination controller 186. In operation, when the wager controller 176 needs to determine a wager outcome, the wager controller communicates a request to the central determination controller 186 for the wager outcome. The central determination controller 186 receives the wager outcome request and generates a wager outcome in response to the wager request. The central determination controller 186 communicates the wager outcome to the wager controller 176. The wager controller 176 receives the wager outcome and utilizes the wager outcome as described herein. In some embodiments, the wager outcome is drawn from a pool of pre-determined wager outcomes. In some embodiments, the wager outcome is a pseudo random result or random result that is utilized by the wager controller along with paytables to determine a wager outcome as described herein.

Figure 1D:
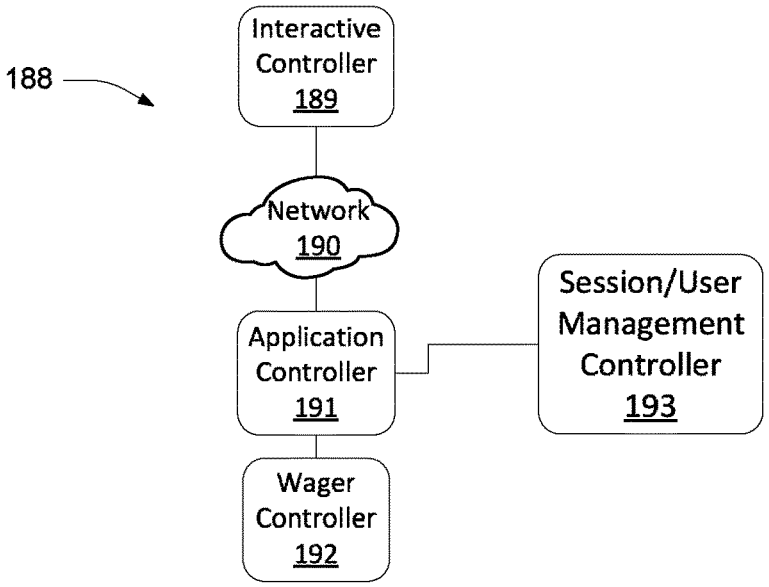
FIG. 1D is a diagram of an interactive configuration of an integrated wagering process interleaved wagering system in accordance with various embodiments of the invention.

FIG. 1D is a diagram of an interactive configuration of an integrated wagering process interleaved wagering system in accordance with various embodiments of the invention. An interactive configuration of an integrated wagering process interleaved wagering system is useful for deployment over a wide area network such as an internet. An interactive configuration of an integrated wagering process interleaved wagering system 188 includes an interactive controller 189 operatively connected by a network 190 to an application controller 191, and a wager controller 192. The application controller 191 is operatively connected to a session/user management controller 193.

Figure 1E:
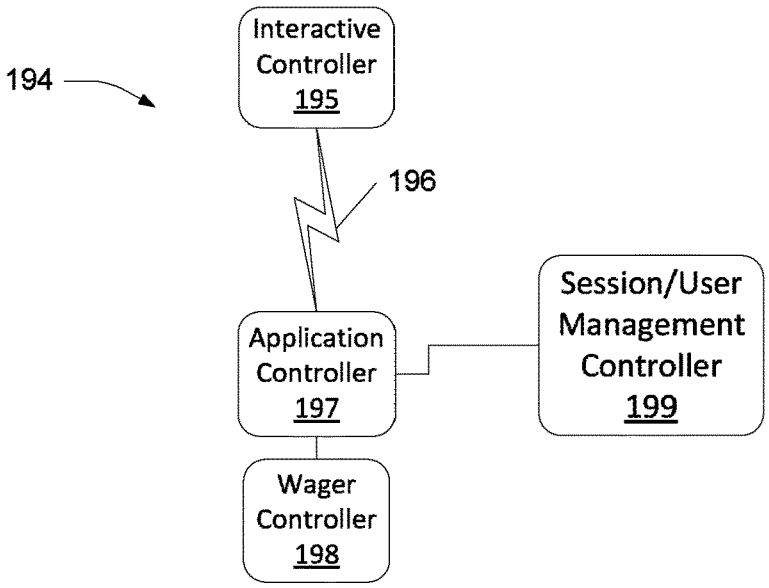
FIG. 1E is a diagram of a mobile configuration of an integrated wagering process interleaved wagering system in accordance with various embodiments of the invention.

FIG. 1E is a diagram of a mobile configuration of an integrated wagering process interleaved wagering system in accordance with various embodiments of the invention. A mobile configuration of an integrated wagering process interleaved wagering system is useful for deployment over wireless communication network, such as a wireless local area network or a wireless telecommunications network. An interactive configuration of an integrated wagering process interleaved wagering system 194 includes an interactive controller 195 operatively connected by a wireless network 196 to an application controller 197, and a wager controller 198. The application controller 197 is also operatively connected to a session/user management controller 199.

FIGS. 2A, 2B, 2C, and 2D are illustrations of interactive controllers of an integrated wagering process interleaved wagering system in accordance with various embodiments of the invention. An interactive controller, such as interactive controller 120 of FIG. 1A, may be constructed from or configured using one or more processing devices configured to perform the operations of the interactive controller. An interactive controller in an integrated wagering process interleaved wagering system may be constructed from or configured using any processing device having sufficient processing and communication capabilities that may be configured to perform the processes of an interactive controller in accordance with various embodiments of the invention. In some embodiments, the construction or configuration of the interactive controller may be achieved through the use of an application control layer, such as application control layer 131 of FIG. 1A, and/or through the use of an interactive application, such as interactive application 143 of FIG. 1A.

Figure 2A:
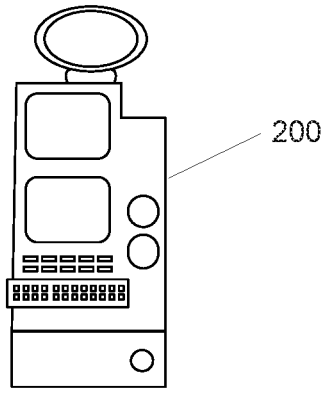
FIGS. 2A, 2B, 2C, and 2D are illustrations of interactive controllers of an integrated wagering process interleaved wagering system in accordance with various embodiments of the invention.

In some embodiments, an interactive controller may be constructed from or configured using an electronic gaming machine 200 as shown in FIG. 2A. The electronic gaming machine 200 may be physically located in various types of gaming establishments.

Figure 2B:
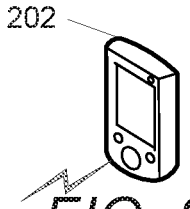

In many embodiments, an interactive controller may be constructed from or configured using a portable device 202 as shown in FIG. 2B. The portable device 202 is a device that may wirelessly connect to a network. Examples of portable devices include, but are not limited to, a tablet computer, a personal digital assistant, and a smartphone.

Figure 2C:
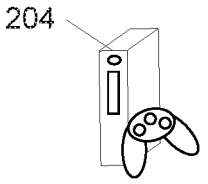

In some embodiments, an interactive controller may be constructed from or configured using a gaming console 204 as shown in FIG. 2C.

Figure 2D:
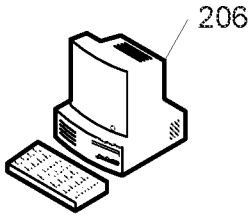

In various embodiments, an interactive controller may be constructed from or configured using a personal computer 206 as shown in FIG. 2D.

In some embodiments, a device, such as the devices of FIGS. 2A, 2B, 2C, and 2D, may be used to construct a complete integrated wagering process interleaved wagering system and may be operatively connected using a communication link to a session and/or user management controller, such as session and/or user management controller 150 of FIG. 1A.

Figure 3A:
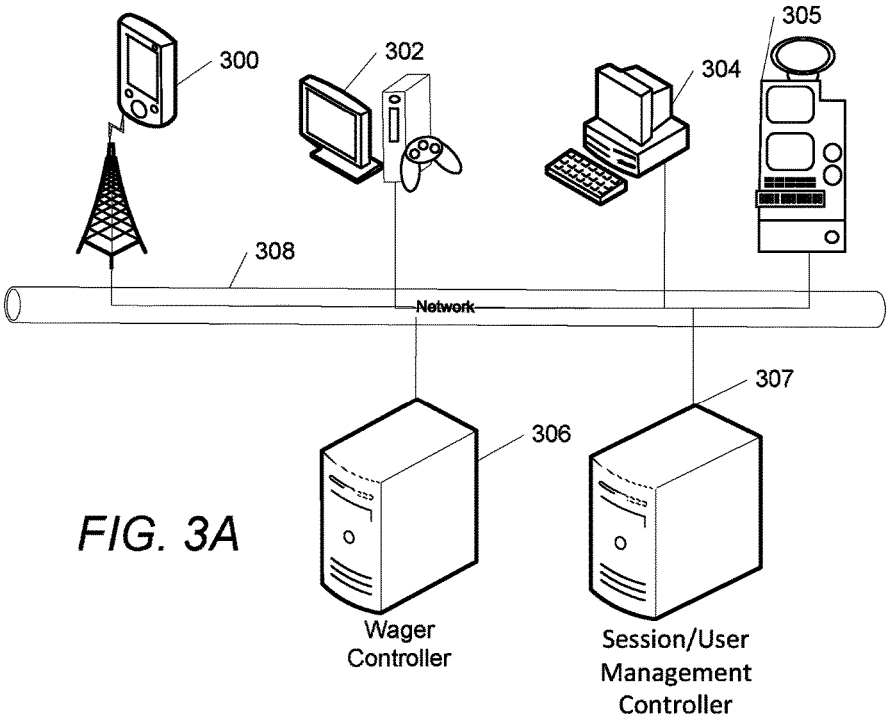
FIGS. 3A, 3B and 3C are diagrams of distributed integrated wagering process interleaved wagering systems in accordance with various embodiments of the invention.
Figure 3B:
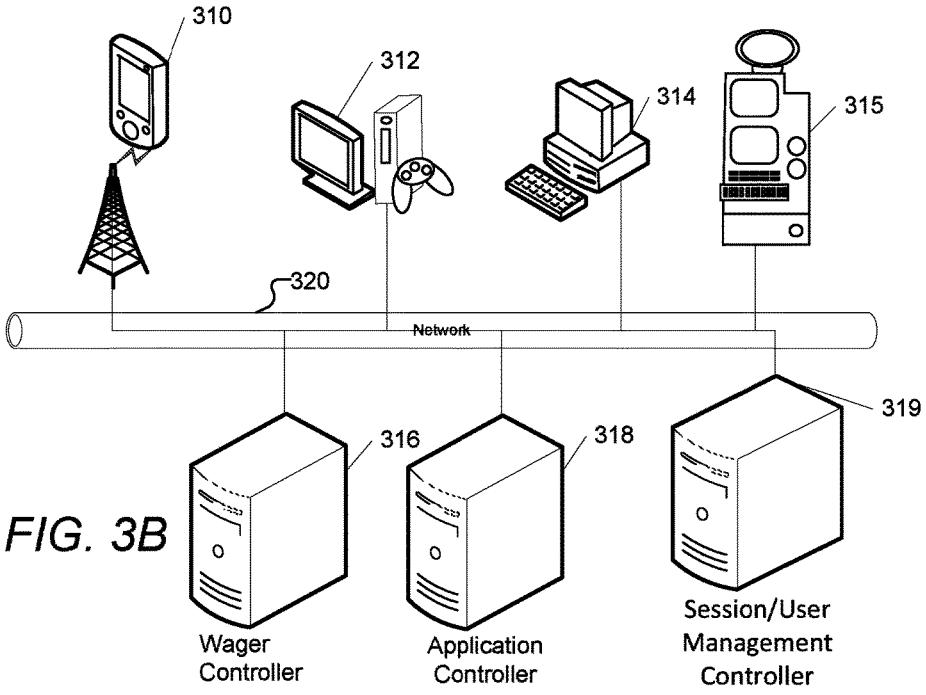
Figure 3C:
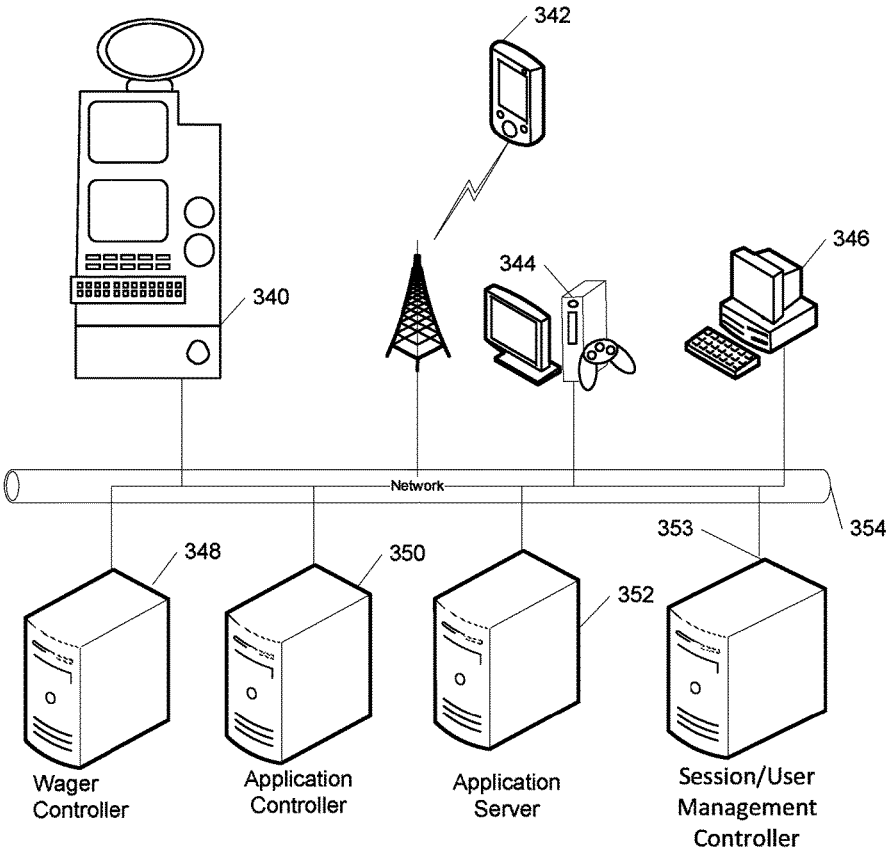

Some integrated wagering process interleaved wagering systems in accordance with many embodiments of the invention can be distributed across a plurality of devices in various configurations. FIGS. 3A, 3B and 3C are diagrams of distributed integrated wagering process interleaved wagering systems in accordance with various embodiments of the invention. Turning now to FIG. 3A, one or more interactive controllers of a distributed integrated wagering process interleaved wagering system, such as but not limited to, a mobile or wireless device 300, a gaming console 302, a personal computer 304, and an electronic gaming machine 305, are operatively connected with a wager controller 306 of a distributed integrated wagering process interleaved wagering system using a communication link 308. Communication link 308 is a communications link that allows processing systems to communicate with each other and to share data. Examples of the communication link 308 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of an interactive controller and an application controller as described herein are executed on the individual interactive controllers 300, 302, 304 and 305 while one or more processes of a wager controller as described herein can be executed by the wager controller 306.

In many embodiments, a distributed integrated wagering process interleaved wagering system and may be operatively connected using a communication link to a session and/or user management controller 307, that performs the processes of a session and/or user management controller as described herein.

A distributed integrated wagering process interleaved wagering system in accordance with another embodiment of the invention is illustrated in FIG. 3B. As illustrated, one or more interactive controllers of a distributed integrated wagering process interleaved wagering system, such as but not limited to, a mobile or wireless device 310, a gaming console 312, a personal computer 314, and an electronic gaming machine 315, are operatively connected with a wager controller server 316 and an application controller 318 over a communication link 320. Communication link 320 is a communication link that allows processing systems to communicate and share data. Examples of the communication link 320 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, the processes of an interactive controller as described herein are executed on the individual interactive controllers 310, 312, 314 and 315. One or more processes of a wager controller as described herein are executed by the wager controller 316, and one or more processes of an application controller as described herein are executed by the application controller 318.

In many embodiments, a distributed integrated wagering process interleaved wagering system and may be operatively connected using a communication link to a session and/or user management controller 319, that performs the processes of a session and/or user management controller as described herein.

A distributed integrated wagering process interleaved wagering systems in accordance with still another embodiment of the invention is illustrated in FIG. 3C. As illustrated, one or more interactive controllers of a distributed integrated wagering process interleaved wagering system, such as but not limited to, a mobile device 342, a gaming console 344, a personal computer 346, and an electronic gaming machine 340 are operatively connected with a wager controller 348 and an application controller 350, and an interactive application server 352 using a communication link 354. Communication link 354 is a communications link that allows processing systems to communicate and to share data. Examples of the communication link 354 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of a display and user interface of an interactive controller as described herein are executed on the individual interactive controllers 340, 342, 344 and 346. One or more processes of a wager controller as described herein can be executed by the wager controller server 348. One or more processes of an application controller as described herein can be executed by the application controller server 350 and one or more processes of an interactive controller excluding the display and user interfaces can be executed by the interactive application server 352.

In many embodiments, a distributed integrated wagering process interleaved wagering system and may be operatively connected using a communication link to a session and/or user management controller 353, that performs the processes of a session and/or user management controller as described herein.

In various embodiments, a user management and session controller may be operatively connected to components of an integrated wagering process interleaved wagering system using a communication link. In other embodiments, a number of other peripheral systems, such as a user management system, a gaming establishment management system, a regulatory system, and/or hosting servers are also operatively connected with the integrated wagering process interleaved wagering systems using a communication link. Also, other servers can reside outside the bounds of a network within a firewall of the operator to provide additional services for network connected integrated wagering process interleaved wagering systems.

Although various distributed integrated wagering process interleaved wagering systems are described herein, integrated wagering process interleaved wagering systems can be distributed in any configuration as appropriate to the specification of a specific application in accordance with embodiments of the invention. In some embodiments, components of a distributed integrated wagering process interleaved wagering system, such as an application controller, wager controller, interactive controller, or other servers that perform services for an application controller, wager controller and/or interactive controller, can be distributed in different configurations for a specific distributed integrated wagering process interleaved wagering system application.

Figure 4A:
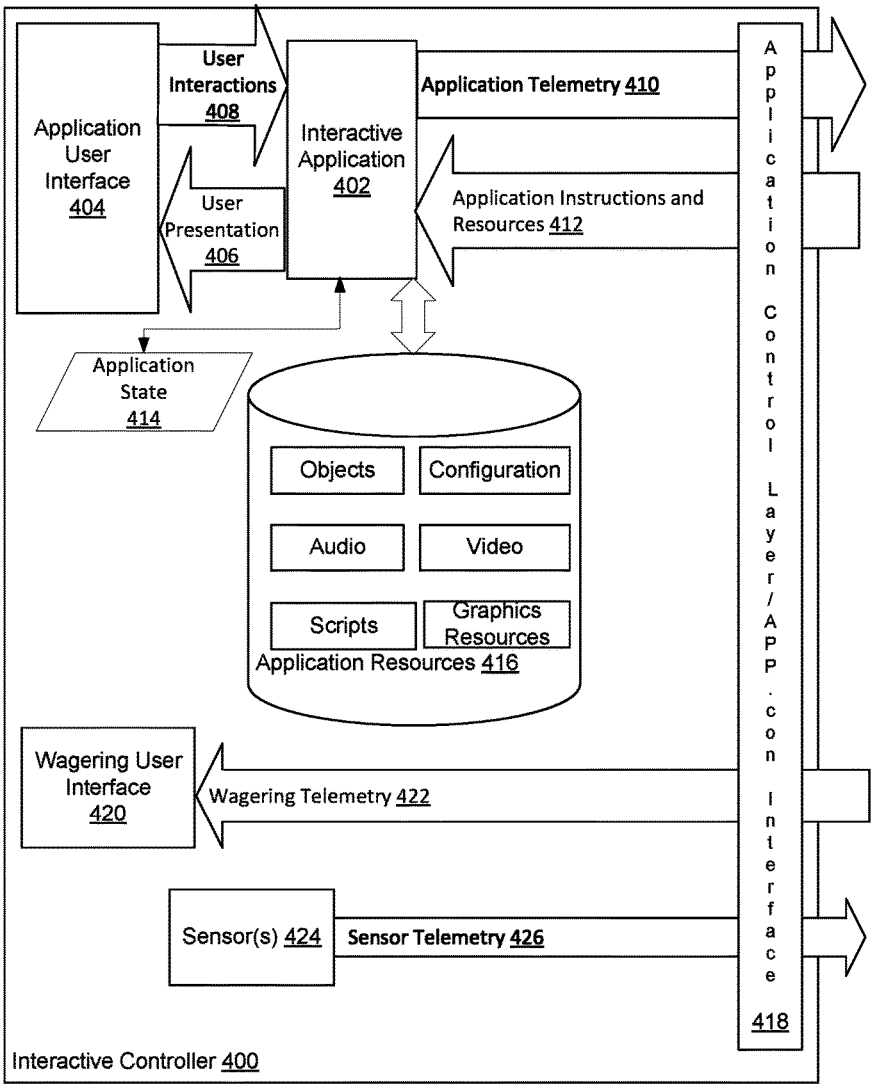
FIGS. 4A and 4B are diagrams of a structure of an interactive controller of an integrated wagering process interleaved wagering system in accordance with various embodiments of the invention.
Figure 4B:
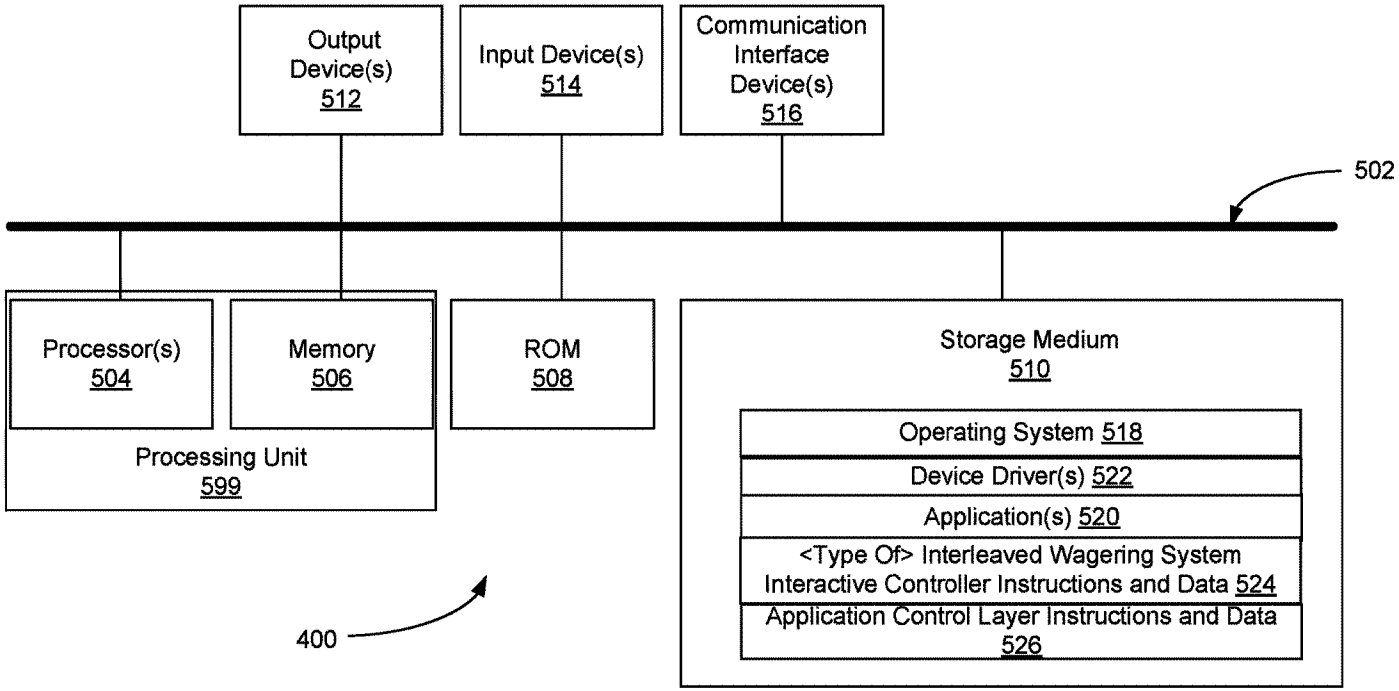

FIGS. 4A and 4B are diagrams of a structure of an interactive controller of an integrated wagering process interleaved wagering system in accordance with various embodiments of the invention. An interactive controller may be constructed from or configured using one or more processing devices configured to perform the operations of the interactive controller. In many embodiments, an interactive controller can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, or the like.

Referring now to FIG. 4A, an interactive controller 400, suitable for use as interactive controller 120 of FIG. 1A, provides an execution environment for an interactive application 402 of an integrated wagering process interleaved wagering system. In several embodiments, an interactive controller 400 of an integrated wagering process interleaved wagering system provides an interactive application 402 that generates an application user interface 404 for interaction with by a user. The interactive application 402 generates a user presentation 406 that is presented to the user through the application user interface 404. The user presentation 406 may include audio features, visual features or tactile features, or any combination of these features. The application user interface 404 further includes one or more human input devices (HIDs) interfaces that communicate with one or more HIDs (e.g., the input devices 514 of FIG. 4*b*) that the user can use to interact with the integrated wagering process interleaved wagering system. The user's interactions 408 are included by the interactive application 402 in application telemetry data 410 that is communicated by interactive controller 400 to various other components of an integrated wagering process interleaved wagering system as described herein. The interactive application 402 receives application instructions and resources 412 communicated from various other components of an integrated wagering process interleaved wagering system as described herein.

In some embodiments, various components of the interactive application 402 can read data from an application state 414 in order to provide one or more features of the interactive application. In various embodiments, components of the interactive application 402 can include, but are not limited to, a physics engine, a rules engine, and/or a graphics engine. The physics engine is used to simulate physical interactions between virtual objects in the interactive application 402. The rules engine implements the rules of the interactive application and a P/RNG that may be used for influencing or determining certain variables and/or outcomes to provide a randomizing influence on the operations of the interactive application. The graphics engine is used to generate a visual representation of the interactive application state to the user. Furthermore, the components may also include an audio engine to generate audio outputs for the user interface.

During operation, the interactive application reads and writes application resources 416 stored on a data store of the interactive controller host. The application resources 416 may include objects having graphics and/or control logic used to provide application environment objects of the interactive application. In various embodiments, the resources may also include, but are not limited to, video files that are used to generate a portion of the user presentation 406; audio files used to generate music, sound effects, etc. within the interactive application; configuration files used to configure the features of the interactive application; scripts or other types of control code used to provide various features of the interactive application; and graphics resources such as textures, objects, etc. that are used by a graphics engine to render objects displayed in an interactive application.

In operation, components of the interactive application 402 read portions of the application state 414 and generate the user presentation 406 for the user that is presented to the user using the user interface 404. The user perceives the user presentation and provides user interactions 408 using the HIDs. The corresponding user interactions are received as user actions or inputs by various components of the interactive application 402. The interactive application 402 translates the user actions into interactions with the virtual objects of the application environment stored in the application state 414. Components of the interactive application use data of the user interactions with the virtual objects of the interactive application and the interactive application state 414 to update the application state 414 and update the user presentation 406 presented to the user. The process loops continuously while the user interacts with the interactive application of the integrated wagering process interleaved wagering system.

The interactive controller 400 provides one or more interfaces 418 between the interactive controller 400 and other components of an integrated wagering process interleaved wagering system, such as, but not limited to, an application controller. The interactive controller 400 and the other integrated wagering process interleaved wagering system components communicate with each other using the interfaces. The interface may be used to pass various types of data, and to communicate and receive messages, status data, commands and the like. In certain embodiments, the interactive controller 400 and an application controller communicate application instructions and environment resources 412 and application telemetry data 410. In some embodiments, the communications include requests by the application controller that the interactive controller 400 update the application state 414 using data provided by the application controller.

In many embodiments, a communication by an application controller includes a request that the interactive controller 400 update one or more resources 416 using data provided by the application controller. In a number of embodiments, the interactive controller 400 provides all or a portion of the application state to the application controller. In some embodiments, the interactive controller 400 may also provide data about one or more of the application resources 416 to the application controller. In some embodiments, the communication includes user interactions that the interactive controller 400 communicates to the application controller. The data of the user interactions may be data of low level user interactions with the user interface 404, such as manipulation of a HID, or may be high level interactions with game objects as determined by the interactive application. The data of the user interactions may also include data of the resultant actions such as modifications to the application state 414 or game resources 416 resulting from the user's interactions taken in the integrated wagering process interleaved wagering system interactive application. In some embodiments, user interactions include, but are not limited to, actions taken by entities such as non-player characters (NPC) of the interactive application that act on behalf of or under the control of the user.

In some embodiments, the interactive controller 400 includes a wagering user interface 420 used to communicate integrated wagering process interleaved wagering system telemetry data 422 to and from the user. The integrated wagering process interleaved wagering system telemetry data 422 from the integrated wagering process interleaved wagering system include, but are not limited to, data used by the user to configure Cr, AC and element wagers, and data about the gambling game Cr, AC and element wagers such as, but not limited to, Cr, AC and element balances and Cr, AC and element amounts wagered.

In some embodiments, the interactive controller includes one or more sensors 424. Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors (GPSs). The interactive controller 400 communicates sensor telemetry data 426 to one or more components of the integrated wagering process interleaved wagering system.

Referring now to FIG. 4B, interactive controller 400 includes a bus 502 that provides an interface for one or more processors 504, random access memory (RAM) 506, read only memory (ROM) 508, machine-readable storage medium 510, one or more user output devices 512, one or more user input devices 514, and one or more communication interface devices 516.

The one or more processors 504 may take many forms, such as, but not limited to: a central processing unit (CPU); a multi-processor unit (MPU); an ARM processor; a controller; a programmable logic device; or the like.

In the example embodiment, the one or more processors 504 and the random access memory (RAM) 506 form an interactive controller processing unit 599. In some embodiments, the interactive controller processing unit includes one or more processors operatively connected to one or more of a RAM, ROM, and machine-readable storage medium; the one or more processors of the interactive controller processing unit receive instructions stored by the one or more of a RAM, ROM, and machine-readable storage medium via a bus; and the one or more processors execute the received instructions. In some embodiments, the interactive controller processing unit is an ASIC (Application-Specific Integrated Circuit). In some embodiments, the interactive controller processing unit is a SoC (System-on-Chip).

Examples of output devices 512 include, but are not limited to, display screens; light panels; and/or lighted displays. In accordance with particular embodiments, the one or more processors 504 are operatively connected to audio output devices such as, but not limited to: speakers; and/or sound amplifiers. In accordance with many of these embodiments, the one or more processors 504 are operatively connected to tactile output devices like vibrators, and/or manipulators.

Examples of user input devices 514 include, but are not limited to: tactile devices including but not limited to, keyboards, keypads, foot pads, touch screens, and/or trackballs; non-contact devices such as audio input devices; motion sensors and motion capture devices that the interactive controller can use to receive inputs from a user when the user interacts with the interactive controller; physiological sensors that monitor the physiology of the user; environmental sensors that monitor the physical environment of the interactive controller; accelerometers that monitor changes in motion of the interactive controller; and location sensors that monitor the location of the interactive controller such as global positioning sensors.

The one or more communication interface devices 516 provide one or more wired or wireless interfaces for communicating data and commands between the interactive controller 400 and other devices that may be included in an integrated wagering process interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 510 stores machine-executable instructions for various components of the interactive controller, such as but not limited to: an operating system 518; one or more device drivers 522; one or more application programs 520 including but not limited to an interactive application; and integrated wagering process interleaved wagering system interactive controller instructions and data 524 for use by the one or more processors 504 to provide the features of an interactive controller as described herein. In some embodiments, the machine-executable instructions further include application control layer/application control interface instructions and data 526 for use by the one or more processors 504 to provide the features of an application control layer/application control interface as described herein.

In various embodiments, the machine-readable storage medium 510 is one of a (or a combination of two or more of) a hard drive, a flash drive, a DVD, a CD, a flash storage, a solid state drive, a ROM, an EEPROM, and the like.

In operation, the machine-executable instructions are loaded into memory 506 from the machine-readable storage medium 510, the ROM 508 or any other storage location. The respective machine-executable instructions are accessed by the one or more processors 504 via the bus 502, and then executed by the one or more processors 504. Data used by the one or more processors 504 are also stored in memory 506, and the one or more processors 504 access such data during execution of the machine-executable instructions. Execution of the machine-executable instructions causes the one or more processors 504 to control the interactive controller 400 to provide the features of an integrated wagering process interleaved wagering system interactive controller as described herein Although the interactive controller is described herein as being constructed from or configured using one or more processors and instructions stored and executed by hardware components, the interactive controller can be constructed from or configured using only hardware components in accordance with other embodiments. In addition, although the storage medium 510 is described as being operatively connected to the one or more processors through a bus, those skilled in the art of interactive controllers will understand that the storage medium can include removable media such as, but not limited to, a USB memory device, an optical CD ROM, magnetic media such as tape and disks. In some embodiments, the storage medium 510 can be accessed by the one or more processors 504 through one of the communication interface devices 516 or using a communication link. Furthermore, any of the user input devices or user output devices can be operatively connected to the one or more processors 504 via one of the communication interface devices 516 or using a communication link.

In some embodiments, the interactive controller 400 can be distributed across a plurality of different devices. In many such embodiments, an interactive controller of an integrated wagering process interleaved wagering system includes an interactive application server operatively connected to an interactive client using a communication link. The interactive application server and interactive application client cooperate to provide the features of an interactive controller as described herein.

In various embodiments, the interactive controller 400 may be used to construct other components of an integrated wagering process interleaved wagering system as described herein.

In some embodiments, components of an interactive controller and an application controller of an integrated wagering process wagering interleaved system may be constructed from or configured using a single device using processes that communicate using an interprocess communication protocol. In other such embodiments, the components of an interactive controller and an application controller of an integrated wagering process wagering interleaved system may communicate by passing messages, parameters or the like.

Figure 5A:
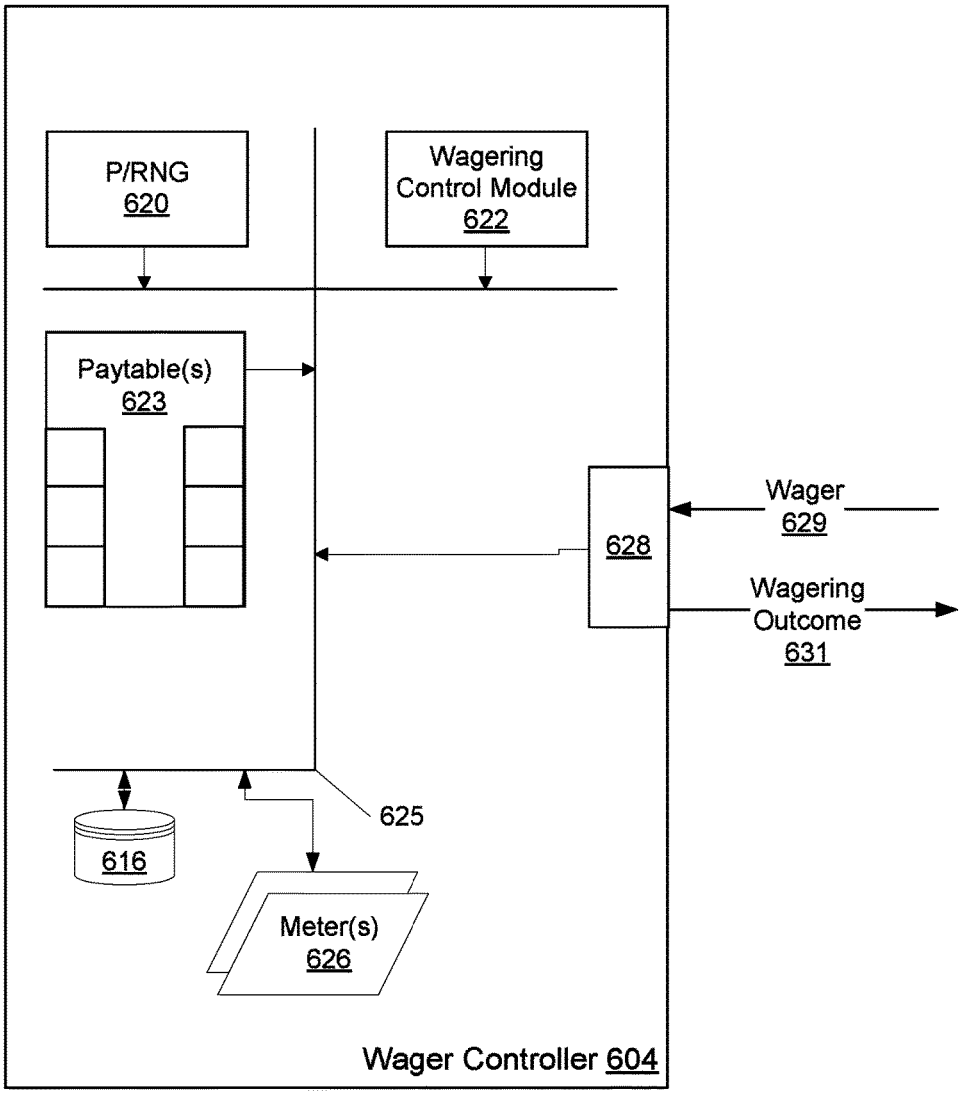
FIGS. 5A and 5B are diagrams of a structure of a wager controller of an integrated wagering process interleaved wagering system in accordance with various embodiments of the invention.
Figure 5B:
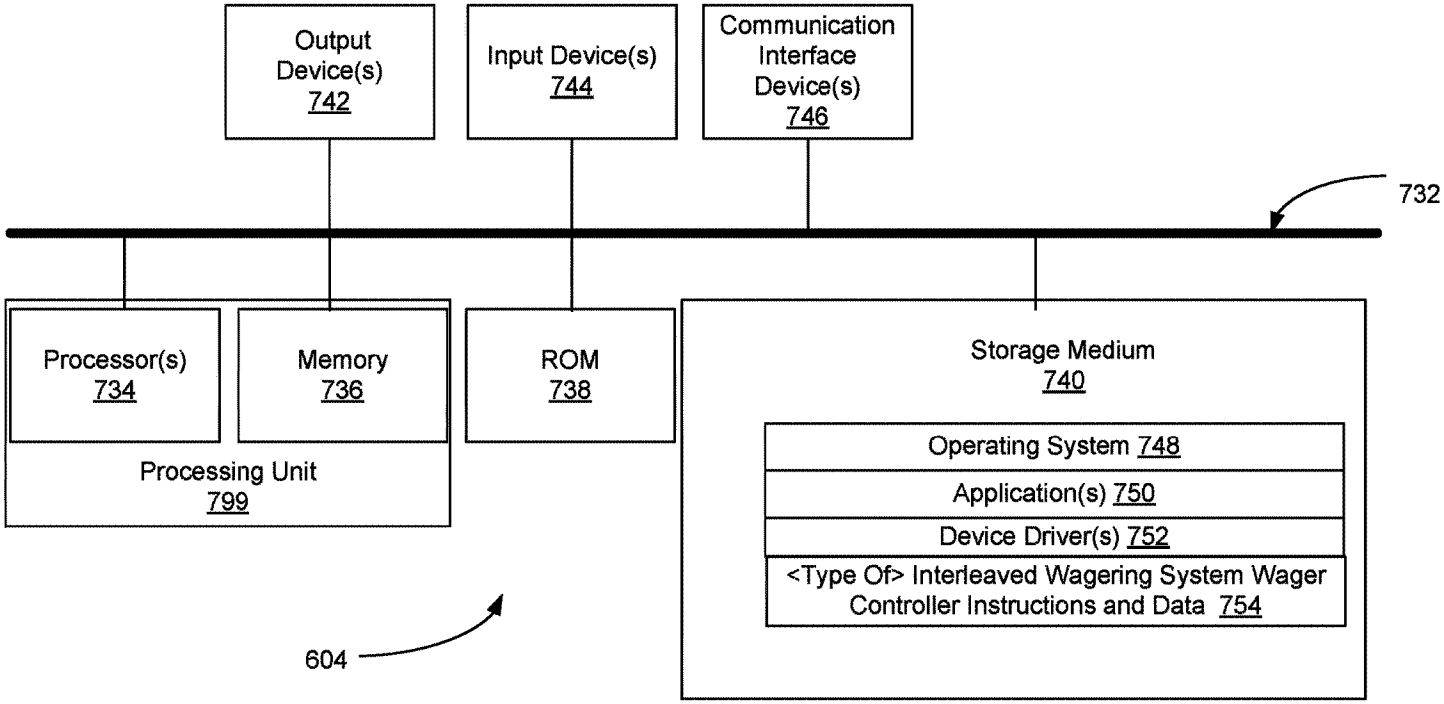

FIGS. 5A and 5B are diagrams of a structure of a wager controller of an integrated wagering process interleaved wagering system in accordance with various embodiments of the invention. A wager controller may be constructed from or configured using one or more processing devices configured to perform the operations of the wager controller. In many embodiments, a wager controller can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, or the like.

Referring now to FIG. 5A, in various embodiments, a wager controller 604, suitable for use as wager controller 102 of FIG. 1A, includes a pseudorandom or random number generator (P/RNG) 620 to produce random results or pseudo random results; one or more paytables 623 which includes a plurality of factors indexed by the random result to be multiplied with an amount of Cr, AC, elements, or objects committed in a wager; and a wagering control module 622 whose processes may include, but are not limited to, generating random results, looking up factors in the paytables, multiplying the factors by an amount of Cr, AC, elements, or objects wagered, and administering one or more Cr, AC, element, or object meters 626. The various wager controller components can interface with each other via an internal bus 625 and/or other appropriate communication mechanism.

An interface 628 allows the wager controller 604 to operatively connect to an external device, such as one or more application controllers as described herein. The interface 628 provides for receiving of wager execution instructions 629 from the external device that is used to specify wager parameters and/or trigger execution of a wager by the wager controller 604. The interface 628 may also provide for communicating wager outcome data 631 to an external device. In numerous embodiments, the interface between the wager controller 604 and other systems/devices may be a wide area network (WAN) such as the Internet. However, other methods of communication may be used including, but not limited to, a local area network (LAN), a universal serial bus (USB) interface, and/or some other method by which two electronic devices could communicate with each other.

In various embodiments, a wager controller 604 may use a P/RNG provided by an external system. The external system may be connected to the wager controller 604 by a suitable communication network such as a local area network (LAN) or a wide area network (WAN). In some embodiments, the external P/RNG is a central deterministic system that provides random or pseudo random results to one or more connected wager controllers.

During operation of the wager controller, the external system communicates wager execution instructions 629 to the wager controller 604. The wager controller 604 receives the wager execution instructions and uses the wager execution instructions to trigger execution of a wager in accordance with a wagering proposition. The wager controller 604 executes the wager and determines a wager outcome for the wager. The wager controller communicates wager outcome data 631 of the wager outcome to the external system.

In some embodiments, the wager controller uses the wager execution instructions to select a paytable 628 to use and/or an amount of Cr, AC, elements, or objects to wager.

In some embodiments, the wager outcome data may include, but is not limited to, an amount of Cr, AC, elements, or objects won in the wager.

In various embodiments, the wager outcome data may include, but is not limited to, an amount of Cr, AC, elements, or objects in the one or more meters 626.

In some embodiments, the wager outcome data includes state data for the wagering proposition of the executed wager. The state data may correspond to one or more game states of a gambling game that is associated with the wagering proposition. Examples of state data include, but are not limited to, reel strips in an operation state or a final state for a reel-based gambling game, one or more dice positions for a dice-based gambling game, positions of a roulette wheel and roulette ball, position of a wheel of fortune, or the like.

In various embodiments, the wagering control module 622 determines an amount of a wager and a paytable to use from the one or more paytables 623. In such embodiments, in response to the wager execution instructions triggering execution of the wager, the wager control module 622 executes the wager by requesting a P/RNG result from the P/RNG 620; retrieving a paytable from the one or more paytables 623; adjusting the one or more credit meters 626 for an amount of the wager; applying the P/RNG result to the retrieved paytable; multiplying the resultant factor from the paytable by an amount wagered to determine a wager outcome; updating the one or more meters 626 based on the wager outcome; and communicating the wager outcome to the external device.

In various embodiments, an external system communicates a request for a P/RNG result from the wager controller 604. In response, the wager controller 604 returns a P/RNG result as a function of an internal P/RNG or a P/RNG external to the external system to which the wager controller 604 is operatively connected.

In some embodiments, a communication exchange between the wager controller 604 and an external system relate to the external system support for coupling a P/RNG result to a particular paytable contained in the wager controller 604. In such an exchange, the external system communicates to the wager controller 604 as to which of the one or more paytables 623 to use, and requests a result whereby the P/RNG result would be associated with the requested paytable 623. The result of the coupling is returned to the external system. In such an exchange, no actual Cr, AC, element, or object wager is conducted, but might be useful in coupling certain non-value wagering interactive application behaviors and propositions to the same final resultant wagering return which is understood for the integrated wagering process interleaved wagering system to conduct wagering.

In some embodiments, the wager controller 604 may also include storage for statuses, wagers, wager outcomes, meters and other historical events in a storage device 616.

In some embodiments, an authorization access module provides a process to permit access and command exchange with the wager controller 604 and access to the one or more credit meters 626 for the amount of Cr, AC, elements, or objects being wagered by the user in the integrated wagering process interleaved wagering system.

In numerous embodiments, communication occurs between various types of a wager controller and an external system 630, such as application controller. In some of these embodiments, the purpose of the wager controller is to allocate wagers to pools, detect occurrences of one or more events upon which the wagers were made, and determine the wager outcomes for each individual wager based on the number of winning wagers and the amount paid into the pool.

In some embodiments, the wager controller manages accounts for individual users wherein the users make deposits into the accounts, amounts are deducted from the accounts, and amounts are credited to the users' accounts based on the wager outcomes.

In some embodiments a wager controller is a pari-mutuel wagering system such as used for wagering on an events such as horse races, greyhound races, sporting events and the like. In a pari-mutuel wagering system, user's wagers on the outcome of an event are allocated to a pool. When the event occurs, wager outcomes are calculated by sharing the pool among all winning wagers.

In various embodiments, a wager controller is a central determination system, such as but not limited to a central determination system for a Class II wagering system or a wagering system in support of a "scratch off" style lottery. In such a wagering system, a player plays against other players and competes for a common prize. In a given set of wager outcomes, there are a certain number of wins and losses. Once a certain wager outcome has been determined, the same wager outcome cannot occur again until a new set of wager outcomes is generated.

In numerous embodiments, communication occurs between various components of a wager controller 604 and an external system, such as an application controller. In some of these embodiments, the purpose of the wager controller 604 is to manage wagering on wagering events and to provide random (or pseudo random) results from a P/RNG.

Referring now to FIG. 5B, wager controller 604 includes a bus 732 that provides an interface for one or more processors 734, random access memory (RAM) 736, read only memory (ROM) 738, machine-readable storage medium 740, one or more user output devices 742, one or more user input devices 744, and one or more communication interface and/or network interface devices 746.

The one or more processors 734 may take many forms, such as, but not limited to, a central processing unit (CPU), a multi-processor unit (MPU), an ARM processor, a controller, a programmable logic device, or the like.

In the example embodiment, the one or more processors 734 and the random access memory (RAM) 736 form a wager controller processing unit 799. In some embodiments, the wager controller processing unit includes one or more processors operatively connected to one or more of a RAM, ROM, and machine-readable storage medium; the one or more processors of the wager controller processing unit receive instructions stored by the one or more of a RAM, ROM, and machine-readable storage medium via a bus; and the one or more processors execute the received instructions. In some embodiments, the wager controller processing unit is an ASIC (Application-Specific Integrated Circuit). In some embodiments, the wager controller processing unit is a SoC (System-on-Chip).

Examples of output devices 742 include, but are not limited to, display screens, light panels, and/or lighted displays. In accordance with particular embodiments, the one or more processors 734 are operatively connected to audio output devices such as, but not limited to speakers, and/or sound amplifiers. In accordance with many of these embodiments, the one or more processors 734 are operatively connected to tactile output devices like vibrators, and/or manipulators.

Examples of user input devices 734 include, but are not limited to, tactile devices including but not limited to, keyboards, keypads, touch screens, and/or trackballs; non-contact devices such as audio input devices; motion sensors and motion capture devices that the wager controller can use to receive inputs from a user when the user interacts with the wager controller 604.

The one or more communication interface and/or network interface devices 746 provide one or more wired or wireless interfaces for exchanging data and commands between the wager controller 604 and other devices that may be included in an integrated wagering process interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface; a cellular or satellite telephone network interface; and the like.

The machine-readable storage medium 740 stores machine-executable instructions for various components of a wager controller, such as but not limited to: an operating system 748; one or more application programs 750; one or more device drivers 752; and integrated wagering process interleaved wagering system wager controller instructions and data 754 for use by the one or more processors 734 to provide the features of an integrated wagering process interleaved wagering system wager controller as described herein.

In various embodiments, the machine-readable storage medium 740 is one of a (or a combination of two or more of) a hard drive, a flash drive, a DVD, a CD, a flash storage, a solid state drive, a ROM, an EEPROM, and the like.

In operation, the machine-executable instructions are loaded into memory 736 from the machine-readable storage medium 740, the ROM 738 or any other storage location. The respective machine-executable instructions are accessed by the one or more processors 734 via the bus 732, and then executed by the one or more processors 734. Data used by the one or more processors 734 are also stored in memory 736, and the one or more processors 734 access such data during execution of the machine-executable instructions. Execution of the machine-executable instructions causes the one or more processors 734 to control the wager controller 604 to provide the features of an integrated wagering process interleaved wagering system wager controller as described herein Although the wager controller 604 is described herein as being constructed from or configured using one or more processors and machine-executable instructions stored and executed by hardware components, the wager controller can be composed of only hardware components in accordance with other embodiments. In addition, although the storage medium 740 is described as being operatively connected to the one or more processors through a bus, those skilled in the art of processing devices will understand that the storage medium can include removable media such as, but not limited to, a USB memory device, an optical CD ROM, magnetic media such as tape and disks. In some embodiments, the storage medium 740 can be accessed by the one or more processors 734 through one of the interfaces or using a communication link. Furthermore, any of the user input devices or user output devices can be operatively connected to the one or more processors 734 via one of the interfaces or using a communication link.

In various embodiments, the wager controller 604 may be used to construct other components of an integrated wagering process interleaved wagering system as described herein.

In some embodiments, components of a wager controller and an application controller of an integrated wagering process wagering interleaved system may be constructed from or configured using a single device using processes that communicate using an interprocess communication protocol. In other such embodiments, the components of a wager controller and an application controller of an integrated wagering process wagering interleaved system may communicate by passing messages, parameters or the like.

It should be understood that there may be many embodiments of a wager controller 604 which could be possible, including forms where many modules and components of the wager controller are located in various servers and locations, so the foregoing is not meant to be exhaustive or all inclusive, but rather provide data on various embodiments of a wager controller 604.

Figure 6A:
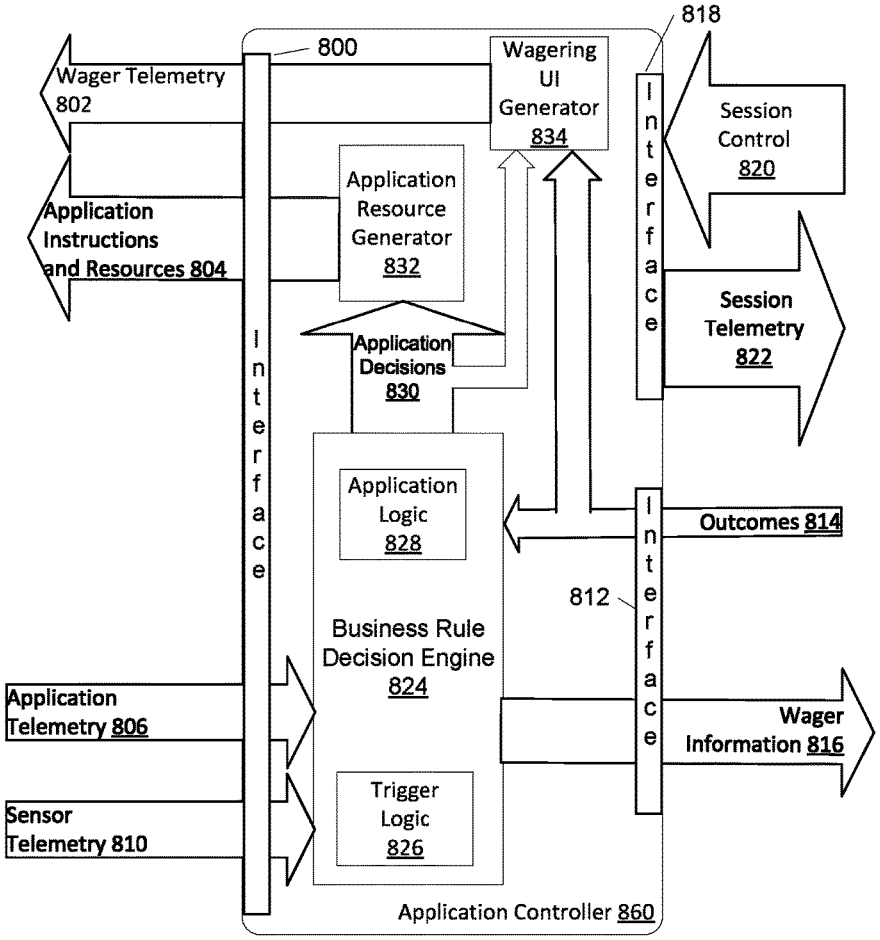
FIGS. 6A and 6B are diagrams of a structure of an application controller of an integrated wagering process interleaved wagering system in accordance with various embodiments of the invention.
Figure 6B:
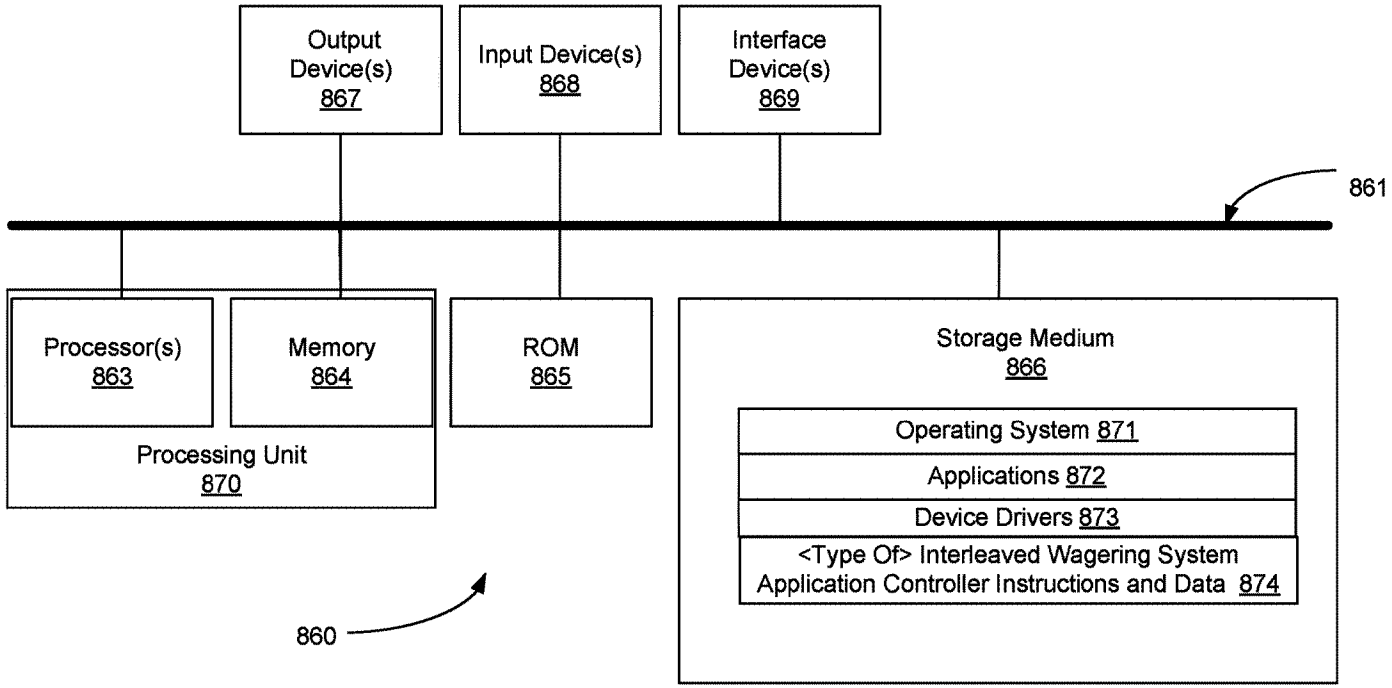

FIGS. 6A and 6B are diagrams of a structure of an application controller of an integrated wagering process interleaved wagering system in accordance with various embodiments of the invention. An application controller may be constructed from or configured using one or more processing devices configured to perform the operations of the application controller. In many embodiments, an application controller can be constructed from or configured using various types of processing devices including, but not limited to, a mobile device such as a smartphone, a personal digital assistant, a wireless device such as a tablet computer or the like, an electronic gaming machine, a personal computer, a gaming console, a set-top box, a computing device, a controller, or the like.

Referring now to FIG. 6A, in many embodiments, an application controller 860, suitable for use as application controller 112 of FIG. 1A, manages operation of an integrated wagering process interleaved wagering system, with a wager controller and an interactive controller being support units to the application controller 860. The application controller 860 provides an interface between the interactive application, provided by an interactive controller, and a wagering proposition, provided by a wager controller.

In some embodiments, the application controller 860 includes an interactive controller interface 800 to an interactive controller. The interactive controller interface 800 provides for communication of data between an interactive controller and the application controller 860, including but not limited to wager telemetry data 802, application instructions and resources 804, application telemetry data 806, and sensor telemetry data 810.

In various embodiments, the application controller 860 includes a wager controller interface 812 to a wager controller. The wager controller interface 812 provides for communication of data between the application controller 860 and a wager controller, including but not limited to wager outcomes 814 and wager execution instructions 816.

In some embodiments, the application controller 860 includes a user management and session controller interface 818 to a user management and session controller. The user management and session controller interface 818 provides for communication of data between the application controller 860 and a user management and session controller, including but not limited to user session control data 820 and user session telemetry data 822.

The application controller 860 includes a rule-based decision engine 824 that receives telemetry data, such as application telemetry data and sensor telemetry data, from an interactive controller. The rule-based decision engine 824 uses the telemetry data, along with trigger logic 826 to generate wager execution instructions used to trigger a wager in a wager controller.

In some embodiments, the application telemetry data includes, but is not limited to, application environment variables that indicate the state of an interactive application being used by a user, interactive controller data indicating a state of an interactive controller, and user actions and interactions between a user and an interactive application provided by an interactive controller. The wagering and/or wager execution instructions may include, but is not limited to, an amount and type of the wager, a trigger of the wager, and a selection of a paytable to be used when executing the wager.

In some embodiments, the rule-based decision engine 824 also receives wager outcome data from a wager controller. The decision engine 824 uses the wager outcome data, in conjunction with telemetry data and application logic 828 to generate application decisions 830 communicated to an application resource generator 832. The application resource generator 832 receives the application decisions and uses the application decisions to generate application instructions and application resources to be communicated to an interactive application.

In many embodiments, the application controller 860 includes a pseudo random or random result generator used to generate random results that are communicated to the application resource generator 832. The application resource generator uses the random results to generate application instructions and application resources to be communicated to an interactive controller for use by an interactive application.

In various embodiments, the rule-based decision engine 824 also determines an amount of AC to award to a user based at least in part on the user's use of an interactive application of the integrated wagering process interleaved wagering system as determined from application telemetry data. In some embodiments, wager outcome data may also be used to determine the amount of AC that should be awarded to the user.

In numerous embodiments, an interactive application is a skill-based interactive game and the AC is awarded to the user for the user's skillful play of the skill-based interactive game.

In some embodiments, the application decisions and wager outcome data are communicated to a wagering user interface generator 834. The wagering user interface generator 834 receives the application decisions and wager outcome data and generates wager telemetry data describing the state of wagering and credit accumulation and loss for the integrated wagering process interleaved wagering system. In some embodiments, the wager telemetry data 146 may include, but is not limited to, amounts of AC and elements earned, lost or accumulated by the user through use of the interactive application as determined from the application decisions, and Cr amounts won, lost or accumulated as determined from the wager outcome data and the one or more credit meters.

In some embodiments, the wager outcome data 814 also includes data about one or more game states of a gambling game executed in accordance with a wagering proposition by a wager controller. In various such embodiments, the wagering user interface generator 834 generates a gambling game process display and/or gambling game state display using the one or more game states of the gambling game. The gambling game process display and/or gambling game state display is included in wager telemetry data that is communicated to an interactive controller. The gambling game process display and/or a gambling game state display is displayed by a wagering user interface of the interactive controller to a user. In other such embodiments, the one or more game states of the gambling game are communicated to an interactive controller and a wagering user interface of the interactive controller generates a gambling game process display and/or gambling game state display using the one or more game states of the gambling game for display to a user.

The application controller 860 can further operatively connect to a wager controller to determine an amount of credit or elements available and other wagering metrics of a wagering proposition. Thus, the application controller 860 may potentially affect an amount of Cr in play for participation in the wagering events of a gambling game provided by the wager controller. The application controller 860 may additionally include various audit logs and activity meters. In some embodiments, the application controller 860 can also couple to a centralized server for exchanging various data related to the user and the activities of the user during game play of an integrated wagering process interleaved wagering system.

In some embodiments, the operation of the application controller 860 does not affect the provision of a wagering proposition by a wager controller except for user choice parameters that are allowable in accordance with the wagering proposition. Examples of user choice parameters include, but are not limited to: wager terms such as but not limited to a wager amount; speed of game play (for example, by pressing a button or pulling a handle of a slot machine); and/or agreement to wager into a bonus round.

In a number of embodiments, communication of wager execution instructions between a wager controller and the application controller 860 can further be used to communicate various wagering control factors that the wager controller uses as input. Examples of wagering control factors include, but are not limited to, an amount of Cr, AC, elements, or objects consumed per wagering event, and/or the user's election to enter a jackpot round.

In some embodiments, the application controller 860 utilizes a wagering user interface to communicate certain interactive application data to the user, including but not limited to, club points, user status, control of the selection of user choices, and messages which a user can find useful in order to adjust the interactive application experience or understand the wagering status of the user in accordance with the wagering proposition in the wager controller.

In some embodiments, the application controller 860 utilizes a wagering user interface to communicate aspects of a wagering proposition to the user including, but not limited to, odds of certain wager outcomes, amount of Cr, AC, elements, or objects in play, and amounts of Cr, AC, elements, or objects available.

In a number of embodiments, a wager controller can accept wager proposition factors including, but not limited to, modifications in the amount of Cr, AC, elements, or objects wagered on each individual wagering event, a number of wagering events per minute the wager controller can resolve, entrance into a bonus round, and other factors. In several embodiments, the application controller 860 can communicate a number of factors back and forth to the wager controller, such that an increase/decrease in a wagered amount can be related to the change in user profile of the user in the interactive application. In this manner, a user can control a wager amount per wagering event in accordance with the wagering proposition with the change mapping to a parameter or component that is applicable to the interactive application experience.

Referring now to FIG. 6B, application controller 860 includes a bus 861 providing an interface for one or more processors 863, random access memory (RAM) 864, read only memory (ROM) 865, machine-readable storage medium 866, one or more user output devices 867, one or more user input devices 868, and one or more communication interface and/or network interface devices 869.

The one or more processors 863 may take many forms, such as, but not limited to: a central processing unit (CPU); a multi-processor unit (MPU); an ARM processor; a programmable logic device; or the like.

Examples of output devices 867 include, include, but are not limited to: display screens; light panels; and/or lighted displays. In accordance with particular embodiments, the one or more processors 863 are operatively connected to audio output devices such as, but not limited to: speakers; and/or sound amplifiers. In accordance with many of these embodiments, the one or more processors 863 are operatively connected to tactile output devices like vibrators, and/or manipulators.

In the example embodiment, the one or more processors 863 and the random access memory (RAM) 864 form an application controller processing unit 870. In some embodiments, the application controller processing unit includes one or more processors operatively connected to one or more of a RAM, ROM, and machine-readable storage medium; the one or more processors of the application controller processing unit receive instructions stored by the one or more of a RAM, ROM, and machine-readable storage medium via a bus; and the one or more processors execute the received instructions. In some embodiments, the application controller processing unit is an ASIC (Application-Specific Integrated Circuit). In some embodiments, the application controller processing unit is a SoC (System-on-Chip).

Examples of user input devices 868 include, but are not limited to: tactile devices including but not limited to, keyboards, keypads, foot pads, touch screens, and/or trackballs; non-contact devices such as audio input devices; motion sensors and motion capture devices that the application controller can use to receive inputs from a user when the user interacts with the application controller 860.

The one or more communication interface and/or network interface devices 869 provide one or more wired or wireless interfaces for exchanging data and commands between the application controller 860 and other devices that may be included in an integrated wagering process interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS), cellular, or satellite telephone network interface; and the like.

The machine-readable storage medium 866 stores machine-executable instructions for various components of the application controller 860 such as, but not limited to: an operating system 871; one or more applications 872; one or more device drivers 873; and integrated wagering process interleaved wagering system application controller instructions and data 874 for use by the one or more processors 863 to provide the features of an application controller as described herein.

In various embodiments, the machine-readable storage medium 870 is one of a (or a combination of two or more of) a hard drive, a flash drive, a DVD, a CD, a flash storage, a solid state drive, a ROM, an EEPROM, and the like.

In operation, the machine-executable instructions are loaded into memory 864 from the machine-readable storage medium 866, the ROM 865 or any other storage location. The respective machine-executable instructions are accessed by the one or more processors 863 via the bus 861, and then executed by the one or more processors 863. Data used by the one or more processors 863 are also stored in memory 864, and the one or more processors 863 access such data during execution of the machine-executable instructions. Execution of the machine-executable instructions causes the one or more processors 863 to control the application controller 860 to provide the features of an integrated wagering process interleaved wagering system application controller as described herein.

Although the application controller 860 is described herein as being constructed from or configured using one or more processors and instructions stored and executed by hardware components, the application controller can be composed of only hardware components in accordance with other embodiments. In addition, although the storage medium 866 is described as being operatively connected to the one or more processors through a bus, those skilled in the art of application controllers will understand that the storage medium can include removable media such as, but not limited to, a USB memory device, an optical CD ROM, magnetic media such as tape and disks. Also, in some embodiments, the storage medium 866 may be accessed by processor 863 through one of the interfaces or using a communication link. Furthermore, any of the user input devices or user output devices may be operatively connected to the one or more processors 863 via one of the interfaces or using a communication link.

In various embodiments, the application controller 860 may be used to construct other components of an integrated wagering process interleaved wagering system as described herein.

In some embodiments, components of an interactive controller and an application controller of an integrated wagering process wagering interleaved system may be constructed from or configured using a single device using processes that communicate using an interprocess communication protocol. In other such embodiments, the components of an interactive controller and an application controller of an integrated wagering process wagering interleaved system may communicate by passing messages, parameters or the like.

Figure 7A:
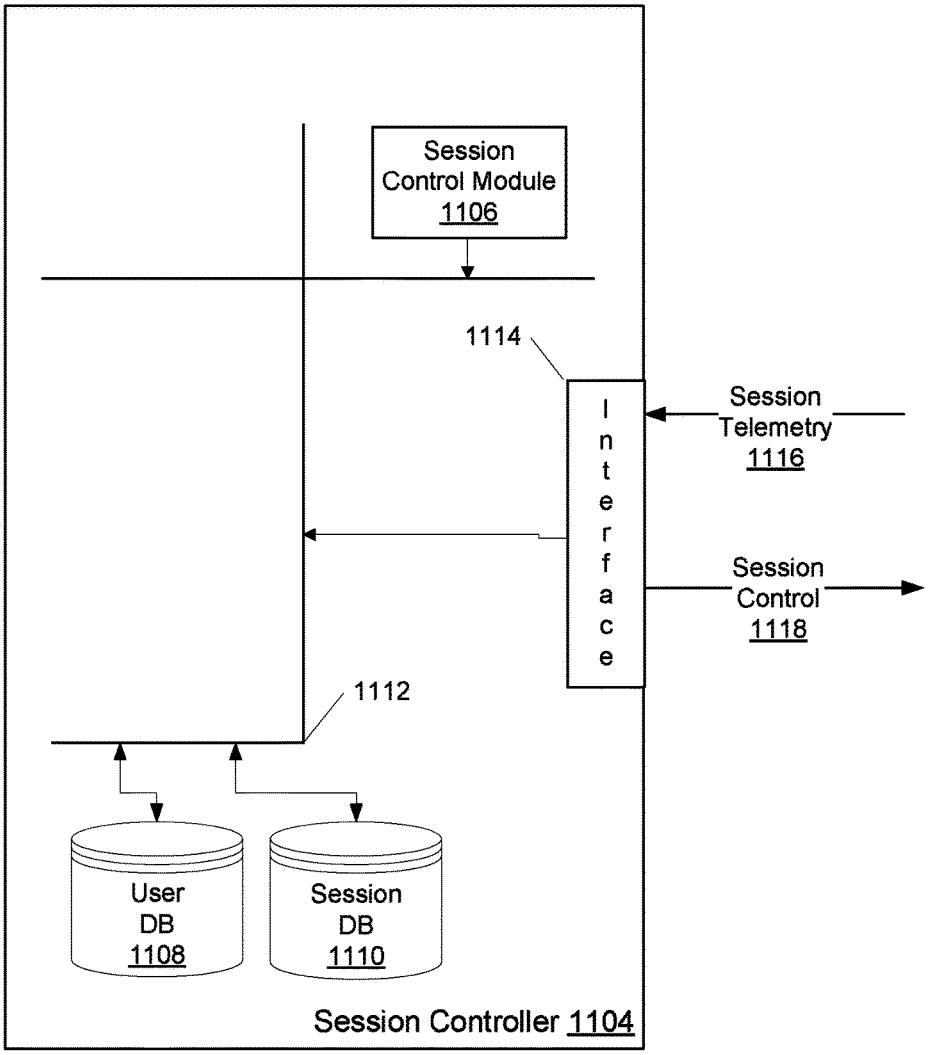
FIGS. 7A and 7B are diagrams of a structure of a user management and session controller of an integrated wagering process interleaved wagering system in accordance with various embodiments of the invention.
Figure 7B:
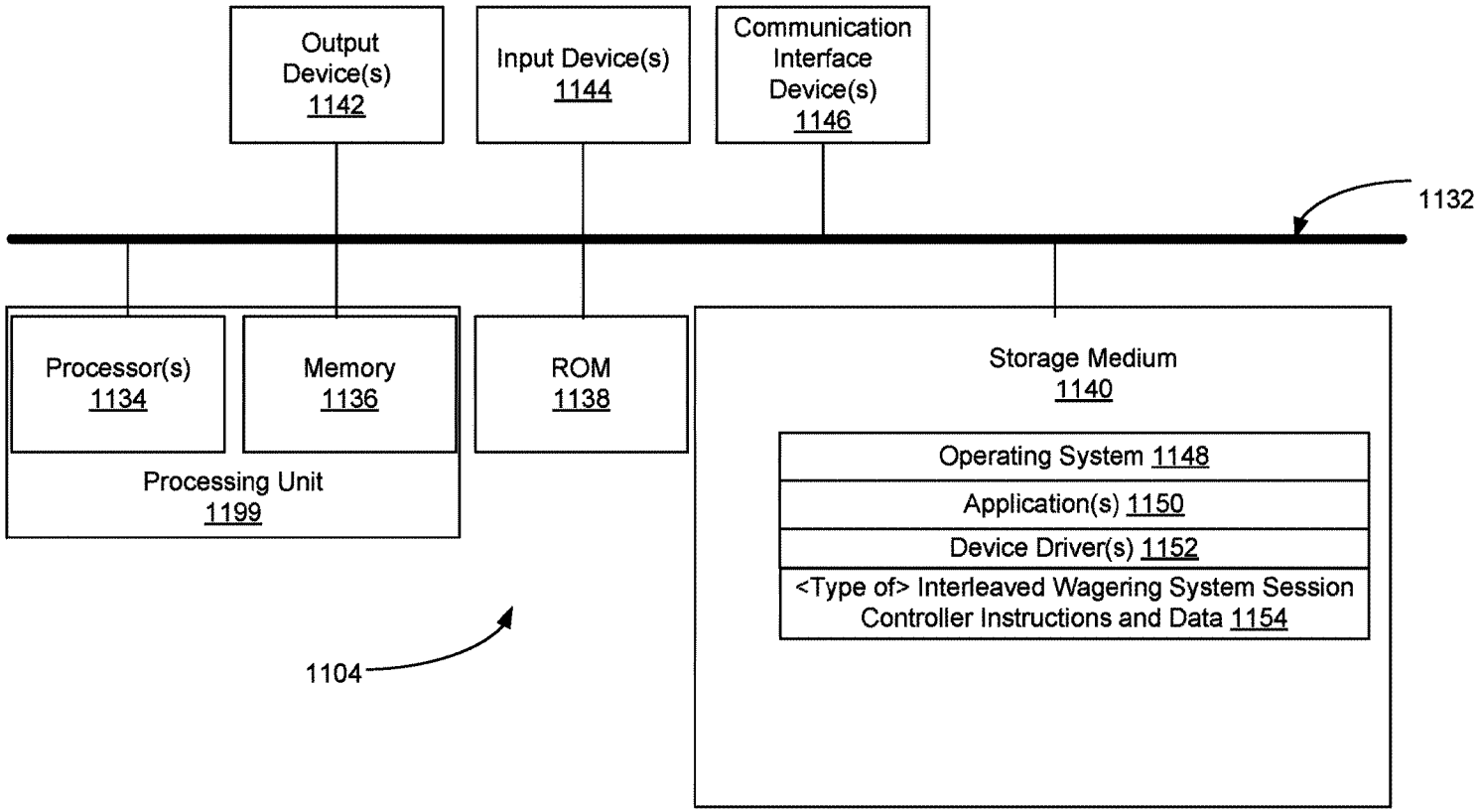

FIGS. 7A and 7B are diagrams of a structure of a user management and session controller of an integrated wagering process interleaved wagering system in accordance with various embodiments of the invention. A user management and session controller may be constructed from or configured using one or more processing devices configured to perform the operations of the user management and session controller. In many embodiments, a wager user session can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, a server, or the like.

Referring now to FIG. 7A, in various embodiments, a user management and session controller 1104, suitable for use as user management and session controller 150 of FIG. 1A, includes a user management and session control module 1106 whose processes may include, but are not limited to, registering users of an integrated wagering process wagering interleaved system, validating users of an integrated wagering process wagering interleaved system using user registration data, managing various types of user sessions for users of the integrated wagering process wagering interleaved system, and the like.

The user management and session controller 1104 may further include a datastore 1108 storing user data used to manage user registration and validation. The user management and session controller 1104 may further include a datastore 1110 storing user session data used to manage one or more user sessions.

The various user management and session controller components can interface with each other via an internal bus 1112 and/or other appropriate communication mechanism.

An interface 1114 allows the user management and session controller 1104 to operatively connect to one or more external devices, such as one or more application controllers, wager controllers and/or interactive controllers as described herein. The interface provides for receiving session telemetry data 1116 from the one more external devices. The user session telemetry data includes, but is not limited to, amounts of AC earned by one or more users, requests for entering into an integrated wagering process user session as described herein, and telemetry data regarding the progress of one or more users during an integrated wagering process user session. The interface 1114 may also provide for communicating secession control data 1118 used to manage a user session.

In numerous embodiments, the interface between the user management and session controller and other systems/devices may be a wide area network (WAN) such as the Internet. However, other methods of communication may be used including, but not limited to, a local area network (LAN), a universal serial bus (USB) interface, and/or some other method by which two electronic devices could communicate with each other.

During operation of the user management and session controller, the external system communicates user session telemetry data to the user management and session controller. The user management and session controller receives the user session telemetry data and uses the user session telemetry data to generate user session control data as described herein. The user management and session controller communicates the user session control data to the external system.

Referring now to FIG. 7B, user management and session controller 1104 includes a bus 1132 that provides an interface for one or more processors 1134, random access memory (RAM) 1136, read only memory (ROM) 1138, machine-readable storage medium 1140, one or more user output devices 1142, one or more user input devices 1144, and one or more communication interface and/or network interface devices 1146.

The one or more processors 1134 may take many forms, such as, but not limited to, a central processing unit (CPU), a multi-processor unit (MPU), an ARM processor, a controller, a programmable logic device, or the like.

In the example embodiment, the one or more processors 1134 and the random access memory (RAM) 1136 form a user management and session controller processing unit 1199. In some embodiments, the user management and session controller processing unit includes one or more processors operatively connected to one or more of a RAM, ROM, and machine-readable storage medium; the one or more processors of the user management and session controller processing unit receive instructions stored by the one or more of a RAM, ROM, and machine-readable storage medium via a bus; and the one or more processors execute the received instructions. In some embodiments, the user management and session controller processing unit is an ASIC (Application-Specific Integrated Circuit). In some embodiments, the user management and session controller processing unit is a SoC (System-on-Chip).

Examples of output devices 1142 include, but are not limited to, display screens, light panels, and/or lighted displays. In accordance with particular embodiments, the one or more processors 1134 are operatively connected to audio output devices such as, but not limited to speakers, and/or sound amplifiers. In accordance with many of these embodiments, the one or more processors 1134 are operatively connected to tactile output devices like vibrators, and/or manipulators.

Examples of user input devices 1144 include, but are not limited to, tactile devices including but not limited to, keyboards, keypads, touch screens, and/or trackballs; non-contact devices such as audio input devices; motion sensors and motion capture devices that the user management and session controller can use to receive inputs from a user when the user interacts with the user management and session controller 1104.

The one or more communication interface and/or network interface devices 1146 provide one or more wired or wireless interfaces for exchanging data and commands between the user management and session controller 1104 and other devices that may be included in an integrated wagering process interleaved wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface; a cellular or satellite telephone network interface; and the like.

The machine-readable storage medium 1140 stores machine-executable instructions for various components of a user management and session controller, such as but not limited to: an operating system 1148; one or more application programs 1150; one or more device drivers 1152; and integrated wagering process interleaved wagering system user management and session controller instructions and data 1154 for use by the one or more processors 1134 to provide the features of an integrated wagering process interleaved wagering system user management and session controller as described herein.

In various embodiments, the machine-readable storage medium 1140 is one of a (or a combination of two or more of) a hard drive, a flash drive, a DVD, a CD, a flash storage, a solid state drive, a ROM, an EEPROM, and the like.

In operation, the machine-executable instructions are loaded into memory 736 from the machine-readable storage medium 1140, the ROM 1138 or any other storage location. The respective machine-executable instructions are accessed by the one or more processors 1134 via the bus 1132, and then executed by the one or more processors 1134. Data used by the one or more processors 1134 are also stored in memory 1136, and the one or more processors 1134 access such data during execution of the machine-executable instructions. Execution of the machine-executable instructions causes the one or more processors 1134 to control the user management and session controller 1104 to provide the features of an integrated wagering process interleaved wagering system user management and session controller as described herein Although the user management and session controller 1104 is described herein as being constructed from or configured using one or more processors and machine-executable instructions stored and executed by hardware components, the user management and session controller can be composed of only hardware components in accordance with other embodiments. In addition, although the storage medium 1140 is described as being operatively connected to the one or more processors through a bus, those skilled in the art of processing devices will understand that the storage medium can include removable media such as, but not limited to, a USB memory device, an optical CD ROM, magnetic media such as tape and disks. In some embodiments, the storage medium 1140 can be accessed by the one or more processors 1134 through one of the interfaces or using a communication link. Furthermore, any of the user input devices or user output devices can be operatively connected to the one or more processors 1134 via one of the interfaces or using a communication link.

In various embodiments, the user management and session controller 1104 may be used to construct other components of an integrated wagering process interleaved wagering system as described herein.

In some embodiments, components of a user management and session controller and an application controller of an integrated wagering process wagering interleaved system may be constructed from or configured using a single device using processes that communicate using an interprocess communication protocol. In other such embodiments, the components of a user management and session controller and an application controller of an integrated wagering process wagering interleaved system may communicate by passing messages, parameters or the like.

In some embodiments, components of a user management and session controller and a wager controller of an integrated wagering process wagering interleaved system may be constructed from or configured using a single device using processes that communicate using an interprocess communication protocol. In other such embodiments, the components of a user management and session controller and an application controller of an integrated wagering process wagering interleaved system may communicate by passing messages, parameters or the like.

It should be understood that there may be many embodiments of a user management and session controller 1104 which could be possible, including forms where many modules and components of the user management and session controller are located in various servers and locations, so the foregoing is not meant to be exhaustive or all inclusive, but rather provide data on various embodiments of a user management and session controller 1104.

In numerous embodiments, any of a wager controller, an application controller, an interactive controller, or a user management and session controller as described herein can be constructed from or configured using multiple processing devices, whether dedicated, shared, or distributed in any combination thereof, or can be constructed from or configured using a single processing device. In addition, while certain aspects and features of integrated wagering process interleaved wagering system processes described herein have been attributed to a wager controller, an application controller, an interactive controller, or a user management and session controller, these aspects and features can be provided in a distributed form where any of the features or aspects can be provided by any of a user management and session controller, a wager controller, an application controller, and/or an interactive controller within an integrated wagering process interleaved wagering system without deviating from the spirit of the invention.

Although various components of integrated wagering process interleaved wagering systems are discussed herein, integrated wagering process interleaved wagering systems can be configured with any component as appropriate to the specification of a specific application in accordance with embodiments of the invention. In certain embodiments, components of an integrated wagering process interleaved wagering system, such as a user management and session controller, an application controller, a wager controller, and/or an interactive controller, can be configured in different ways for a specific integrated wagering process interleaved wagering system.

In some embodiments, components of a user management and session controller, an interactive controller, an application controller, and/or a wager controller of an integrated wagering process wagering interleaved system may be constructed from or configured using a single device using processes that communicate using an interprocess communication protocol. In many embodiments, the components of a user management and session controller, an interactive controller, an application controller and a wager controller of an integrated wagering process wagering interleaved system may communicate by passing messages, parameters or the like.

In addition, while certain aspects and features of integrated wagering process interleaved wagering system processes described herein have been attributed to a user management and session controller, a wager controller, an application controller, or an interactive controller, these aspects and features can be provided in a distributed form where any of the features or aspects can be provided by any of a user management and session controller, a wager controller, an application controller, and/or an interactive controller within an integrated wagering process interleaved wagering system.

Operation of Integrated Wagering Process Wagering Interleaved Systems

Figure 8:
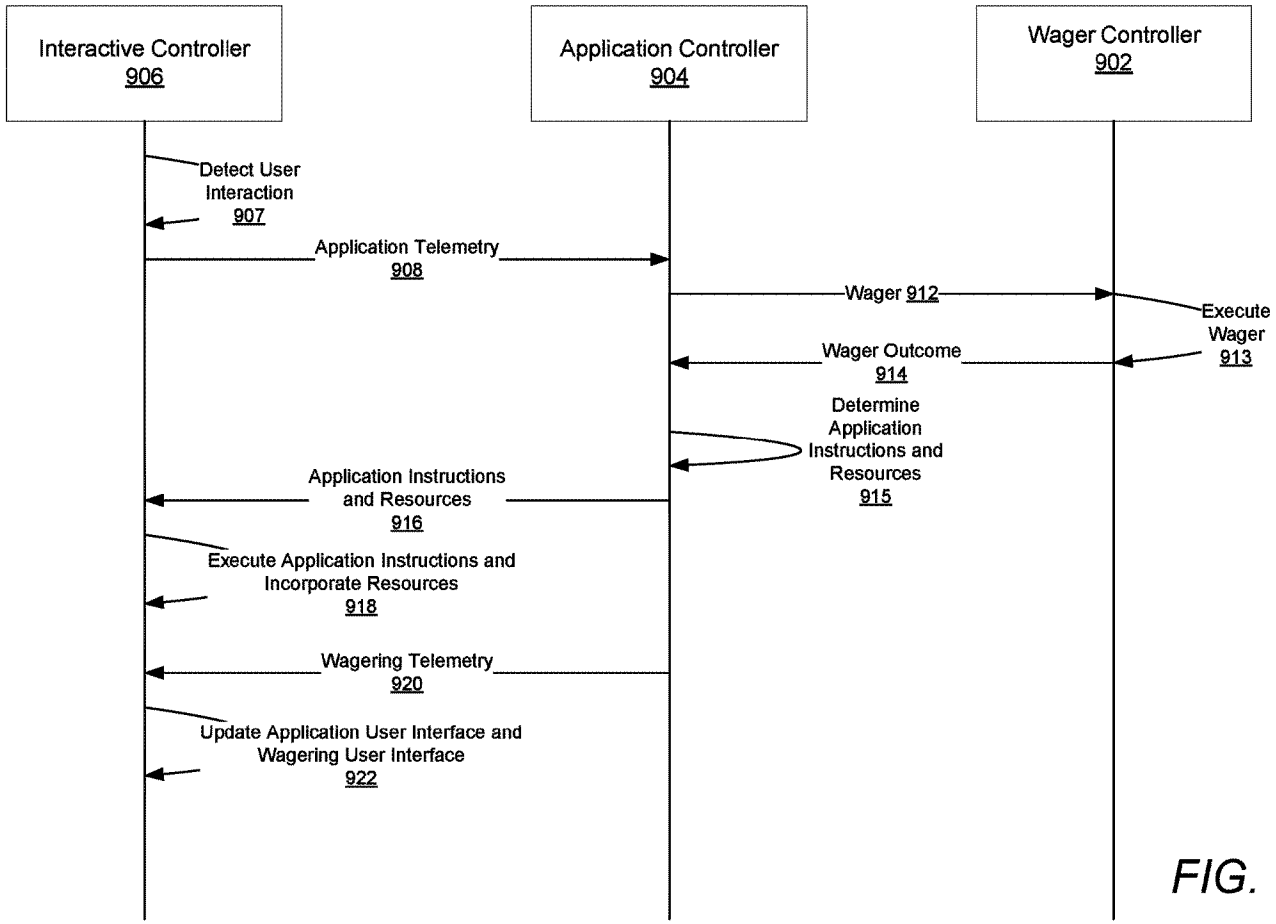
FIG. 8 is a sequence diagram of interactions between components of an integrated wagering process interleaved wagering system in accordance with various embodiments of the invention.

FIG. 8 is a sequence diagram of interactions between components of an integrated wagering process interleaved wagering system in accordance with various embodiments of the invention. The components of the integrated wagering process interleaved wagering system include a wager controller 902, such as wager controller 102 of FIG. 1A, an application controller 904, such as application controller 112 of FIG. 1A, and an interactive controller 906, such as interactive controller 120 of FIG. 1A. The process begins with the interactive controller 906 detecting a user performing a user interaction in a user interface of an interactive application provided by the interactive controller 906. The interactive controller 906 communicates application telemetry data 908 to the application controller 904. The application telemetry data includes, but is not limited to, data of the user interaction detected by the interactive controller 906.

The application controller 904 receives the application telemetry data 908. Upon determination by the application controller 904 that data of the user interaction indicates a wagering event, the application controller 904 generates wager execution instructions including a wager request 912 that the application controller 904 uses to instruct the wager controller 902 to execute a wager. The request for a wager event may include wager terms associated with a wagering proposition. The application controller 904 communicates the wager execution instructions to the wager controller 902.

The wager controller 902 receives the wager execution instructions 912 and uses the wager execution instructions to execute (913) a wager in accordance with a wagering proposition. The wager controller 902 communicates a wager outcome 914 of the executed wager to the application controller 904.

The application controller 904 receives the wager outcome and generates (915) interactive application instructions and resources 916 for the interactive application. The application controller 904 uses the interactive application instructions and resources 916 to instruct the interactive controller. The application controller communicates the interactive application instructions and resources 916 to the interactive controller 906. The application controller also communicates wagering telemetry data 920 including the wager outcome to the interactive controller 906.

The interactive controller 906 receives the interactive application instructions and resources 916 and wagering telemetry data 918. The interactive controller 906 incorporates the received interactive application resources and executes the received interactive application instructions (918). The interactive controller updates (922) an application user interface of the interactive application provided by the interactive controller using the interactive application instructions and the resources, and updates (922) a wagering user interface using the wagering telemetry data.

In several embodiments, a user can interact with an integrated wagering process interleaved wagering system by using Cr for wagering in accordance with a wagering proposition along with AC and elements in interactions with an interactive application. Wagering can be executed by a wager controller while an interactive application can be executed by an interactive controller and managed with an application controller.

Figure 9:
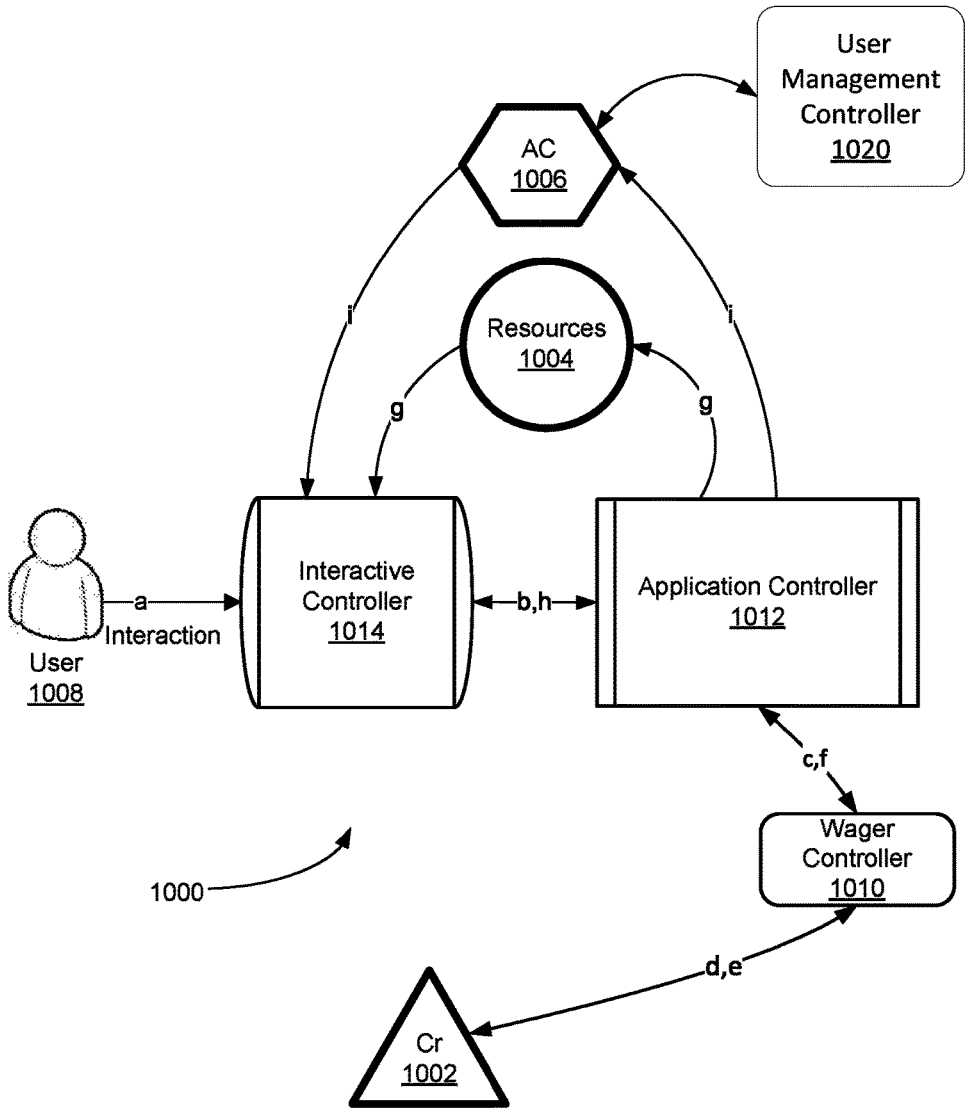
FIG. 9 is a collaboration diagram for components of an integrated wagering process interleaved wagering system in accordance with various embodiments of the invention.

FIG. 9 is a collaboration diagram that illustrates how resources such as AC, Cr, elements, and objects are utilized in an integrated wagering process interleaved wagering system in accordance with various embodiments of the invention. The collaboration diagram 1000 illustrates that Cr 1002, interactive application resources including elements and objects 1004 and AC 1006 can be utilized by a user 1008 in interactions with a wager controller 1010, such as wager controller 102 of FIG. 1A, an application controller 1012, such as wager controller 112 of FIG. 1, and an interactive controller 1014, such as interactive controller 120 of FIG. 1A, of an integrated wagering process interleaved wagering system. The contribution of elements and objects such as included in resources 1004, can be linked to a user's access to credits, such as Cr 1002 and/or AC 1006. Electronic receipt of these credits can come via a smart card, voucher or other portable media, or as received using a communication link from a server. In some embodiments, these credits can be drawn on demand from a user profile located in a database locally on an integrated wagering process interleaved wagering system or in a remote server.

A user's actions and/or decisions can affect an interactive application of interactive controller 1014 that consume and/or accumulate AC 1004 and/or resources 1004 in an interactive application executed by an interactive controller 1014, a wager controller 101 and an application controller 1012. The application controller 1012 can monitor the activities taking place within an interactive application executed by an interactive controller 1014 for wagering event occurrences. The application controller 1012 can also communicate the wagering event occurrences to the wager controller 1010 that triggers a wager of Cr 1002 in accordance with a wagering proposition executed by the wager controller 1010.

In several embodiments, the user commences interaction with the integrated wagering process interleaved wagering system by contributing credit to an integrated wagering process interleaved wagering system such as, but not limited to, Cr 1002 that may be credit in a real currency or may be credit in a virtual currency that is not fungible with a real currency, AC 1006 that may be application environment credits, and specified types of interactive application elements and/or objects 1004. One or more of these contributions may be provided directly as currency and/or transferred in electronically. Electronic transfer may come via a smart card, voucher or other portable media, or as transferred in using a communication link from a user data server or integrated wagering process interleaved wagering system user management and session controller. In many embodiments, contributions may be drawn on demand from user accounts located in servers residing on the network or in the cloud on a real time basis as the credits, elements and/or object are committed or consumed by the integrated wagering process interleaved wagering system. Generally, Cr is utilized and accounted for by the wager controller 1010; and the resources 1004 and AC 1006 are utilized and accounted for by the application controller 1012 and/or the interactive controller 1014.

The user interacts (a) with an interactive application provided by the interactive controller 1014 with the interaction representing an action by the user within the context of the interactive application. The interactive controller 1014 receives the data of the user interaction and communicates (b) the interaction to the application controller 1012. The application controller 1012 receives the interaction and determines from the interaction whether or not a wager should be triggered. If a wager should be triggered, the application controller 1012 instructs (c) the wager controller 1010 to execute a wager in accordance with a wagering proposition associated with the interaction and thereby triggers a wager. The wager controller receives the wager execution instructions and executes the wager in accordance with the wagering proposition, and consumes (d) an appropriate amount of Cr 1002 for the wager. The wager controller 1010 adjusts (e) the Cr 1002 based upon a wager outcome of the wager and communicates (f) the wager outcome to the application controller 1012 as to the outcome of the wager triggered by the application controller 1012. The application controller 1012 receives the wager outcome. The application controller determines what resources 1004 should be provided to the interactive controller, generates the resources 1004 and application instructions and instructs (g) the interactive controller 1014 using the resources 1004 and application instructions. The interactive controller receives the resources 1004 and application instructions from the application controller 1012 and integrates them into the execution of the interactive application provided by the interactive controller 1014.

In some embodiments, the application controller 1012 communicates (h) data about the wager outcome to the interactive controller. The interactive controller receives the wager outcome and displays the wager outcome to the user 1008.

In some embodiments, the application controller 1012 determines what resources and instructions to provide to the interactive controller 1014 for use by the interactive application provided by the interactive controller 1014 partially on the basis of the wager outcome. In some such embodiments, resources are provided in a case that the wager was a winning wager for the user. In other such embodiments, fewer or no resources are provided in a case of a losing wager.

In some embodiments, the application controller 1012 determines what resources to provide based on internal logic of the application controller 1012. In some such embodiments, the application controller 1012 employs a random result generator, such as a P/RNG, to generate a random result and the random result is used to determine what resources are provided to the interactive controller 1014.

In several embodiments, the application controller 1012 determines an increment or a decrement of an amount of AC 1006 using the interactions received from the interactive controller. The increment or decremented amount is communicated (i) to the interactive controller for display to the user.

In some embodiments, the application controller 1012 executes a wager of Cr as a virtual currency, AC, elements or objects. In some such embodiments, the application controller 1012 employs a random result generator, such as a P/RNG, to generate a random result and the random result is used to determine a wager outcome in Cr as a virtual currency, AC, elements or objects.

The following is description of an embodiment of the described collaboration where an interactive application provided by an interactive controller of an integrated wagering process interleaved wagering system is a first person shooter game. The process begins by a user selecting a machine gun to use in the game and then fires a burst of bullets at an opponent. The interactive controller can communicate to the application controller of the user's choice of weapon, that a burst of bullets was fired, and/or the outcome of the burst. The application controller communicates to the wager controller that 3 credits (Cr) are to be wagered on the outcome of a wagering event to match the three bullets consumed. The wager controller then performs the wagering event and determines the result of the wager and may determine the winnings from a paytable. The wager controller consumes 3 credits of Cr for the wager and executes the specified wager. By way of example, the wager controller may determine that the user hit a jackpot of 6 credits and returns the 6 credits to the Cr and communicates to the application controller that 3 net credits were won by the user.

The application controller communicates to the interactive controller to add 3 bullets to an ammunition clip. The interactive controller adds 3 bullets back to the ammo clip. The ammunition may be added by directly adding the ammunition to the clip or by allowing the user to find extra ammunition during use. The application controller logs the new user score (AC) in the game (as a function of the successful hit on the opponent) based on the interactive controller communication, and adds 2 extra points to the user score since a jackpot has been won. The application controller then adds 10 points to the user score (AC) given the success of the hit which in this example is worth 8 points, plus the 2 extra point. Note that this example is only intended to provide an illustration of how credits flow in an integrated wagering process interleaved wagering system, but is not intended to be exhaustive and only lists only one of numerous possibilities of how an integrated wagering process interleaved wagering system may be configured to manage its fundamental credits.

In many embodiments, user management and session controller 1020, such as user account controller 150 of FIG. 1A, of an integrated wagering process interleaved wagering system is used to store AC for use of the user. In such an embodiment, AC is generated by the application controller based on the user's use of the integrated wagering process interleaved wagering system and an amount of the AC is communicated to the user management and session controller 1020. The user management and session controller stores the amount of AC between user sessions. In some embodiments, the user management and session controller communicates an amount of AC to the application controller at the start of a user session for use by the user during a user session.

In accordance with many embodiments of the invention, an integrated wagering process interleaved wagering system provides an interactive application and a wagering mechanic. A wide array of interactive applications include explicit random events that are observable to the game's user(s) and often initiated by a user. Random events can include, but are not limited to, the drawing of cards, the rolling of a die, and the use of a spinner. These explicit random events can be singular or multiple, operating in parallel or in serial. For example, Monopoly® provided by Hasbro Inc. of Pawtucket, R.I. is played by each user rolling a pair of dice at the onset of each turn to move a game piece around the board (singular per turn, and serially between users). In Risk® provided by Hasbro Inc. of Pawtucket, R.I., two users roll dice simultaneously to establish the outcome of a battle, and the users continue to roll dice until the battle is resolved (parallel dice rolls occurring multiple times). In Scrabble® provided by Hasbro Inc. of Pawtucket, R.I., a user draws tiles at random from a pool of tiles. In War, users draw randomly ordered cards from a deck of cards and compare those cards each turn. These random events are typically initiated by a user as part of a user's turn and can drive actions such as the movement of a user piece around a board (e.g. Monopoly®), the resolution to a battle between users (e.g. Risk®), establishing whether a character successfully deploys a specific skill (e.g. Dungeons and Dragons®), etc. Although the above examples discussed are board games, the same principle can be applied in computerized versions of these games.

Figure 10:
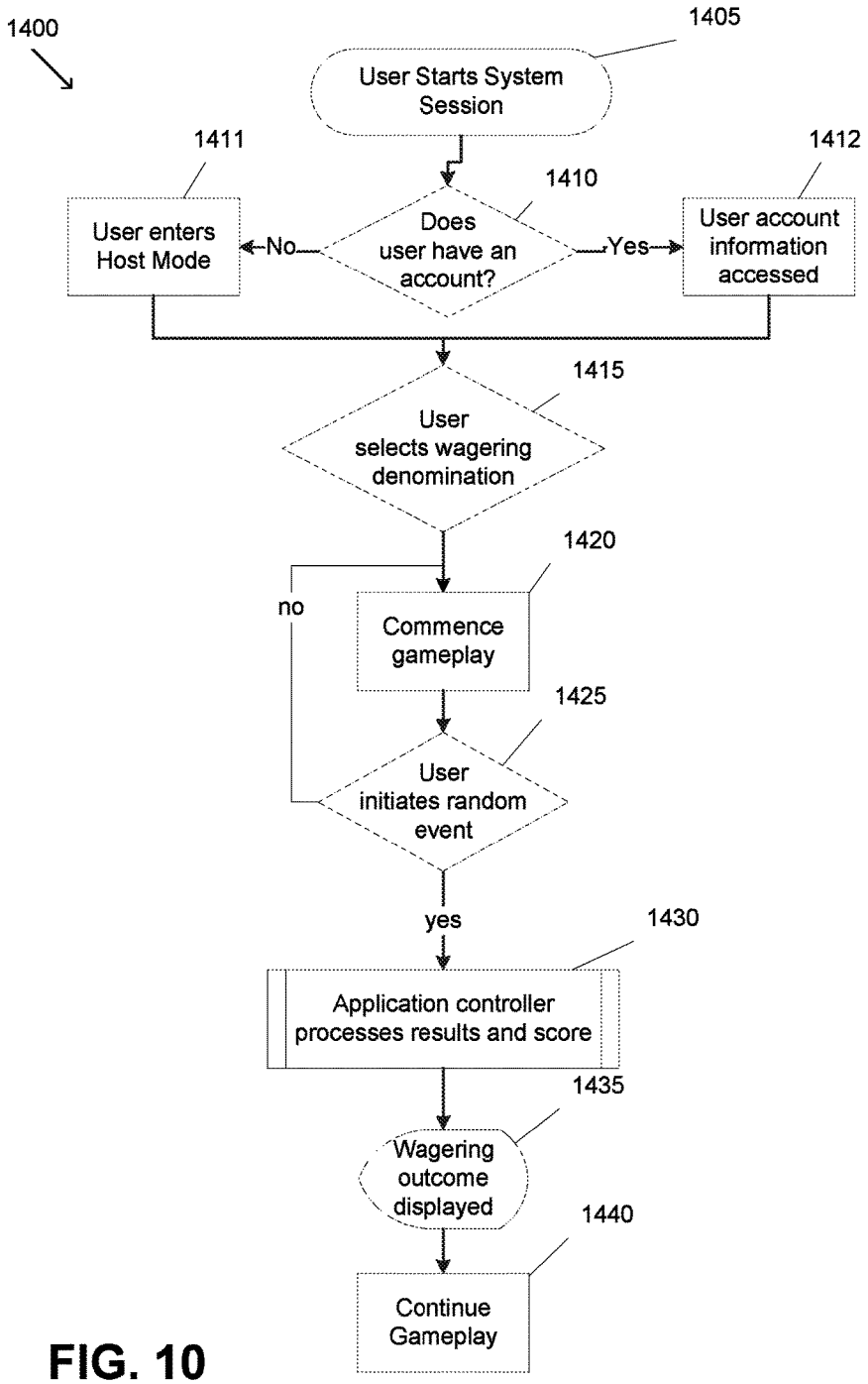
FIG. 10 is a flow diagram of a process for providing an integrated wagering process interleaved wagering system in accordance with embodiments of the invention.

In accordance with several embodiments of the invention, the explicit random events in an interactive application provided by an integrated wagering process interleaved wagering system are harnessed to drive wagering events in a wagering mechanic in concert with the play of the interactive application. An integrated wagering process interleaved wagering system uses the random events inherent in the underlying interactive application as a wagering mechanic where the outcome of a random event or a set of random events in the interactive application is linked to the provisions of awards to a user. Examples of awards in accordance with embodiments of the integrated wagering process interleaved wagering system include, but are not limited to, in-application objects, the alteration of in-application variables, and the allocation of credits to one or more pools being collected by the application operator (e.g., casino). A flow diagram of a process for providing an integrated wagering process interleaved wagering system in accordance with embodiments of the invention is illustrated in FIG. 10.

In process 1400, the user begins interaction with the integrated wagering process interleaved wagering system (1405). Upon starting an interactive application provided by an interactive controller of the integrated wagering process interleaved wagering system, the user selects (1410) between using either a user account to provide Real World Credits (RWC) and/or application credits (AC) for play (1412) or may play a stand-alone or host version (1411) of the interactive application in which RWC and/or AC is entered on a per-play basis. Regardless of the selected type of interactive application play, the user then chooses the denominations or wagering amount to use during interactive application play (1415). The interactive controller then commences providing interaction with the interactive application (1420). During interaction with the interactive application, the user initiates a random event (1425).

The results of the random event are generated and the awards and/or wager results in the wagering mechanic based upon the random event are determined (1430). In some embodiments, the results of the random event are generated by a wager controller, as described herein. The application controller generates wager request instructions. The application controller instructs the wager controller by communicating the wager request instructions to the wager controller.

The wager controller receives the request instructions and determines a wager outcome based on the wager request instructions. Wager outcome data comprising the wager outcome is communicated by the wager controller to the application controller. The application controller scans the wager outcome data to determine the wager outcome.

The application controller generates wager outcome instructions using the wager outcome. The application controller instructs the interactive controller by communicating the wager outcome instructions to the interactive controller. The interactive controller receives the wager outcome instructions.

The results of the wagers and/or awards are provided to the user and displayed as part of the interactive application display (1435). In an example embodiment, an integrated wagering process interleaved wagering system provides a computerized version of a board game wherein the object of the game is to advance around a board, acquiring spaces on the board, and charging rents to other users who land on the acquired spaces, such as in the game of Monopoly®. In the game, a user rolls two 6-sided die each turn. In addition to dictating how far the user moves the user's piece in the interactive application, the dice roll determines which one of the 36 possible permutations (where die 1 and die 2 are called out separately) or 21 permutations (where only sum of the dice is called out) corresponds to a specific monetary payout relative to the credits committed to the wagering mechanic before the dice were "rolled" in an integrated wagering process interleaved wagering system version of the electronic board game. In accordance with some embodiments of an electronic board game integrated wagering process interleaved wagering system, each of the 36 or 21 possible permutations correspond to at least one of a payout to the user, a possible allocation to a bonus pool, the alteration of an in-application variable, a loss of funds by the user, and a gain of funds by the user.

In accordance with some embodiments, the results of wagers and/or awards can include, but are not limited to contribution to a bonus pool that is awarded as a function of subsequent random events; an RC win for the user; an RC loss for the user; an RC draw for the user; a contribution to a bonus pool that is awarded as a function of user skill and/or as a function of a user's performance in one or more instances of the interactive application; a contribution to an interstitial credit, such as Quanta, that the user can use in the current application session and/or over multiple application sessions to alter interactive application variables; a contribution to a specific interactive application variable without user selection or input; and a contribution to a bonus pool that is applied to a subsequent competition or tournament that the user may or may not become eligible to enter based upon factors including, but not limited to, the demonstrated skill of the user in the interactive application, money committed to the wagering mechanic, hours spent playing the game, and user club status.

In accordance with some embodiments, the award and/or wager may be provided in lieu of the random event affecting the interactive application. In an example embodiment, the user may gain the ability to move the user's piece, or one of the above effects may take place in an integrated wagering process interleaved wagering system providing an electronic board game as an interactive application in accordance with an embodiment of the invention. In accordance with the embodiment, the results of the random event may be affected by direct allocation of each possible random outcome to one of the outcomes in a wagering mechanic or a move in the interactive application, as described herein. In an example embodiment, a first die roll of a "2" and a second die roll of a "5" may result in an RC win and no longer provide a move of seven squares in the Monopoly game. In accordance with some embodiments, an addition of an additional random number generating element (a third die for example) is introduced into the interactive application that causes the fundamental random number generating element (the two dice) to be interpreted as either a conventional move in the underlying interactive application, or instead as one of the above effects. In accordance with a number of embodiments, the impact of the underlying explicit random number generating mechanism in the interactive application may be accumulated over multiple occurrences of the explicit random events in the interactive application. In an example embodiment, rather than the outcome of a single roll of the dice by a user during a user turn in an electronic board game employing two six-sided dice which would limit the outcome to one of 36 distinct outcomes, the results of multiple dice rolls accumulated across several turns may be considered at one time so that a greater number of permutations of the result are possible. In the example embodiment, six rolls of the two dice by a single user or the rolls from six user turns may be used to drive the random effect to provide 612 possible outcomes. After the results of the random event are determined and displayed, game play of the interactive application continues (1440).

Although specific processes for providing integrated wagering process interleaved wagering systems with an integrated wagering process interleaved wagering system are discussed above with respect to FIG. 10, any of a variety of processes for providing an integrated wagering process interleaved wagering system can be utilized as appropriate to the requirements of specific applications in accordance with embodiments of this invention.

Figure 11:
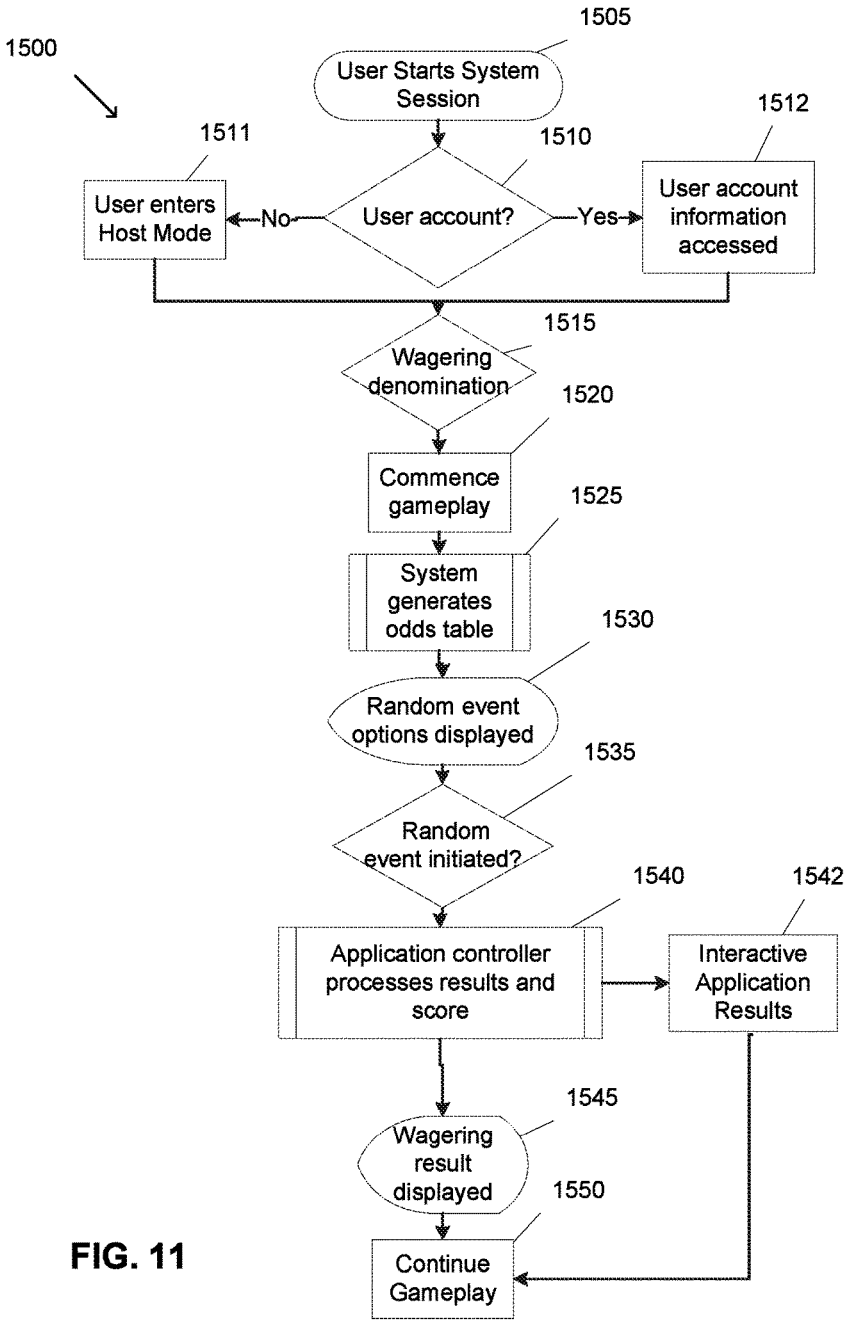
FIG. 11 is a flow diagram of a process for providing an integrated wagering process interleaved wagering system with different odds for a random event in accordance with an embodiment of the invention.

In accordance with some embodiments, the interactive application in an integrated wagering process interleaved wagering system includes different random events that may be initiated at a given time. The results of a wagering event corresponding to the random event may depend on the odds associated the random event initiated. A flow diagram of a process for providing an integrated wagering process interleaved wagering system with different odds for a random event in accordance with an embodiment of the invention is shown in FIG. 11.

In process 1500, the user begins interaction with an interactive application of the integrated wagering process interleaved wagering system (1505), where the interactive application is an interactive game. Upon starting the game, the user selects (1510) between using either a user account to provide Real World Credits (RWC) and/or application credits (AC) for play (1512) or may play a stand-alone or host version (1511) of the game in which RWC and/or AC is entered on a per-play basis. Regardless of the selected type of game play, the user chooses the denominations or wagering amount to use during game play (1515). The interactive controller then provides the game play of the interactive application (1520). The odds for each random event option are then determined for the integrated wagering process interleaved wagering system session (1525) and displayed to the user (1530). In some embodiments, the application controller generates the odds for each random event option. The application controller generates odds instructions and instructs the interactive controller by communicating the odds instructions to the interactive controller. In some embodiments, the wager controller generates the odds for each random event option. The wager controller communicates odds data and communicates the odds data to the application controller. The application controller scans the odds data to determine the odds for each random event option. The application controller generates odds instructions using the odds for each random event option and instructs the interactive controller by communicating the odds instructions to the interactive controller.

During game play, the user initiates a random event from the random event options (1535). The results of the initiated random event are generated and the awards in the wagering mechanic based upon the random event are determined. In some embodiments, the results of the random event are generated by a wager controller, as described herein. The application controller generates wager request instructions. The application controller instructs the wager controller by communicating the wager request instructions to the wager controller.

The wager controller receives the request instructions and determines a wager outcome based on the wager request instructions. Wager outcome data comprising the wager outcome is communicated by the wager controller to the application controller. The application controller scans the wager outcome data to determine the wager outcome.

The application controller generates wager outcome instructions using the wager outcome. The application controller instructs the interactive controller by communicating the wager outcome instructions to the interactive controller. The interactive controller receives the wager outcome instructions.

The results of any wagers and/or rewards are provided to the user and displayed as part of the game play (1540). The results of the random event on game play of the entertainment are determined (1542). The determined outcomes of wagers and/or awards provided to the user based upon the random event are displayed (1545) and game play of the interactive application continues (1540). The determination of the results of the random event is performed in a manner similar to the determination described with reference to FIG. 10.

Although a specific process for providing an integrated wagering process interleaved wagering system is discussed above with respect to FIG. 11, any of a variety of processes for providing an integrated wagering process interleaved wagering system may be utilized as appropriate to the requirements of specific applications in accordance with embodiments of this invention.

Figure 12:
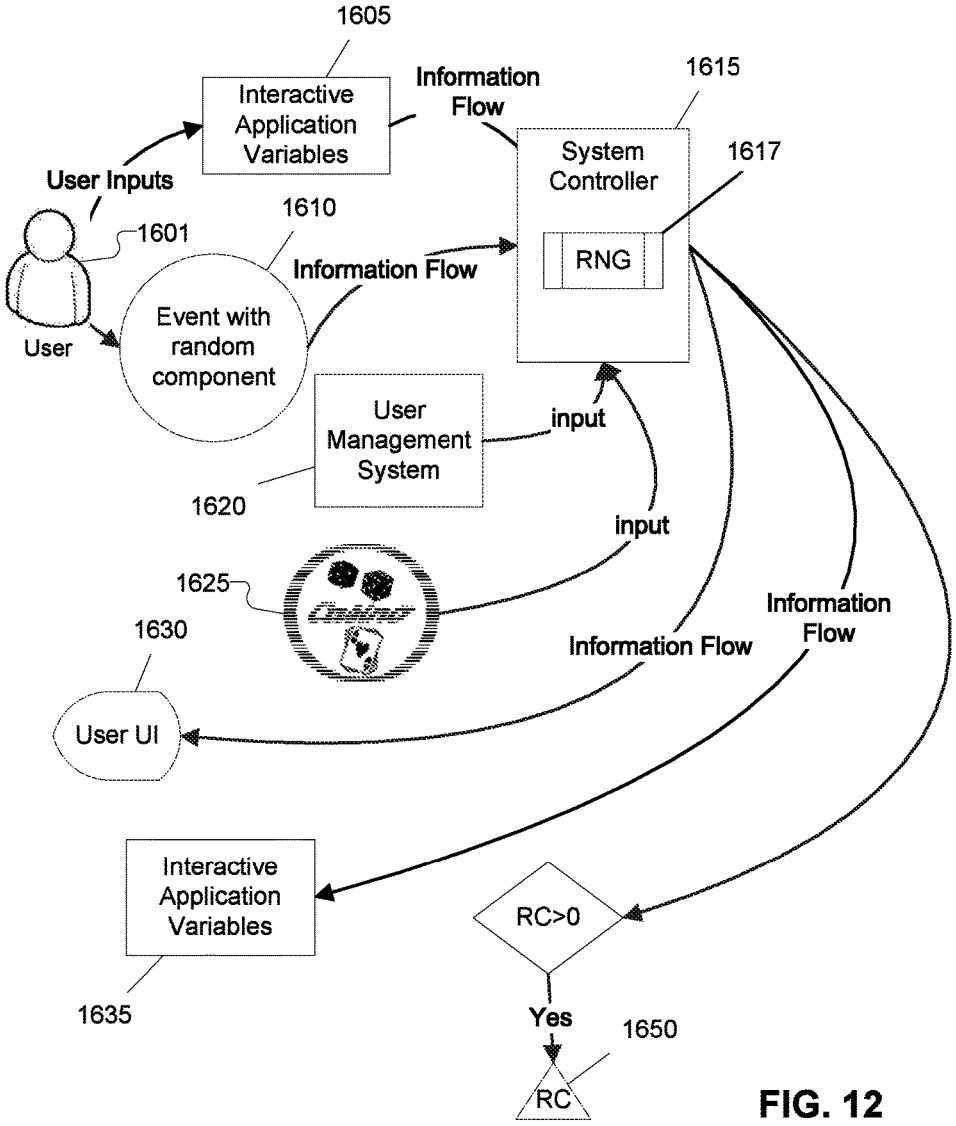
FIG. 12 is a flow diagram showing the passing of information during the provision of an integrated wagering process interleaved wagering system in accordance with embodiments of this invention.

In accordance with many embodiments of the invention, the determination of the payout of a wager and/or award based upon the results of a random event in the interactive application may be influenced by other information. This information includes, but is not limited to, interactive application variables; user information; and casino and/or interactive application provider information. A flow diagram showing the passing of information during the provision of an integrated wagering process interleaved wagering system in accordance with embodiments of this invention is illustrated in FIG. 12.

User 1601 provides user inputs to the interactive application. The inputs cause the interactive application to update interactive application variables 1605 that indicate the state of the interactive application. The user inputs also initiate an event with a random component 1610. Interactive application variables 1605 and information about the event with a random component 1610 are provided to an integrated wagering process interleaved wagering system controller. The integrated wagering process interleaved wagering system controller also receives user information from a user management system 1620 and provider information from a casino and/or a game provider 1615. Random Number Generator (RNG) 1617 can be used to determine the results of the event with a random component 1610 in the interactive application and the wagering mechanic. The interactive application uses the results of the event with a random component to update the interactive application variables 1635 and the user interface 1630. The wagering mechanic uses the results of the event with a random component to determine the results of the wagering event 1645 and any RC 1650 rewarded for wagers based upon the results of the wagering mechanic.

Figure 13:
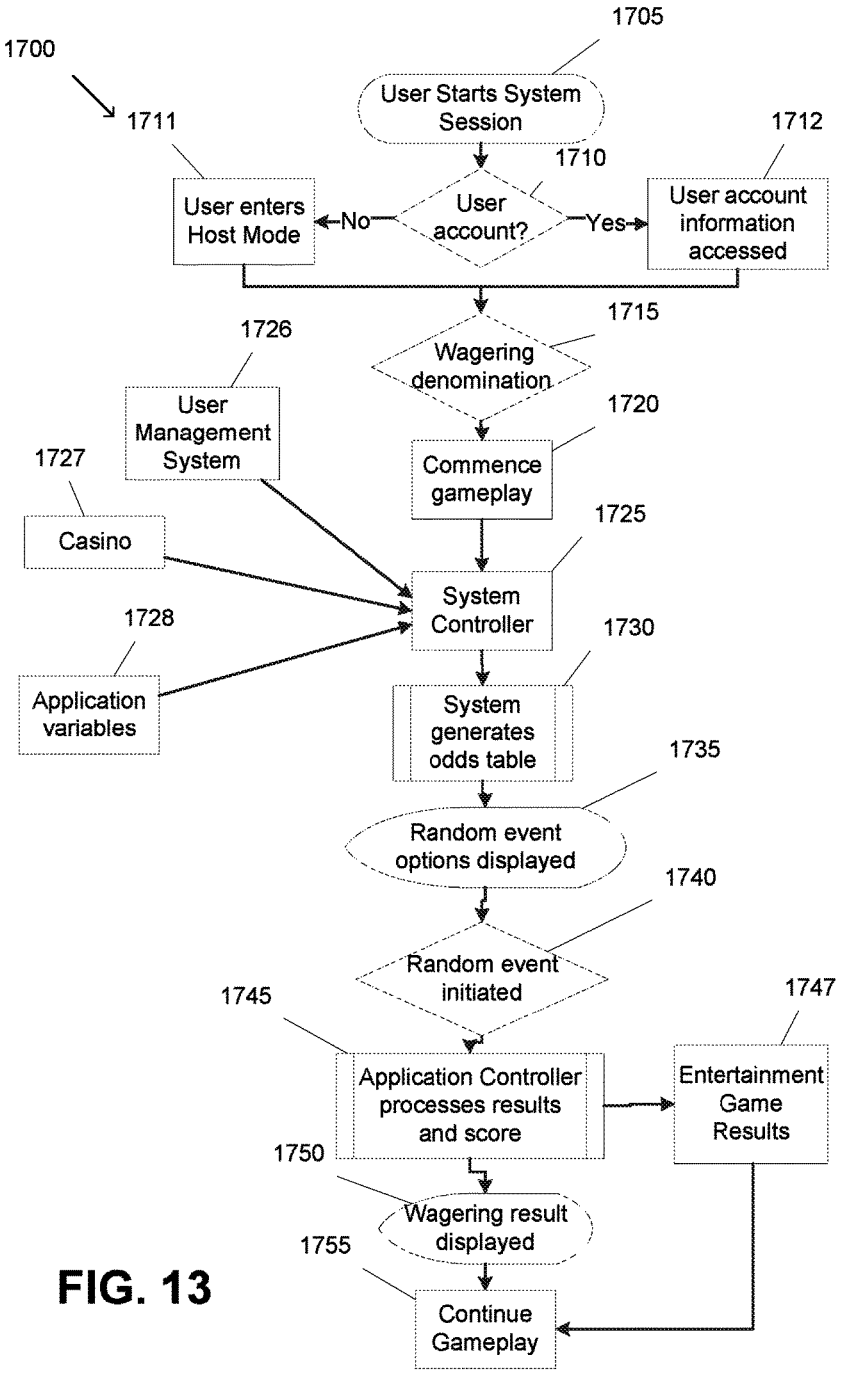
FIG. 13 is a flow diagram of a process for providing an integrated wagering process interleaved wagering system that uses the results of a random event and other information to determine the results of the random event in the interactive application to determine results in a wagering event in a wagering mechanic in accordance with an embodiment of the invention.

A flow diagram of a process for providing an integrated wagering process interleaved wagering system that uses the results of a random event and other information to determine the results of the random event in the interactive application to determine results in a wagering event in a wagering mechanic in accordance with an embodiment of the invention is shown in FIG. 13.

In process 1700, the user begins interaction with an interactive application of the integrated wagering process interleaved wagering system (1705), where the interactive application is an interactive game. Upon starting the game, the user selects (1710) between using either a user account to provide Real World Credits (RWC) and/or application credits (AC) for play (1712) or may play a stand-alone or host version (1711) of the game in which RWC and/or AC is entered on a per-play basis. Regardless of the selected type of game play, the user chooses the denominations or wagering amount to use during game play (1715). The interactive controller then provides the game play of the interactive application (1720).

The integrated wagering process interleaved wagering system controller 1725 receives user information from user management system 1726, interactive application variables 1728 from the interactive controller and provider information from the casino or game provider 1727. The odds for each random event option may then be determined for the integrated wagering process interleaved wagering system using the user information, provider information, interactive application variables, and other interactive application information (1730) and displayed to the user (1735). During game play, the user initiates a random event from the random event options (1740). The results of the initiated random event are determined and the awards in the wagering mechanic based upon the random event, the user information, provider information, and interactive application variables are determined and the results of any wagers and/or rewards are provided to the user and displayed as part of the game play (1745). The results of the random event on game play of the interactive application are determined (1747).

The results of the wagers and/or awards provided to the user based upon the random event are displayed (1750) and game play of the interactive application continues (1755).

Although a specific process for providing an integrated wagering process interleaved wagering system is discussed above with respect to FIG. 13, any of a variety of processes for providing an integrated wagering process interleaved wagering system can be utilized as appropriate to the requirements of specific applications in accordance with embodiments of this invention.

Examples of Integrated Wagering Process Interleaved Wagering Systems

Figure 14:
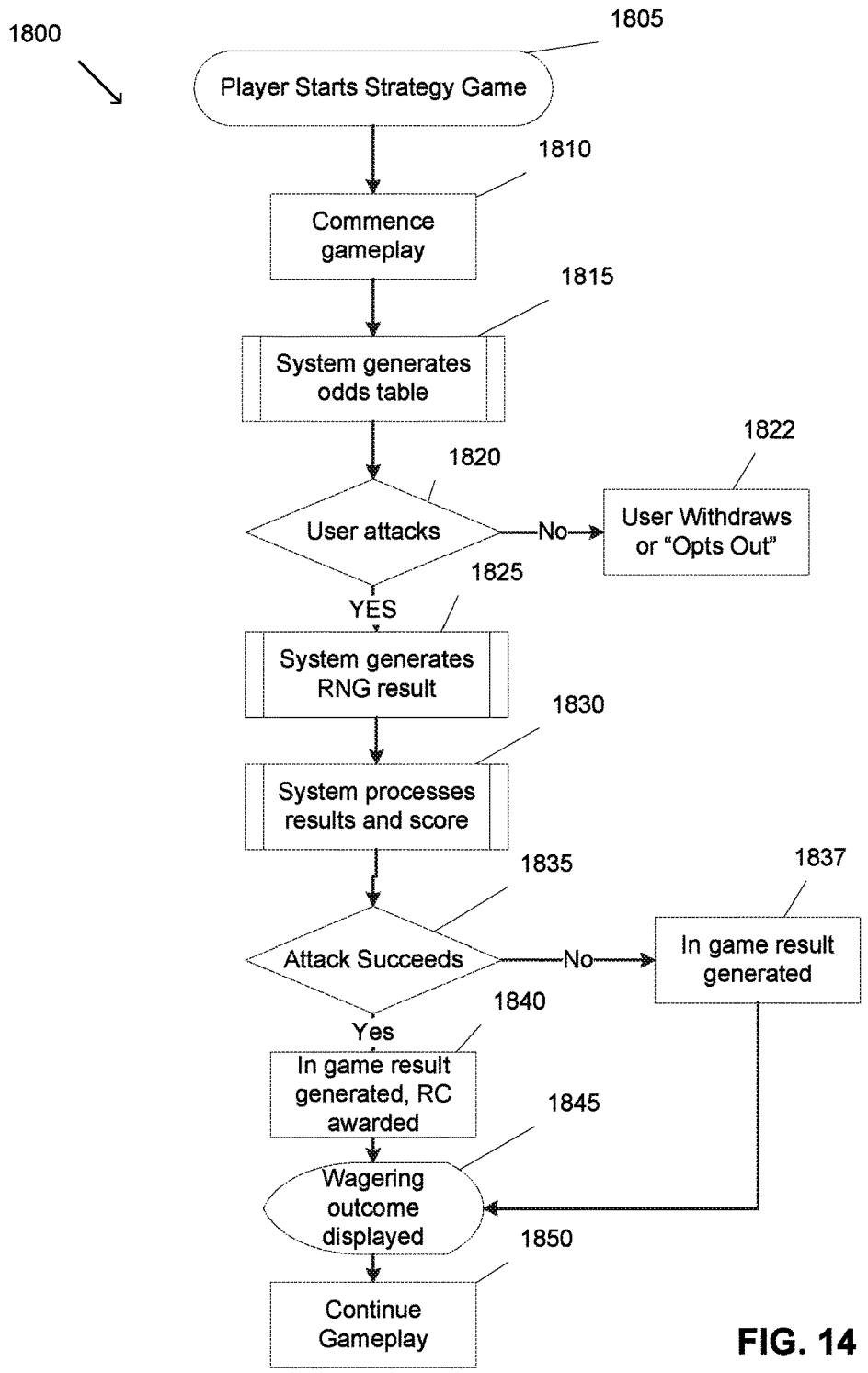
FIG. 14 is a flow diagram of a process for providing an integrated wagering process interleaved wagering system with a strategy-based game as the interactive application.

In accordance with some embodiments of an integrated wagering process interleaved wagering systems with an integrated wagering process interleaved wagering system, the interactive application provided is a strategy-based game. A flow diagram of a process for providing an integrated wagering process interleaved wagering system with a strategy-based game as the interactive application is shown in FIG. 14. In process 1800, the user initiates the strategy-based game (1805). Game play of the strategy-based game commences (1810). As game play proceeds, the integrated wagering process interleaved wagering system generates an odds table for a random event. In some embodiments, a wager controller generates the odds table. In some embodiments, an application controller generates the odds table.

The user then initiates the random event (1820). An example of a random event in the strategy-based game is when a user attacks a country on the game board occupied by a troop of another user. The attack continues until the user wins or withdraws (1822). For each roll of the dice during the attack, the integrated wagering process interleaved wagering system generates a random result using the RNG (1825). The integrated wagering process interleaved wagering system then processes the results of the random event in the wagering mechanic and the results of the random event in the interactive application (1830). If the attack fails (1837), the in-game results are recorded and game play of the interactive application continues (1850). If the attack is successful, the in-game results of the successful attack are recorded and the award and/or results of wagers in the wagering mechanic are determined (1840). The awards and/or results of the wagers are displayed (1845) and game play of the interactive application continues (1850).

Although a specific process for providing an integrated wagering process interleaved wagering system providing a strategy game as the interactive application is discussed above with respect to FIG. 14, any of a variety of processes for providing an integrated wagering process interleaved wagering system can be utilized as appropriate to the requirements of specific applications in accordance with embodiments of this invention.

In accordance with an embodiment of an integrated wagering process interleaved wagering system that provides a strategy game as the interactive application, users engage in battles between groups of armies using one, two or three dice each, depending upon the number of armies each user is using to attack or defend. Over the course of a battle, there can be multiple rolls of the dice until one party is victorious or the attacker withdraws. The set of combinations of dice are known as a function of the number of troops each party uses in the battle. Each party is required in this example to contribute a specific sum of RC to each battle as a function of the number of troops that the party has committed to that battle as a whole in accordance with the embodiment. However, in accordance with other embodiments, RC is committed at a fixed amount per battle regardless of the number of troops committed. In accordance with still other embodiments, the amount of RC committed is a function of the number of dice rolled during each round of a battle. The combination of dice outcomes can be used to drive one or more of the following: a contribution to a pool to be paid to the winner of the specific head-to-head battle; a contribution to a tournament pool to which the users may or may not ultimately gain entry; and a contribution to a pool to be paid to the winner of the specific game. In several embodiments, there is no feedback from the wagering mechanic to the interactive application other than that already inherent in the strategy-based game. In particular, the winner of the battle gains more territory and territory cards and may therefore ultimately receive more armies at the onset of the next turn of the winner. In accordance with other embodiments, one or more of the dice outcomes may cause a user to receive an award. Examples of awards include, but are not limited to additional armies; and special features including, but not limited to, extra attack dice for an attach, better attack odds, and better defending odds.

In another example embodiment, User 1 attacks Japan from Kamchatka with 10 troops. User 2 defends Kamchatka with four troops. Therefore, User 1 is required to commit 10 RC to the battle, and user 2 is required to commit four RC to the battle. The battle proceeds in the manner shown in the following table.

| Battle Round | User 1 Troops at start of round | User 2 Troops at start of round | User 1 Dice Rolls | User 2 Dice Rolls |
|---|---|---|---|---|
| 1 | 10 | 4 | 2, 3, 4 | 3, 6 |
| 2 | 8 | 4 | 4, 4, 5 | 2, 6 |
| 3 | 7 | 3 | 2, 1, 3 | 5, 3 |
| 4 | 5 | 3 | 6, 5, 1 | 4, 5 |
| 5 | 5 | 1 | 3, 4, 2 | 4 |
| 6 | 4 | 1 | 6, 3, 4 | 5 |
| 7 | 4 | 0 | N/A | N/A |

As shown in the table, User 1 takes over the country after six rounds of battle having lost six of his initial troops and User 2 has lost all four of his troops. As a result of the battler the following random effects result in accordance with the embodiment:

A Victory Bonus—User 1 receives a credit back from her commitment as a function of having won the battle. 1 credit returned to user 1;

A Strong Defender Bonus—User 2 receives a credit back from his commitment as a function of having lost fewer troops than user 1. One credit to user 2; and Game Victory Pool—1 credit from the attacking user (User 1) is committed to a pool at the onset of the battle that will be awarded to the ultimate winner of the strategy-based game.

The wagering outcome for User 1 in the example is determined in the following manner. 8 RC from User 1 are committed to the random outcome that is ultimately determined by the numerical sequence {2,3,4,4,4,5,2,1,3,6,5,1,3,4,2,6,3,4}. The numerical sequence is looked up in a table that can be dynamically generated at the onset of the battle. The table reflects all the possible outcomes of the engagement (including either user withdrawing before being defeated) with regards to rolls of User 1. Prizes are allocated to each possible numerical combination in the table as a function of a prescribed distribution of outcomes dictated by the game. The prizes may be RC; in-game variables; in-game objects; or other items of value in accordance with the embodiment. The outcome of the process may be represented to User 1 graphically through a variety of means including, but not limited to, a graphical representation of a slot machine or other wagering mechanic. In the specific example, User 1 loses the wagering mechanic and is not awarded any RC.

The wagering outcome for User 2 is determined in the following manner. 3 RC from User 2 are committed to the random outcome that is ultimately determined by the numerical sequence {3,6,2,6,5,3,4,5,4,5}. The numerical sequence is looked up in a table that can be dynamically generated at the onset of the battle, and which reflects all the possible outcomes of that engagement (including User 2 withdrawing before being conquered) with regards to the rolls of User 2. Prizes are allocated to each possible numerical combination in the table as a function of a prescribed distribution of outcomes dictated by the game. The prizes may be RC; in-game variables; in-game objects; or other items of value in accordance with the embodiment. The outcome of this process may be represented to User 2 graphically through a variety of means including, but not limited to, a graphical representation of a slot machine or other wagering mechanic. In this specific example, User 2 wins the wagering mechanic and is awarded 10 RC.

In aggregate, User 1 loses 9 RCs net as a result of the battle and User 2 gains 7 RCs. Further, 1 RC is allocated to a pool for the ultimate winner of the strategy-based game.

In accordance with another embodiment of an integrated wagering process interleaved wagering system and providing a strategy-based game as the interactive application, an attack by User 1 on a country protected by User 2 is performed in the following manner. When User 1 attacks User 2 with a given number of troops on each side, the probability of User 1 winning is at a known maximum. The probability can be less in so far as User 1 may withdraw without completing the battle. However, maximum probability of User 1 winning is known, and more specifically, the likelihood of User 1 winning with N troops remaining is known. A following table can be constructed and shown to User 1 before (or after) troops are committed to the battle given the number of troops that User 1 and User 2 each have committed to the battle (ten and four, respectively). The following table shows the odd of User 1 winning with N troops remaining.

| N | Percentage Odds of Winning with N troops remaining |
|---|---|
| 10 | 0.04% |
| 9 | 0.4% |
| 8 | 6% |
| 7 | 12% |
| 6 | 14% |
| 5 | 18% |
| 4 | 21% |
| 3 | 15% |
| 2 | 14% |
| 1 | 5% |

The above percentages are for exemplary purposes only and do not add to 100% because there is also the prospect of the User 1 losing the battle. The following table adds a third column and an additional data point (the case of withdrawal or loss) to the above table to show User 1 the credits awarded for a 10 credit bet based on the outcome of the battle. This table will be generated by the game logic with input from the casino, regulator, and/or other providers to reflect the desired wagering performance/volatility of the game. In accordance with this embodiment, only the attacking party will have a wagering mechanic initiated as a function of committing troops to the battle. However, it is possible to provide a similar wagering mechanic to the defending party using a similar process in accordance with some embodiments. Furthermore, the percentage odds in the second column could be represented to the user as odds as opposed to percentages in accordance with some embodiments. For example, the table could show "1-in-500" instead of "0.2%".

| N | Percentage Odds of Winning with N troops remaining | Payout on10 committed credits |
|---|---|---|
| 10 | 0.2% | 1000 |
| 9 | 4% | 250 |
| 8 | 12% | 100 |
| 7 | 11% | 11 |
| 6 | 10% | 10 |
| 5 | 7% | 8 |
| 4 | 5% | 1 |
| 3 | 5% | 0 |
| 2 | 4% | 0 |
| 1 | 3% | 0 |
| LOSS OR WITHDRAWAL | 36.8% | 0 |

In the above table, the percentages are for exemplary purposes only.

User 1 commits to the battle after looking at the above table and the battle plays out in step-wise fashion where the attacker decides whether to continue or withdraw after each roll. In accordance with the embodiment, the attacker's funds are committed, and withdrawal at any time leads to a complete loss of the committed funds. However, the game may provide the user with an "opt out" after each round where the user would lose some but not all of the committed credits in accordance with some embodiments. For example, User 1 may want to "opt out" after a single round of the battle in response to a roll of the three die that led to the loss two troops. User 1 may "opt out" at the cost of 5 RC, or some other substantial penalty.

Once the battle is complete, User 1 is paid out according to the above table. As in the previous embodiment, a portion of the funds committed by the user may also be allocated to a number of different pools. In an example embodiment, a single credit may be allocated to a pool to be awarded to the overarching winner of the strategy-based game in accordance with the embodiment. Another credit may be awarded to the defender for winning the battle in accordance with the embodiment. If the defender wins the battle, the credit, as with all, may be allocated from an overarching pool as controlled by the game and/or casino; or may be directly shifted from User 1 to User 2 depending on the embodiment. Another credit may be allocated to a tournament pool in accordance with the embodiment. Allocations of credits played in a bonus round that relates to skill and/or wagering (e.g., chance) may also be made in accordance with some embodiments. Each type of allocation the funds can be drawn directly from user contributions or an overarching marketing pool that is not explicitly tied to the flow of credits during a given game session.

After User 1 is paid out according to the above table, play continues as before. In accordance with this example, game play continues by User 1 continuing the turn until complete. User 2 then drafts armies, places the armies on the board, attacks adjacent enemy territories (and wagers) as desired, and then moves troops before ending his turn. The process is repeated for each user (including computer driven users) in the game until the game is completed.

In accordance with another embodiment of an integrated wagering process interleaved wagering system having a strategy-based game as the interactive application, the strategy-based game may be implemented in an integrated wagering process interleaved wagering system context where the aforementioned table operates not in context of a payout for a specific battle victory scenario (e.g., a win with 7 troops remaining) but to pay out as a function of winning with at least X troops remaining. This may be simpler to convey to the user. The table for determining payouts is shown in the following table where the percentages herein are exemplary only and not meant to be representative of the actual odds associated with the outcomes in a strategy-based game.

| User 1 Battle Outcome | Percentage Odds | Payout on10 committed credits |
|---|---|---|
| Win with 10 troops remaining | 0.2% | 1000 |
| Win with 6+ troops remaining | 35% | 15 |
| Win with 6 > x > 3 troops remaining | 15% | 12 |
| Win with 3 or fewer troops remaining | 10% | 5 |
| Lose or withdraw | | 0 |

One skilled in the art will recognize that the user need not be exposed to the odds explicitly when showing the possible payouts.

In accordance with still another embodiment of an integrated wagering process interleaved wagering system having a strategy-based game as the interactive application, a given battle consists of a number of rounds, or "attacks" made by the attacking user. For each attack, the attacking user can claw back a portion of a wager committed to the wagering mechanic. The claw back is paid only if the user wins (or in some implementations wins or draws) the attack round and the user is paid as a function of the # of troops attacked relative to the # of troops defending as shown in the following general equation.

Claw Back per Attack Round=$f$(# of troops attacking,# of troops defending)

The following is an example of a specific claw back formula for game play in accordance with the embodiment:

$$A = \#\text{ of troops attacking}$$

$$D = \#\text{ of troops defending}$$

$$W = RC\ (\text{or } VC)\text{ commited to gambling game}$$

$$\text{Claw Back per Attack Round} = C * W * \left(\frac{D}{A}\right) \text{ where } D < A$$

$$\text{Claw Back per Attack Round} = C * W * \left(\frac{A}{D}\right) \text{ where } D > A$$

Where C is defined as $$C = 0.1 * \left(\frac{1}{n}\right)$$

$$n = \text{attack round in the given battle (i.e. 1, 2, 3, etc.)}$$

In accordance with some embodiments, the claw back process can be limited by the game logic and/or the casino to persist only for a maximum of n rounds (e.g. 10). The above is a single example, and it is possible to construct any other manner of formulaic approach, including approaches that increase the claw back with each ongoing attack round, rather than decreasing it.

Beyond the claw back process, a payout to a user winning the battle is established as a function of the # of die "rolled" during the battle at the end of the battle in accordance with a number of embodiments. A series of tiers may be set as a function of the number of die rolled and prizes are allocated to each tier in accordance with some embodiments. A table dictating the prizes for each tier is used to establish the payout in accordance with many of the embodiments. The prizes can vary as a function of the ultimate performance of the die rolls relative to a given table. The prizes may also vary from table to table to account for the number of die rolls in a battle. For example, a table for a battle that entailed 5 die rolls for the attacker would likely have a much lower maximum payout than a table that reflected a battle that entailed 20 die rolls.

An example of tables in accordance with an embodiment of the invention that account for the different amount of die rolls in a battle is given below. The payouts are different because of the amount of RC committed is based on the number of die rolled during the battle in accordance with the embodiment. Each die roll result (e.g. a 1, 2, 3, 4, 5 or 6) of a user is added together to ascertain a user's score. The score is then cross-referenced against a table to establish a payout based on the number of die rolls by the user. The first table shows a table for 20 die rolls in accordance with embodiments of the invention.

| Dice Roll Score for 20 Rolls | Payout on 20 committed credits |
|---|---|
| 110 <= X | 5,000 |
| 100 <= X < 110 | 2,000 |
| 80 <= X < 100 | 100 |
| X = 20 | 20,000 |
| X < 80, X ≠ 20 | 0 |
| Lose or withdraw | NIL |

The following table is for a battle that only entailed 5 dice rolls. The payouts are less than payouts on the first table because the odds associated with the various outcomes are much greater than in the 20 die case.

| Dice Roll Score for 5 Rolls | Payout on 5 committed credits |
|---|---|
| 27 < X | 500 |
| 25 <= X <= 27 | 100 |
| 20 <= X < 25 | 10 |
| X = 5 | 1000 |
| X < 20, X ≠ 5 | 0 |
| Lose or withdraw | NIL |

In addition to the wagering mechanisms in an integrated wagering process interleaved wagering system described for the above embodiments, AC may be accumulated as a function of battles won in accordance with some embodiments. In many embodiments, any battle won would generate the same amount of AC. In accordance with many embodiments, the payout of AC is a function of the ratio of the number of initial troops of the winner of the battle relative to number of initial troops of the loser. AC may also be awarded to a user losing a battle if the user's performance in the battle was "heroic" in accordance with a number of embodiments. In an example embodiment, the user destroyed 20 attacking troops before losing the 3 defending troops. The amount of AC and/or the user's ultimate status at the end of the game (1st place, 2nd, etc.) may dictate in whole or in part the awarding of a fixed or variable cash prize and/or count towards entry into a tournament (e.g., a user may need a fixed amount of AC accumulated through the strategy-based game play to gain entry) in accordance with some embodiments of the invention. Other variables also introduced by the casino could also affect the prize in accordance with a number of embodiments.

In some embodiments, a sequence of random events (such as dice rolls) in a portion of an interactive application are provided for, and a wagering outcome (such as a payout) is generated as an accumulated result of those random events. In many such embodiments for electronic strategy-based games, a battle may consist of a number of different skirmishes. Each skirmish requires the rolling of dice (random events in the interactive application) and the generation of an RNG result (random outcome in the wagering mechanic.) At the end of each skirmish, the integrated wagering process interleaved wagering system may provide updated odds tables for the battle. Lower odds of winning in the interactive application may be offset by higher possible payouts in a higher-volatility wager.

In some additional embodiments, a user may stake an ante on the battle. Leaving the battle after a skirmish may require the forfeiting of that ante.

In some embodiments, a battle may consist of a number of different skirmishes, the total sequence of serial dice rolls (the random events in the interactive application) may be used to generate the RNG for the integrated wagering process interleaved wagering system.

Figure 15:
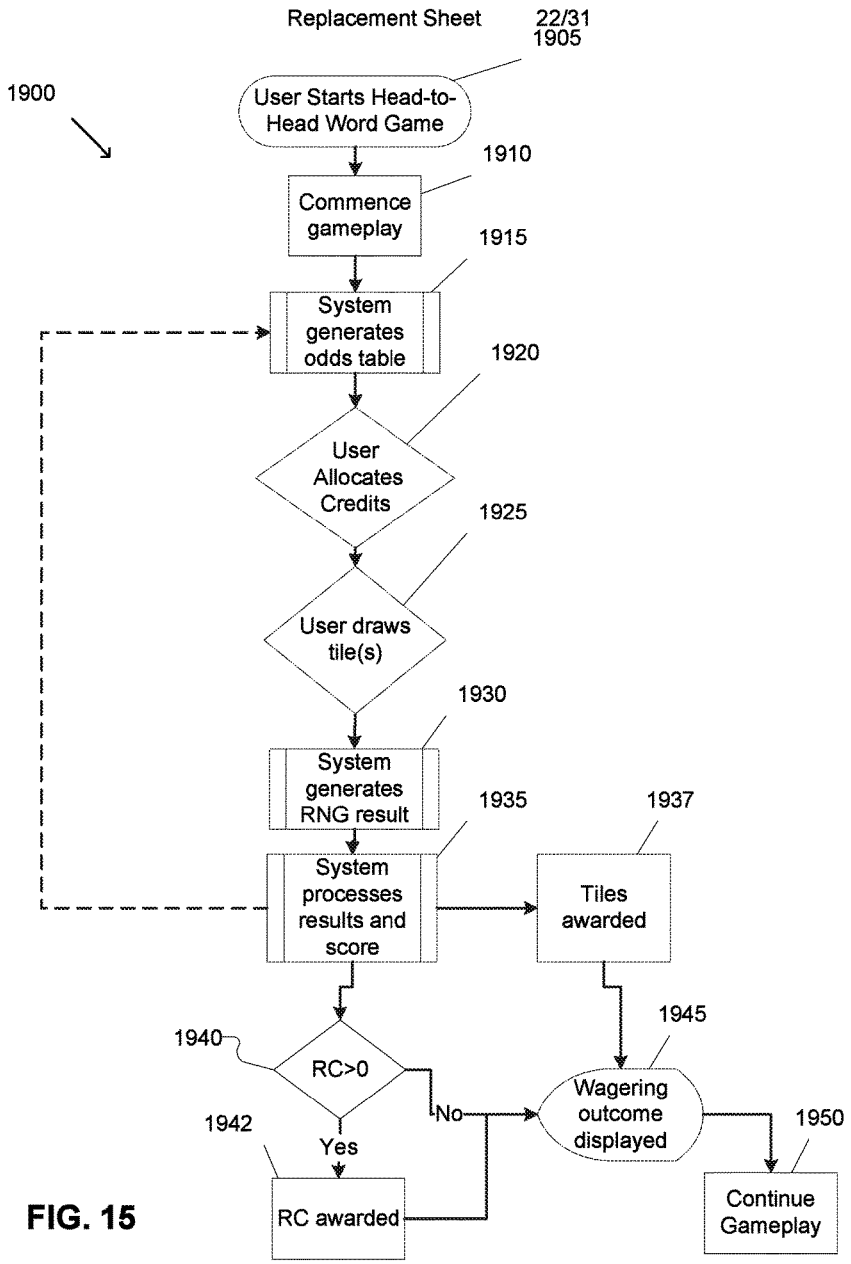
FIG. 15 is a process for providing integrated wagering process interleaved wagering system game based upon a word game in accordance with embodiments of the invention.

Another example of an integrated wagering process interleaved wagering system in accordance with embodiments of this invention provides a word game as an interactive application. In a word game, a user randomly selects tiles of letters from a pool of tiles and attempts to place words on a game board using the selected tiles. An example of a word game is Scrabble®. The integrated wagering process interleaved wagering system drives wagering events based upon the random nature of receiving tiles from the pool. At the time the tiles are selected, the odds associated with pulling any specific combination of letters from the pool are known. As such, wagering propositions can be offered to the user each time that the user selects tiles from the pool as part of the overarching game play. As with any integrated wagering process interleaved wagering system game, the user can be offered a prescribed wagering mechanic, and/or have the option to choose from one or more wagering mechanics in accordance with embodiments of the invention. A process for providing integrated wagering process interleaved wagering system game based upon a word game in accordance with embodiments of the invention is shown in FIG. 15.

In process 1900, the user initiates the integrated wagering process interleaved wagering system with a word game as the interactive application (1905). Game play of the word game commences (1910). At the beginning of a user's turn, the integrated wagering process interleaved wagering system generates odds tables for pulling a specific combination of letters (1915). The user then allocates wagers to a bet on one or more of the specific combinations of letters. The user then receives the tiles with letters from the pool of tile (1925) based upon the results of RNG provided by the integrated wagering process interleaved wagering system (1930). The integrated wagering process interleaved wagering system then processes the results of the tiles received (1937) by the user and resolves any wagers and/or awards based upon the tiles received (1940). Depending on the results, the process may be repeated to provide other wagers and/or random events. The results of the wager (1940) and any RC won based wagers (1942) are then displayed to the user (1945) and game play continues (1950).

Although a specific process for providing an integrated wagering process interleaved wagering system providing a word game as the interactive application is discussed above with respect to FIG. 15, any of a variety of processes for providing an integrated wagering process interleaved wagering system can be utilized as appropriate to the requirements of specific applications in accordance with embodiments of this invention.

In an example embodiment, a user turn may occur as follows. A user receives three tiles from the pool to replace tiles used to form a word on the game board. To obtain the tiles, user commits three RC to one or more wagering mechanics based upon previous decisions by the user in the context of casino provided choices. The integrated wagering process interleaved wagering system offers the user a high volatility, a mild volatility and a low volatility proposition as follows: a high volatility proposition is "Draw A-A-A and win 2000 credits per credit bet"; a medium volatility proposition is "Draw two vowels and win 2 credits per credit bet"; and a low volatility proposition is "Draw three consonants and win 10 credits per credit bet".

The user can allocate the three credits in any of the following manners: one of the three credits to each of the above propositions; two credits to one proposition and the third credit to a second proposition; or all three credits to a single proposition. In accordance with a number of embodiments, the game shows the user the odds associated with each available bet. In accordance with many embodiments, the user may not be provided choices. Instead, the user is provided a pre-structured table of potential outcomes such as the following table. In accordance with some embodiments, the percentage odds can be constructed given the number of tiles that need to be drawn, and the tiles remaining in the bag with blank tiles considered as wild cards. The user may or may not be shown the column "Percentage Odds of Drawing this Tile Set" depending on the embodiment.

| Tiles Pulled (order is significant) | Percentage Odds of Drawing this Tile Set | Payout on 3 committed credits |
|---|---|---|
| A-A-A | 0.1% | 250 |
| Two vowels and one consonant | 36% | 3 |
| Three consonants | 12% | 4 |
| Three vowels | 12% | 4 |
| C-O-W | 0.005% | 3,000 |
| D-O-G | 0.003% | 10,000 |
| Three vowels | 12% | 4 |
| All others | 17% | 0 |

One skilled in the art will recognize that the above percentages are for illustrative purposes only and the exact percentages can change as game play proceeds. During each turn, the user will see a new set of payout possibilities immediately before drawing tiles from the bag. In accordance with some embodiments, display of the table may be initiated by the user using a button; an on-screen control;

and/or some other mechanism. In general, the integrated wagering process interleaved wagering system can structure the payouts and select the winning options to provide the same overarching expected payout per wagering mechanic in accordance with many embodiments. In a number of embodiments, the volatility can vary from the onset of the game towards the end of the game. During game play of certain games, such as "Words With Friends", the number of tiles in the bag diminishes as the game progresses causing the range of outcomes to narrow. As a result, it may not be possible to provide an equivalent distribution of outcomes or volatility as when the game commenced.

In accordance with some embodiments of an integrated wagering process interleaved wagering system providing a word game as the interactive application, or any integrated wagering process interleaved wagering system, it is also possible to offer wagering propositions that span multiple turns of the same user or multiple turns inclusive of more than one user. Because of the dependencies across user turns, and the fact that it is unknown how many tiles will be drawn in subsequent turns, this specific aspect may not be applicable in Words with Friends. However, spanning wagering propositions across multiple turns may be practical in other interactive applications where the explicit random elements are consistent from turn to turn. For example, in the game of LIFE®, the user spins the same spinner each turn, generating a random number between 1 and 10.

Other Features of an Integrated Wagering Process Interleaved Wagering System

In accordance with some embodiments, tournament entry for play of an integrated wagering process interleaved wagering system can be governed by overall AC won, such that integrated wagering process interleaved wagering system games can each have a schema for awarding points for a user's in-game performance. Tournament entry can also be governed by a user's skill rating such that bands of skill can be established and users are given access to enter tournaments as a function of their demonstrated skill in accordance with a number of embodiments. Other requirements, such as number of games played, funds committed to games, a user's status vis-à-vis a casino's user's club, etc. can all impact eligibility to enter a tournament where the tournaments being be either for playing integrated wagering process interleaved wagering system game, or for playing the underlying interactive application without the integrated wagering process interleaved wagering system component. Skill ratings can be established using a number of systems, including ELO or modified ELO systems that account for the wagering outcomes experienced by the user to various extents.

In accordance with some embodiments, head-to-head betting is also available in an integrated wagering process interleaved wagering system game. Odds can be set as a function of a user's skill rating, experience, or other factors. In accordance with a number of embodiments, users can set their own bet structures as a function of their knowledge about one another, and/or the subject of the bet (e.g., outright win vs. a specific in-game achievement, etc.).

Provision of an Integrated Wagering Process Interleaved Wagering System

Figure 16:
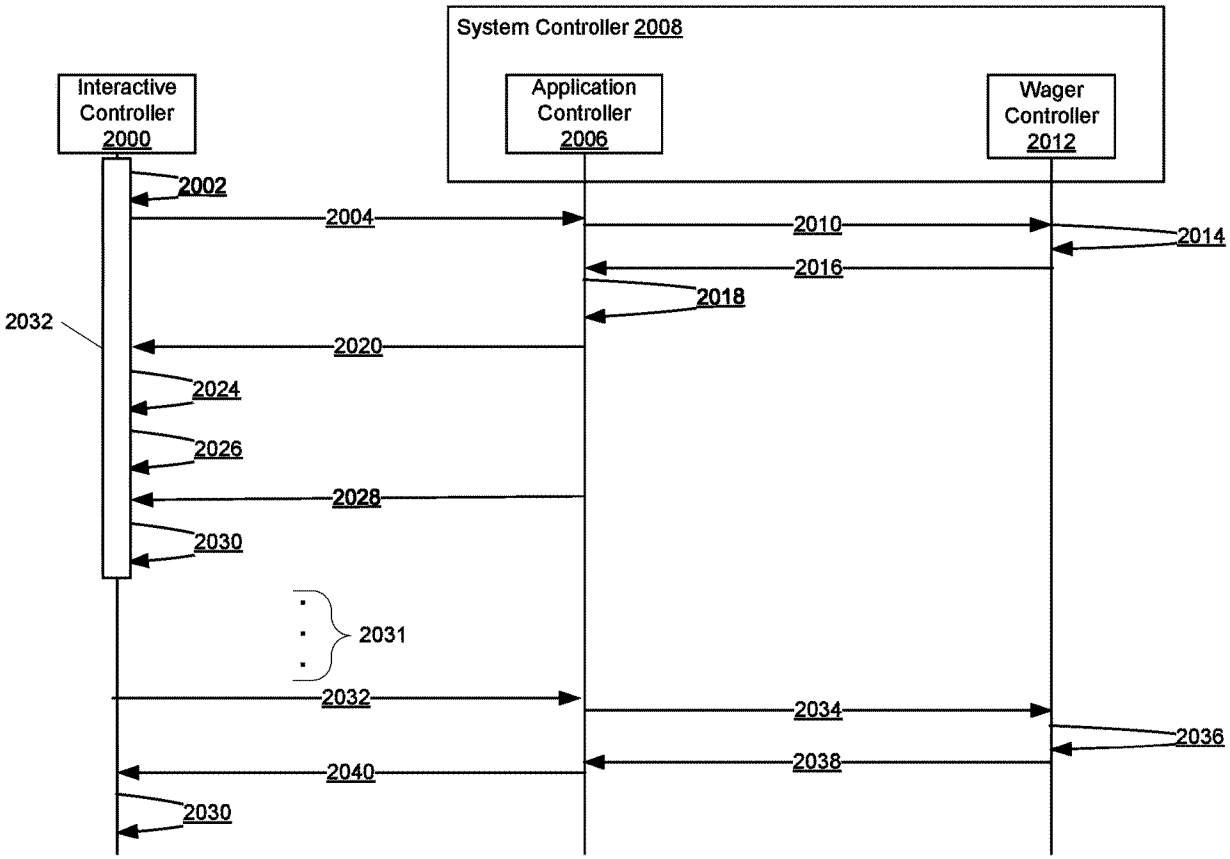
FIG. 16 is a sequence diagram showing the processes performed by the interactive controller, application controller, and wager controller and the communications between these components to provide an integrated wagering process interleaved wagering system in accordance with an embodiment of this invention.

In accordance with several embodiments of this invention, the interactive controller, application controller, and wager controller of an integrated wagering process interleaved wagering system provides an integrated wagering process interleaved wagering system. A sequence diagram showing the processes performed by the interactive controller, application controller, and wager controller and the communications between these components to provide an integrated wagering process interleaved wagering system in accordance with an embodiment of this invention is illustrated in FIG. 16. The interactive controller 2000 provides an interactive application in which random events are utilized to implement the game rules of an interactive application.

During the play of the interactive application 2002, application telemetry data 2004 is communicated by the interactive controller to an application controller 2006 that is included in an integrated wagering process interleaved wagering system controller 2008. In some embodiments, the application telemetry 2004 includes events occurring in the interactive application. In some embodiments, when the interactive application is an interactive game, the application telemetry 2004 includes game events.

In some embodiments, the application telemetry follows an application telemetry protocol. In some embodiments, the application telemetry protocol comprises an identification of the user. In some embodiments, the application telemetry protocol comprises an identification of the interactive application. In some embodiments, the application telemetry protocol comprises an event that has occurred in the interactive application. In some embodiments, the application telemetry protocol comprises an indication to trigger a wager. In some embodiments, the application telemetry protocol is an array of the elements making up the application telemetry. In some embodiments, the application telemetry protocol is a concatenation of the elements making up the application telemetry.

The application controller 2006 receives, from the interactive controller 2000, the application telemetry. The application controller 2006 scans the application telemetry to determine an occurrence of one or more random events within the interactive application of the interactive controller 2000 and that a resolution to the one or more random events is needed by the interactive controller 2000 for the interactive application. In addition, the application controller 2006 determines if the application telemetry indicates an occurrence of one or more wagering events and that a wager or wagers should be initiated in accordance with a wagering proposition of a wagering mechanic. The application controller 2006 generates random outcome request instructions using the application telemetry. The application controller 2006 instructs the wager controller 2012 by communicating the random outcome request instructions 2010 to the wager controller 2012.

The wager controller 2012 receives the random outcome request instructions and determines 2014 data of a sequence of one or more random outcomes, based on the wager request instructions 2016. The sequence of one or more random outcomes can be used to resolve the one or more random events in the interactive application. In addition, the sequence of one or more random outcomes can also be used to determine a resolution to the one or more wagering events. In some embodiments, resolution to the occurrence of the at least one wagering event also includes a complete resolution to one or more wagering events, such as payouts or the like computed using a pay table that is a result of a wager in accordance with the wagering proposition involving real or virtual credits.

Random outcome data comprising the sequence of at least one random outcome is communicated by the wager controller 2012 to the application controller 2006. The application controller 2006 scans the random outcome data to determine the sequence of at least one random outcome. The application controller 2006 uses the sequence of at least one random outcome to resolve 2018 the occurrence of the one or random events for the interactive controller 2000.

The application controller 2006 generates resolution instructions using the resolution to the occurrence of the one or more random events for the interactive controller 2000. The application controller 2006 instructs the interactive controller 2000 by communicating the resolution instructions 2020 to the interactive controller 2000.

In some embodiments, the resolution instructions follow a resolution instructions protocol. In some embodiments, the resolution instructions protocol comprises the identification of the user. In some embodiments, the resolution instructions protocol comprises the identification of the interactive application. In some embodiments, the resolution instructions protocol comprises the resolution to the occurrence of the one or more random events. In some embodiments, the resolution instructions protocol is an array of the elements making up the resolution instructions. In some embodiments, the resolution instructions protocol is a concatenation of the data of elements making up the resolution instructions.

The interactive controller 2000 receives the resolution instructions from the application controller 2006 and integrates 2024 the resolution within the interactive application. The resolution to the one or more random events and/or the integration of the resolution to the one or more random events is also displayed 2026 to the user.

The application controller 2006 generates wager outcome instructions using the resolution to the occurrence of the at least one wagering event. The application controller 2006 instructs the interactive controller 2000 by communicating the wager outcome instructions 2028 to the interactive controller 2000. In some embodiments, the wager outcome data follows a wager outcome protocol. In some embodiments, the wager outcome protocol comprises the identification of the user. In some embodiments, the wager outcome protocol comprises the identification of the interactive application. In some embodiments, the wager outcome protocol comprises the wager outcome amount. In some embodiments, the wager outcome protocol comprises a credit type. In some embodiments, the wager outcome protocol is an array of the elements making up the wager outcome data. In some embodiments, the wager outcome protocol is a concatenation of the elements making up the wager outcome data. The interactive controller 2000 receives the wager outcome instructions and displays 2030 the wager outcome to the user within the context of the interactive application.

In some embodiments, the application controller 2006 does not resolve the one or more random events for the interactive controller 2000. Instead, the application controller 2006 communicates the wager outcome data directly to the interactive controller 2000 and the interactive controller 2000 generates the resolution to the one or more random events.

In some embodiments, the application controller 2006 determines random outcome information for the resolution to the occurrence of the one or more random events while the wager controller 2012 determines random outcome information for the resolution to the occurrence of the one or more wagering events.

In some embodiments, an accumulation of a sequence of random outcomes is used to resolve an occurrence of a wagering event while intermediate random outcomes of the sequence of random outcomes are used to resolve occurrences of one or more random events in the interactive application. In many of these embodiments, the wager controller 2012 caches the intermediate random outcomes of the sequence of random outcomes until the sequence of random outcomes is complete enough that the sequence of random outcomes can be utilized to resolve the occurrence of the wagering event by generating a wagering outcome. In some embodiments, the application controller 2006 caches the intermediate random outcomes of the sequence of random outcomes until the sequence of random outcomes is complete enough that the sequence of random outcomes can be utilized to resolve the occurrence of the wagering event and determine a wagering outcome. In many embodiments, the application controller requests an entire sequence of random outcomes sufficient to resolve an occurrence of a wagering event, and then determines resolutions of occurrences of one or more random events in the interactive application as the random events occur in the interactive application. Once enough random events have occurred corresponding to the random outcomes that were used to determine the resolution to the wagering event, the resolution to the occurrence of the wagering event is communicated to the interactive controller for display to the user.

In some embodiments, the sequence of one or more random outcomes are used to resolve a sequence of random events in an interactive application. In many embodiments, the interactive application is an electronic strategy-based game, wherein the sequence of one or more random outcomes simulate throws of dice that are associated with a user's action or a move in the electronic strategy-based game. The results of each throw of the dice are communicated to the interactive controller for utilization in accordance with the rules of the interactive application to advance play of the interactive application. In addition, a sequence of two or more throws of the dice are used to resolve a wagering outcome. In various embodiments, the sequence of one or more random outcomes simulates a series of die or dice throws or spinner spins that are used to resolve a sequence of random events in an electronic board game, wherein each die throw or spinner spin is associated with a movement along a path of the electronic board game. The results of each die or dice throw are communicated to the interactive controller for use in the interactive application so that a user may advance through the game. In addition, a sequence of two or more die or dice throws or spinner spins are used to resolve a wagering outcome. In several embodiments, the sequence of one or more random outcomes simulate a series of random tile draws used to resolve a sequence of random events in an electronic word game. The results of each tile draw are communicated to the interactive controller for use in the interactive application so that a user may play the electronic word game. In addition, the sequence of two or more tile draws are used to resolve a wagering outcome.

FIGS. 17A to 17H illustrate a display of a user interface of an integrated wagering process interleaved wagering system in accordance with embodiments of the invention. In the figures, elements having the same element identifiers refer to either the same element or elements having the same functions. The interactive application displayed is an electronic strategy game in which users compete against each other or a computer to take and hold regions of a game board through simulated military-themed battles simulated using die throws. As illustrated, the display 2100 includes an interactive application portion (including a stylized world map) and a wagering outcome display portion 2200.

The wagering outcome display portion 2200 is operational to display information about the wagering proposition of the hybrid game. The wagering outcome display portion 2200 of the display includes, but is not limited to, a display of a denomination of the game 2202, a display of an amount of real currency credits 2204 attributed to the user, and an amount of real currency credits 2206 about to be wagered.

The world map is divided into a plurality of world regions, such as regions 2102 and 2104, corresponding roughly with continents, sub-continents and/or large countries. A user may place one or more application resources representing "armies" or "troops", such as game resources 2106 and 2108, in each region controlled by a user. A user may "attack" another adjacent region from a particular region using the one or more application resources in that particular region. To do so, the user selects one of their regions (for example, as illustrated, the user has selected region 2102 having application resources 2106) and then selects another adjacent region to attack (for example, as illustrated, region 2104 having application resources 2108). Upon selection, the application resources for each selected region are displayed (for example, as illustrated "Your Armies" 2120 and "Enemy Armies" 2122.) In addition, an amount of credits 2124 that the attacking user is about to wager is displayed. An "odds" button 2126 is selectable to display to a user the odds and/or pay tables associated with the user's proposed move. An "attack" button 2128 is operable to perform the proposed move or action.

Figure 17A:
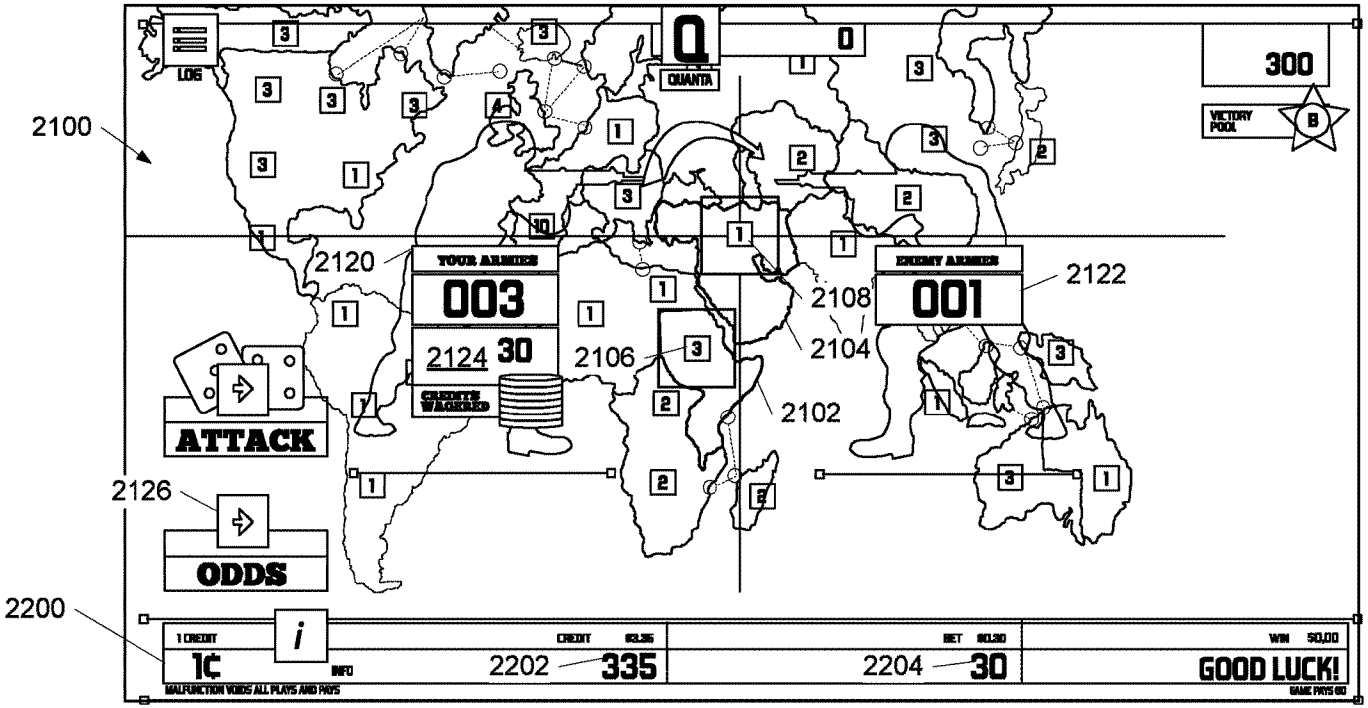
FIGS. 17A-17H illustrate a display of a user interface of an integrated wagering process interleaved wagering system in accordance with embodiments of the invention.
Figure 17B:
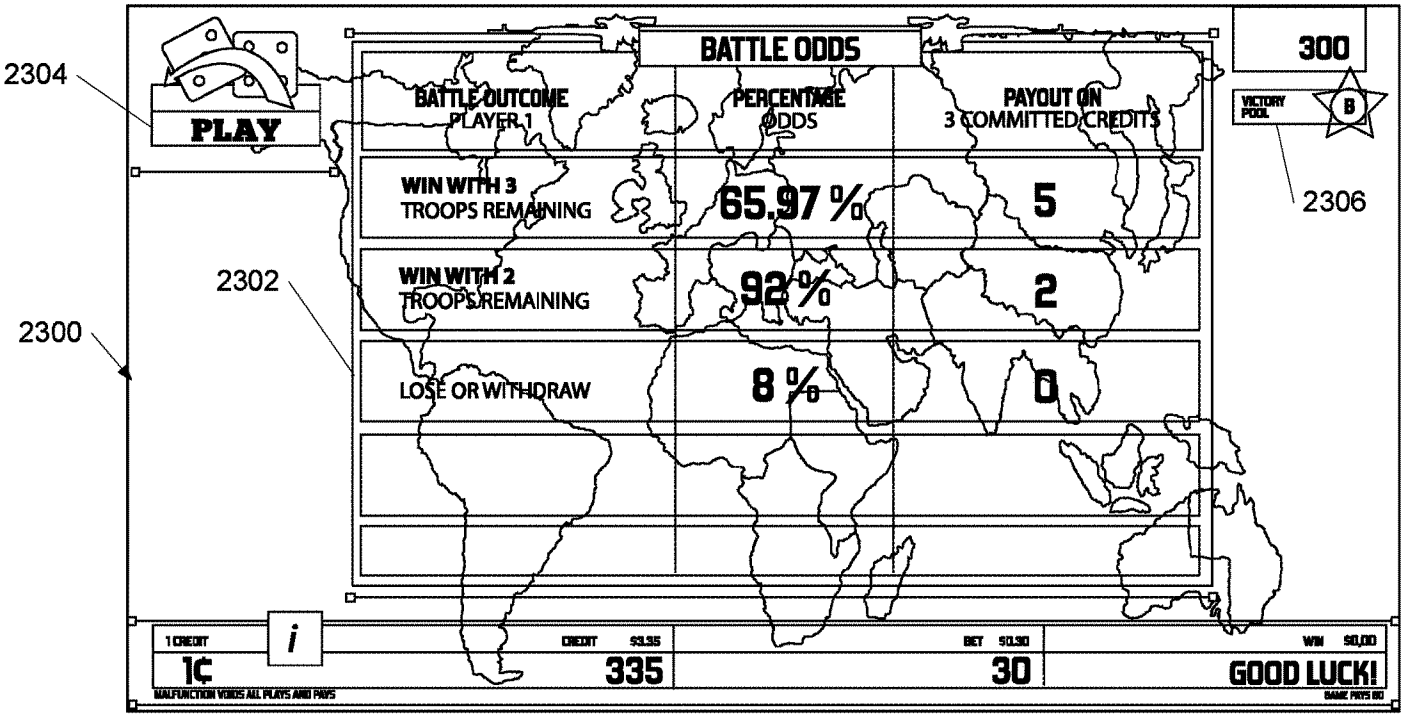

Referring now to FIG. 17B, an odds and pay table display for a proposed move by a user is illustrated in accordance with embodiments of the invention. The display 2300 includes a table 2302 including a plurality of columns. In a first column, possible battle outcomes are displayed. In a second column, a probability that a particular battle outcome will occur is shown. In a third column, a payout for a specified number of credits is shown. The odds and pay table display includes a "play" button 2304 selectable to cause the proposed battle to take place. In some embodiments, an amount of a credit pool 2306 available to a user on achieving a particular goal in the interactive application is displayed.

In some embodiments, the number of real world credits committed to a proposed action or move is equal to, or is a function of, the number of interactive application resources the user is willing to commit to the proposed action or move. Accordingly, the odds table is generated based on the game state of the interactive application being played as well as a pay table for a wagering proposition. The game state of the interactive application may include, but is not limited to, an amount of application resources available to the user, a position or location within a game world of the interactive application, an amount of application resources that a user may be proposing to commit to a move or operation, etc.

Figure 17C:
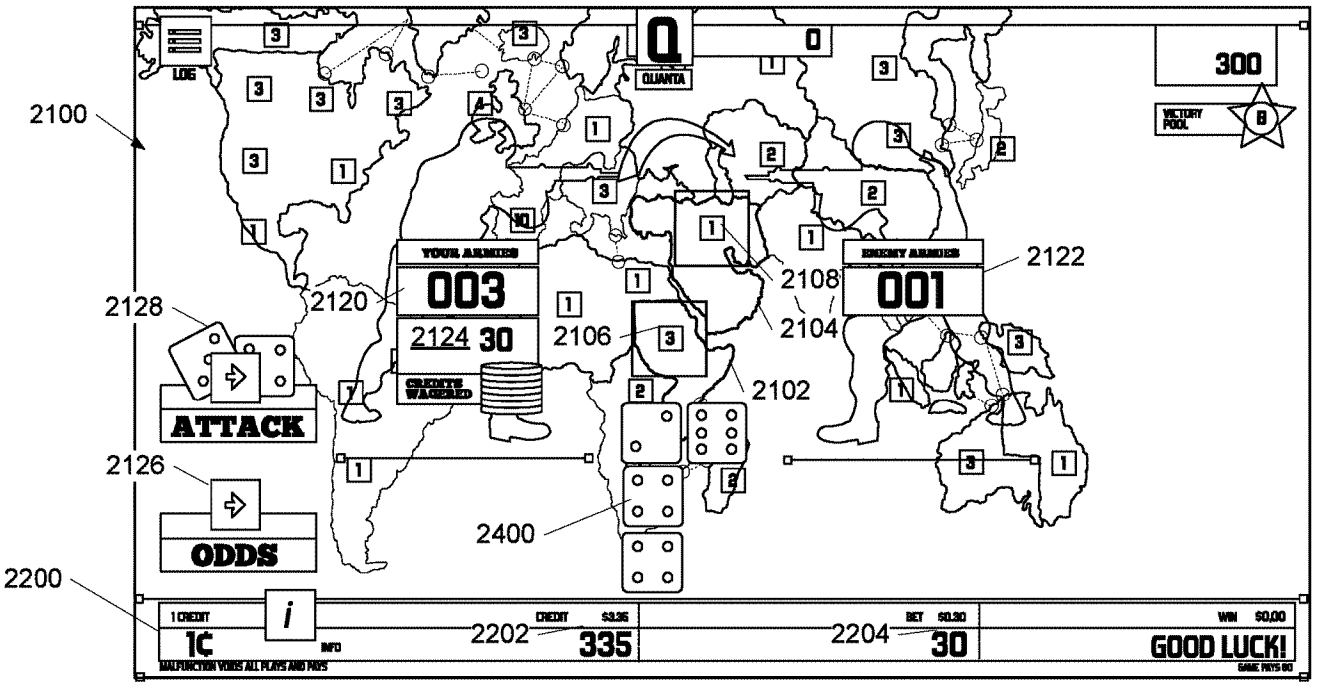

Referring now to FIG. 17C, an operation of the display 2100 during a user move or action is illustrated in accordance with embodiments of the invention. As illustrated, the "attack" button 2128 has been selected in order to initiate the user's move or action. Selection of the attack button by the user indicates an occurrence of a random event in the interactive application. Selection of the attack button may also indicate an occurrence of a wagering event. In the display, an outcome 2400 of a result of a random event in the interactive application is displayed. In this embodiment, a result of a simulated dice throw is illustrated although other types of representations of the outcome of the random result may be utilized as appropriate for the underlying interactive application.

Continuing the exemplary embodiment, three dice are shown as having been thrown for the user, as that is the number of interactive application resources that the user has committed to the proposed move or action, whereas the user's opponent has only thrown a single die, representing the number of interactive application resources that the opponent has available to oppose the user's move or action. The results of the dice throw are one possible random outcome resolution to the random event in the interactive application; however, additional random outcomes of a sequence of random outcomes are to be determined before the wagering event can be resolved. In the simulated throw, the user rolled a two, a four and a four, whereas the user's opponent has thrown a single six. As none of the user's dice have a thrown value greater than the opponent's single thrown value of six, the user will lose one interactive application resource. Also, as the user's move is not yet complete (as the user has neither completed the proposed move or action nor has the user withdrawn from the move or action) a wagering outcome of the wager has yet to be resolved.

Figure 17D:
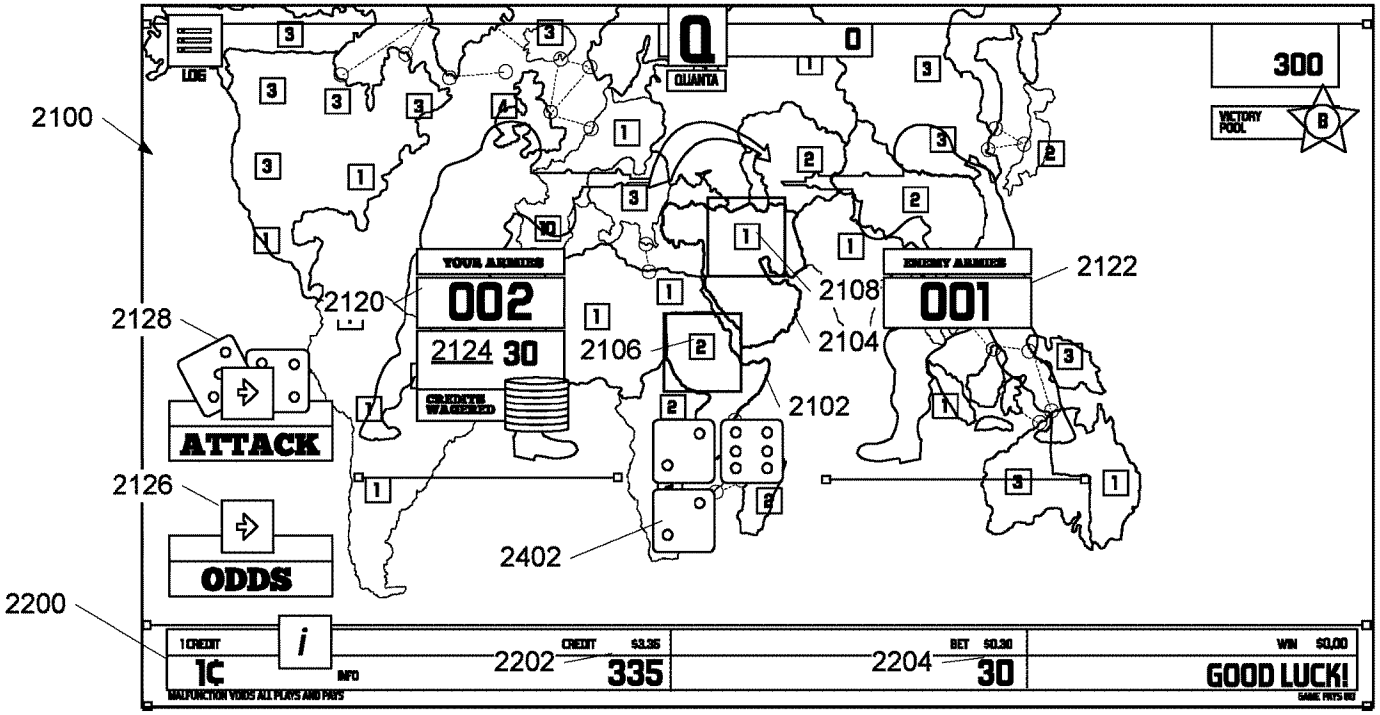

Referring now to FIG. 17D, the user has lost an interactive application resource as reflected by the numeral "2" being displayed 2106. In addition, the loss of resources is reflected in the interactive application resource display 2120. As the wagering event has yet to be resolved, the wagered amount 2124 remains the same. In addition, the amount of credits 2202 attributed to the user has not been updated.

Continuing the description of the exemplary embodiment, in the display, a random outcome 2402 of a resolution to a random event is displayed. Two dice are shown as having been thrown for the user, as that is the number of interactive application resources that the user has committed to the proposed move or action, whereas the user's opponent has only thrown a single die, representing the number of interactive application resources that the opponent has available to oppose the user's move or action. In the simulated throw, the user rolled two twos, whereas the user's opponent has thrown a single six. As none of the user's dice have a thrown value greater than the opponent's single thrown value of six, the user will lose one interactive application resource. Also, as the user's move is not yet complete (as the user has neither completed the proposed move or action nor has the user withdrawn from the move or action) a wagering outcome of the wager has yet to be resolved as the sequence of random outcomes is not yet complete.

Figure 17E:
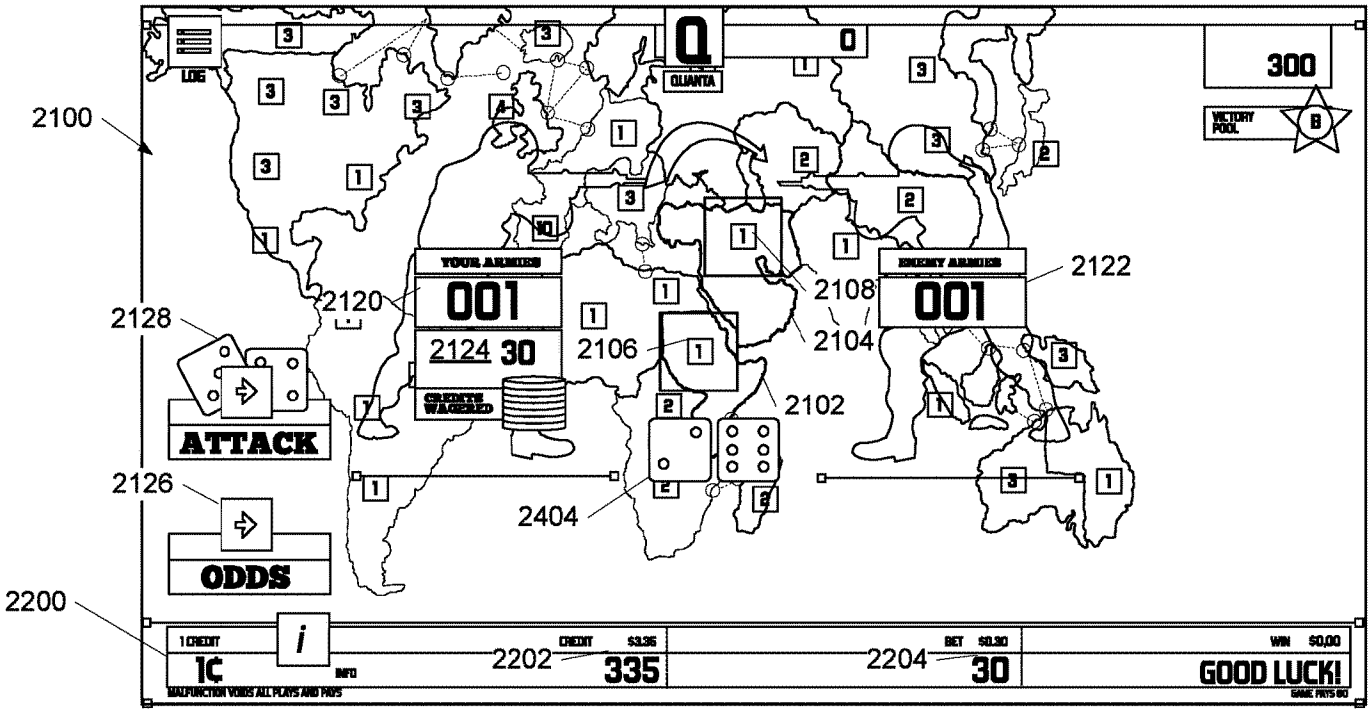

Referring now to FIG. 17E, the user has lost an interactive application resource as reflected by the numeral "1" being displayed 2106. In addition, the loss of resources is reflected in the interactive application resource display 2120. As the wagering event has yet to be resolved, the wagered amount 2124 remains the same. In addition, the amount of credits 2202 attributed to the user has not been updated.

Continuing the description of the operation of the exemplary embodiment, in the display, a random outcome 2404 of a result of a random event is displayed. One die is shown as having been thrown for the user, as that is the number of interactive application resources that the user has committed to the proposed move or action, whereas the user's opponent has also thrown a single die, representing the number of interactive application resources that the opponent has available to oppose the user's move or action. In the simulated throw, the user rolled a two, whereas the user's opponent has thrown a single six. As the user's die has thrown a value less than the opponent's thrown value of six, the user will lose one interactive application resource. The sequence of random events is now complete, and the wagering event can now be resolved.

Figure 17F:
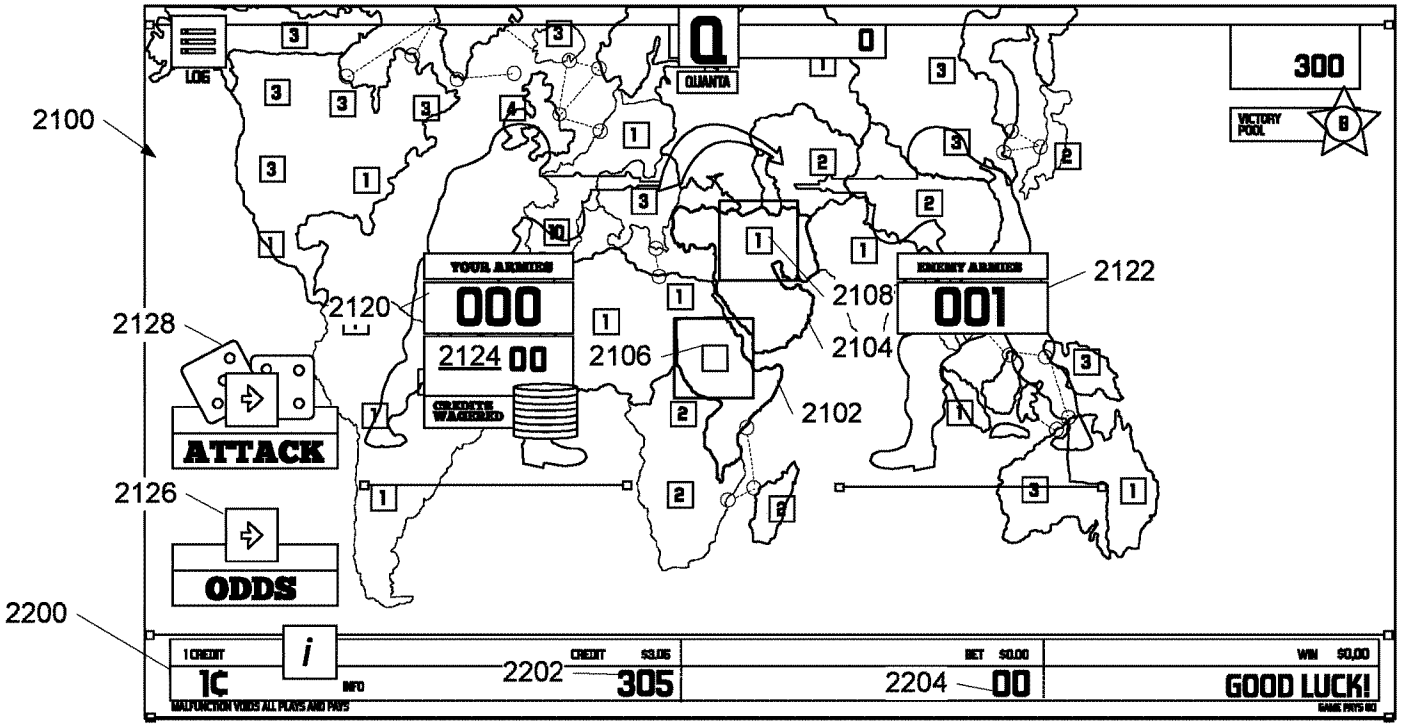

Referring now to FIG. 17F, the user has lost an interactive application resource as reflected by no interactive application resources being displayed 2106. In addition, the loss of resources is reflected in the interactive application resource display 2120. As the sequence of random outcomes represented by simulated dice throws is now complete, the wagering event can now be resolved using the sequence of random outcomes. In this example, the wagering outcome is a loss to the user, and the wagered amount 2124 and 2204 are zeroed out. In addition, the amount of credits 2202 attributed to the user has been updated to reflect the loss.

Figure 17G:
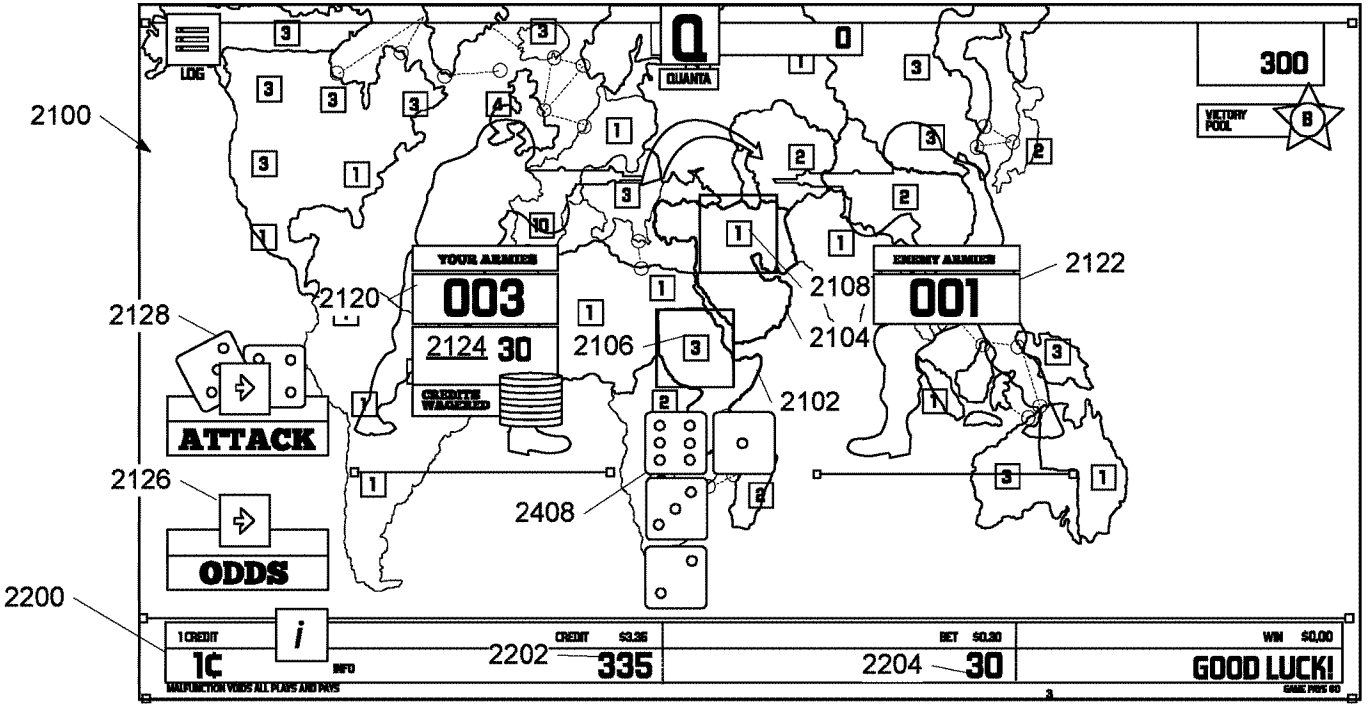

Referring now to FIG. 17G, an operation of the display 2100 during a user move or action as the user is winning a wager with a winning wagering outcome is illustrated in accordance with embodiments of the invention. As illustrated, the "attack" button 2128 has been selected in order to initiate the user's move or action. In the display, a random outcome 2408 of a result of a random event is displayed. In this embodiment, a result of a simulated dice throw is illustrated although other types of representations of the outcome of the random result may be utilized as appropriate for the underlying interactive application.

Continuing the description of the operation of the exemplary embodiment, three dice are shown as having been thrown for the user, as that is the number of interactive application resources that the user has committed to the proposed move or action, whereas the user's opponent has only thrown a single die, representing the number of interactive application resources that the opponent has available to oppose the user's move or action. In the simulated throw, the user rolled a six, a three and a two, whereas the user's opponent has thrown a single one. As at least one of the user's dice has a thrown value greater than the opponent's single thrown value of one, the user has completed the proposed move or action by "winning" the "battle." In addition, as the user's move or action is complete, a sequence of random outcomes is also complete and the user's wagering outcome can also be determined as a resolution to the wagering event. In this case, the user has a successful or winning wagering outcome.

Figure 17H:
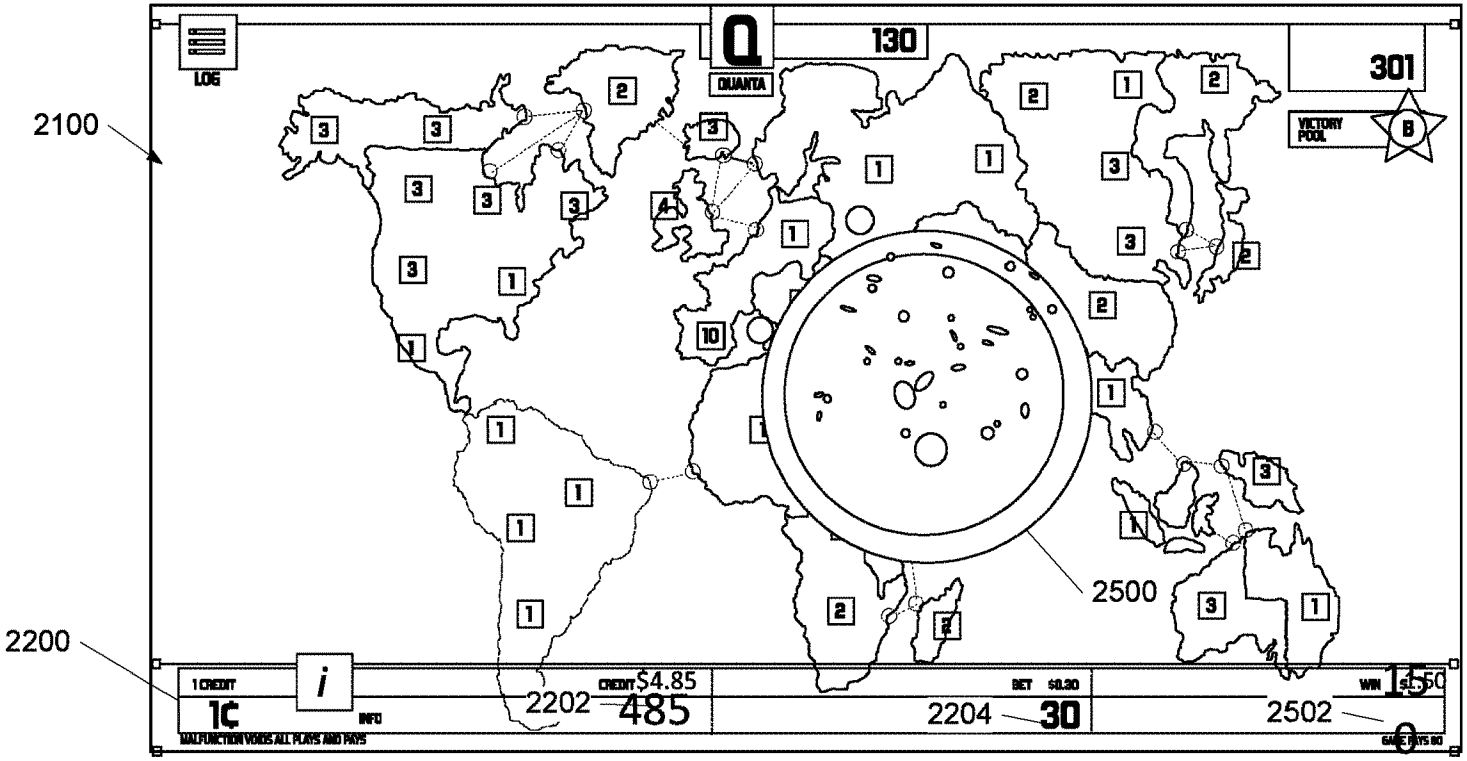

Referring now to FIG. 17H, the user has had a successful wagering outcome and a success display is generated 2500 within the context of the interactive application. In addition, the amount of credits attributed to the user 2202 has been updated as well as a display of credits won 2502.

In some embodiments, the integrated wagering process interleaved wagering system interactive application provides for 1-2 human users and 1-2 computer controlled participants, for a maximum of 3 participants total. In some embodiments, holding all of the territories in a continent nets AC bonuses. In some embodiments, application resources associated with a virtual currency credit are used and awarded to participants. In some embodiments, a successful "attack" nets virtual currency credit. In some embodiments, wagers may be placed on the outcome of an "attack." In some embodiments, application resources are not awarded by the application controller based on the wager outcome. Instead, application credits are awarded and application resources may be acquired in exchange for application credits.

In some embodiments, when the interactive application is an interactive game, a user wagers either for or against their victory in an "attack." In some embodiments, the payout of the wager will be based on the probability that the user's decision is correct. In an example embodiment, the user sends a single army against a single defending army. In some embodiments, the success of such an attack is 41.67%, which equates to approximately 2.4:1 odds. Conversely, the failure percentage of the attack is 58.33%, which equates to approximately 1.7:1 odds. In some embodiments, payouts are determined by rounding down 11% odds to the nearest whole number, creating a natural log curve leading to high rewards being from high risk wagers.

In some embodiments, an end of turn phase begins once users have ceased all combat actions. In some embodiments, a confirmation button exists to move onto the next step. In some embodiments, this is true for all steps where purchasing is possible. In some embodiments, users may purchase additional application resources during the end of turn phase. In some embodiments, users may purchase application resources at any time in between combats. In some embodiments, when users have finished all their purchases, they can click the confirmation button again to end their turn. In some embodiments, a button is displayed to the user which dynamically changes based on the context of the session (e.g., combat, end turn, etc.)

In some embodiments, credits may be used for wagering only. In some embodiments, application resources may be purchased using credits. In some embodiments, application credits may be earned. In some embodiments, virtual credits may be used to purchase application resources to provide the user an advantage. In some embodiments, the advantage includes: an ability to protect a territory for a predetermined number of rounds, an ability to automatically defeat a predetermined number of attacking troops, an ability to move a number of troops to any other territory, an ability to move a number of troops to a linked territory, an ability to add a number of troops to any territory based on a dice roll outcome, an ability to remove a number of troops from an enemy territory based on a dice roll outcome, an ability to roll an additional die on defense, and an ability to remove a predetermined number of troops from a chosen enemy territory each turn for a number of turns determined by a dice roll outcome.

In some embodiments, multiplayer sessions include three participants, with at least one human user and at least one computer controller participant. In some embodiments, an emoticon based chat system is included. In some embodiments, the computer controller participant has three difficulty settings. In some embodiments, scoring is based on the difficulty of the computer controlled participant. In an example embodiment, scoring is doubled for medium difficulty and tripled for hard difficulty. In some embodiments, a leaderboard is limited to ladder matches or other matchmaking. In some embodiments, there is no leaderboard for casual matches.

While the above description may include many specific embodiments of the invention, these should not be construed as limitations on the scope of the invention, but rather as examples of embodiments thereof. It is therefore to be understood that the present invention can be practiced otherwise than specifically described, without departing from the scope and spirit of the present invention. Thus, embodiments of the present invention described herein should be considered in all respects as illustrative and not restrictive.

What is claimed:

1. An integrated wagering process interleaved wagering system for an interactive application having a strategy-based game, comprising:

an interactive controller configured to:

communicate, to an application controller, application telemetry comprising an occurrence of at least one random event and an occurrence of at least one wagering event, wherein the random event and the wagering event are initiated by the user of the interactive application during gameplay of the strategy-based game;

receive, from the application controller, resolution instructions comprising a resolution to the occurrence of the at least one random event;

integrate the resolution to the occurrence of the at least one random event within the interactive application based on the resolution instructions;

display the resolution to the occurrence of the at least one random event as a gameplay outcome in the strategy-based game;

receive, from the application controller, wager outcome instructions comprising a resolution to the occurrence of the at least one wagering event; and display the resolution to the occurrence of the at least one wagering event based on the wager outcome instructions;

a wager controller constructed to:

receive, from the application controller, random outcome request instructions;

determine a sequence of at least one random outcome based on the random outcome request instructions; and communicate, to the application controller, random outcome data comprising the sequence of at least one random outcome; and the application controller operatively connecting the interactive controller and the wager controller, the application controller constructed to:

receive, from the interactive controller, the application telemetry;

scan the application telemetry to determine the occurrence of at least one random event and the occurrence of at least one wagering event;

generate the random outcome request instructions based on determination of the occurrence of at least one random event and the occurrence of at least one wagering event;

instruct the wager controller by communicating the random outcome request instructions to the wager controller;

receive, from the wager controller, the random outcome data;

scan the random outcome data to determine the sequence of the at least one random outcome;

determine the resolution to the occurrence of the at least one random event and the resolution to the occurrence of the at least one wagering event based on the sequence of at least one random outcome;

generate the resolution instructions using the resolution to the occurrence of the at least one random event;

instruct the interactive controller by communicating the resolution instructions to the interactive controller;

generate the wager outcome instructions using the resolution to the occurrence of the at least one wagering event; and instruct the interactive controller by communicating the wager outcome instructions to the interactive controller.

2. The integrated wagering process interleaved wagering system for an interactive application having a strategy-based game of claim 1, wherein the interactive controller and the application controller are constructed from the same device, and wherein the application controller is operatively connected to the wager controller using a communication link.

3. The integrated wagering process interleaved wagering system for an interactive application having a strategy-based game of claim 1, wherein the wager controller and the application controller are constructed from the same device, and wherein the application controller is operatively connected to the interactive controller using a communication link.

4. The integrated wagering process interleaved wagering system for an interactive application having a strategy-based game of claim 1, wherein the determining of the sequence of one or more random outcomes comprises caching one or more intermediate random outcomes, and wherein the resolution to the occurrence of the at least one wagering event is based on the cache of one or more intermediate random outcomes.

5. The integrated wagering process interleaved wagering system for an interactive application having a strategy-based game of claim 1, wherein the application controller is further constructed to cache one or more intermediate random outcomes of the sequence of one or more random outcomes.

6. The integrated wagering process interleaved wagering system for an interactive application having a strategy-based game of claim 5, wherein the resolution to the occurrence of the at least one random event is based on the cached one or more intermediate random outcomes.

7. The integrated wagering process interleaved wagering system for an interactive application having a strategy-based game of claim 1, wherein the application controller is further constructed to:

receive, from a user management system, user information; and determine the resolution to the occurrence of the at least one wagering event based on the sequence of one or more random outcomes and the user information.

8. The integrated wagering process interleaved wagering system for an interactive application having a strategy-based game of claim 1, wherein the application controller is further constructed to:

receive, from a game provider system, game provider information; and determine the resolution to the occurrence of the at least one wagering event based on the sequence of one or more random outcomes and the game provider information.

* * * * *